US005264332A

United States Patent [19]

Otani et al.

[11] Patent Number: 5,264,332

[45] Date of Patent: Nov. 23, 1993

[54] SILVER HALIDE COLOR PHOTOGRAPHIC MATERIAL

[75] Inventors: Shigeaki Otani; Hiroyuki Yoneyama, both of Minami-ashigara, Japan

[73] Assignee: Fuji Photo Film Co., Ltd., Kanagawa, Japan

[21] Appl. No.: 774,539

[22] Filed: Oct. 8, 1991

[30] Foreign Application Priority Data

Oct. 8, 1990 [JP] Japan ..... 2-269912
Oct. 8, 1990 [JP] Japan ..... 2-269913

[51] Int. Cl.[5] ..... G03C 1/08

[52] U.S. Cl. ..... 430/508; 430/372; 430/551; 430/550; 430/553; 430/572; 430/576; 430/545

[58] Field of Search ..... 430/508, 550, 551, 372, 430/545, 553, 572, 576

[56] References Cited

U.S. PATENT DOCUMENTS

| | | | |
|---|---|---|---|
| 2,360,290 | 10/1944 | Vittum et al. | 430/372 |
| 2,384,658 | 9/1945 | Vittum et al. | 430/540 |
| 2,403,721 | 7/1946 | Jelley et al. | 430/523 |
| 2,675,314 | 4/1954 | Vittum et al. | 430/372 |
| 2,728,659 | 12/1955 | Loria et al. | 430/551 |
| 2,732,300 | 1/1956 | Thirtle et al. | 430/551 |
| 2,735,765 | 2/1956 | Loria et al. | 430/551 |
| 3,700,453 | 10/1972 | Kuechel | 430/505 |
| 3,773,510 | 11/1973 | Fisch | 430/393 |
| 4,945,031 | 7/1990 | Sakai et al. | 430/393 |
| 5,057,405 | 10/1991 | Shiba et al. | 430/508 |

FOREIGN PATENT DOCUMENTS

| | | |
|---|---|---|
| 0126455 | 11/1984 | European Pat. Off. . |
| 0280238 | 8/1988 | European Pat. Off. . |
| 0320821 | 6/1989 | European Pat. Off. . |
| 0368356 | 5/1990 | European Pat. Off. . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

There is disclosed a silver halide color photographic material containing a support having thereon three color-forming layers, which comprises, in said color-forming silver halide emulsion layers, high-silver-chloride grains, silver halide grains in the cyan color-forming layer being spectrally sensitized with a red-sensitive sensitizing dye having a prescribed reduction potential, and/or, in the cyan color-forming layer, an oil-soluble cyan coupler that cause coupling reaction with the oxidized product of an aromatic primary amine developing-agent to form a nondiffusible dye, a compound represented by formula (I) or (II), and a compound represented by formula (II) or (IV).

Formula (I)

Formula (II)

Formula (III)

Formula (IV)

wherein $R_1$ and $R_3$ each represent a hydrogen atom, an alkyl group, or a halogen atom, $R_2$, $R_4$, $R_5$, $R_7$, and $R_8$ (Abstract continued on next page.)

each represent independently an alkyl group, an aryl group, an alkoxy group, an aryloxy group, alkylthio group, an arylthio group, an amido group, an acyl group, an alkoxycarbonyl group, an aryloxycarbonyl group, a carbamoyl group, a sulfamoyl group, or a sulfoxido group, the number of carbon atoms of each of $R_2$ and $R_4$ is 6 or more, $R_6$ represents an alkylene group, n is 0 or 1, and $M\oplus$ represents a cation.

23 Claims, No Drawings

SILVER HALIDE COLOR PHOTOGRAPHIC MATERIAL

FIELD OF THE INVENTION

The present invention relates to silver halide color photographic materials, and more particularly to a silver halide color photographic material that is suitable for rapid processing and wherein the change of the cyan dye density due to a change in the composition of a processing solution is improved. Further, the present invention relates to a silver halide color photographic material in which deterioration of the image during the storage of the print due to a change in the cyan dye density after the color-development processing step is improved, and the change of sensitivity and gradation (latent-image preservability) during the period from exposure to light to the development processing is improved.

BACKGROUND OF THE INVENTION

To form a color photographic image, photographic couplers for three colors; that is, for yellow, magenta, and cyan, are contained in photosensitive layers, and after exposure to light they are processed with a color developer containing a color-developing agent. In this step, the couplers react with the oxidized product of an aromatic primary amine to form color-formed dyes.

Generally, the standard processing steps of silver halide color photographic materials comprise a color-development step of forming a color image, a desilvering step of removing developed silver and undeveloped silver, and a washing step and/or an image stabilizing step.

Although efforts have hitherto been made to shorten the processing time, recently the need for shortening the processing time has heightened because of a demand for shortening the time of the delivery of the finished product, a demand for reduction of labor in the photofinisher, a demand for minimizing the processing system for a small-scale photofinisher (a so-called compact lab), and a demand for simplification of the operation.

Shortening the time of the color-development step can be attained by suitably combining the use of a coupler whose coupling speed is increased as much as possible, the use of a silver halide emulsion whose developing speed is high, the use of a color developer whose developing speed is high, and by increasing the temperature of the color developer.

The shortening of the desilvering step can be attained by lowering the pH of the bleaching solution and the bleach-fix solution. That the bleach-fix may be quickened by lowering the pH of the bleach-fix solution is described in *The Theory of the Photographic Process, Chapter* 15, *E. Bleach-Fix System.*

However, lowering the pH of the bleach-fix solution increases the bleaching speed, but the dye formed from a cyan coupler is decolored by leuco dye formation and it is not restored until completion of the processing (hereinafter this phenomenon is referred to as insufficiency of color formation), causing a drop in the density and leading to the problem of the color being gradually restored after processing and the color balance being lost, which lowers the image quality.

As a means of improving this, there is an improved method wherein, after color development, washing is carried out, and after removing the developing agent, a bleach-fix process is carried out. But the method is accompanied by defects in that the number of steps increases and the total period of processing becomes longer.

As other improving means, addition of a water-soluble ionic compound containing a polyvalent element to a bleach-fix bath is suggested, for example, in U.S. Pat. No. 3,773,510, but that technique has defects in that the load on pollution increases and the intended purpose is not yet satisfactory.

Conventionally, for the purpose of adjusting the gradation, preventing fogging, and preventing fading of mainly magenta dyes, the use of hydroquinones and quinones is described in JP-A ("JP-A" means unexamined published Japanese patent application) Nos. 161238/1980, 60647/1985, and 32034/1978, West German Patent Application Laid-Open Nos. 2,149,789 and 3,320,483Al, JP-A Nos. 24141/1983 and 2128/1971, JP-B ("JP-B" means examined Japanese patent publication) Nos. 4934/1968, 21249/1975, and 3171/1985, JP-A Nos. 106329/1974 and 129535/1974, British Patent No. 1,465,081, JP-A Nos. 129536/1974,134327/1974, 110337/1975, 156438/1975, 6024/1976, 9828/1976, 14023/1976, 65432/1977, 128130/1977, 146234/1977, 146235/1977, 9528/1978, 55121/1978, 139533/1978, 24019/1979, 25823/1979, 29637/1979, 70036/1979, 97021/1979, 133181/1979, 95948/1980, 5543/1981, 83742/1981, 85748/1981, 87040/1981, 153342/1981, 112749/1982, 176038/1982, 136030/1983, 72443/1984, 75249/1984, 83162/1984, 101650/1984, 180557/1984, 60647/1985, 189342/1984, 191031/1984, 55339/1985, and 263149/1985, *Research Disclosure* (R.D.) 22827 (1983), and U.S. Pat. Nos. 2,384,658, 2,403,721, 2,728,659, 2,735,765, 3,700,453, 2,675,314, 2,732,300, and 2,360,290 and the prevention of fogging particularly by using a hydroquinone substituted by an electron attractive group in an intermediate layer is described in JP-B No. 35012/1984, and JP-A Nos. 109344/1981 and 22237/1982. But they do not disclose anything as to insufficiency of color formation.

It is known that the addition of a hydroquinone is liable to bring about the insufficiency of color formation when hydroquinone is used in a bleach-fix bath whose pH is high and into which a color developer has interfused; on the contrary JP-A No. 60647/1985 suggests reducing the amount of hydroquinones to be used.

Further, JP-A No. 316857/1988 suggests the use of alkyl-group-substituted hydroquinones or quinones to improve the insufficiency of color formation in a bleach-fix bath whose pH is low, and although the effect is indeed recognized, further improvement is desired. Also, in this method a new problem has been found. When the processed photographic material is stored under very intense light, the cyan image is deteriorated.

Further, JP-A No. 316857/1988 suggests the use of halogen-substituted hydroquinones or quinones to improve the insufficiency of color formation in a bleach-fix bath whose pH is low and to improve on the deterioration of the cyan color image. But a new problem has been found that when the halogen-substituted hydroquinones or quinones are used in a red-sensitive layer, the change of sensitivity and gradation (hereinafter referred to as latent-image preservability) during the period from exposure to light to the development processing is conspicuous.

JP-A No. 189649/1989 describes that a red-sensitive sensitizing dye having a reduction potential of −1.25 V (vs SEC) or more negative can improve the preservability of a raw stock (unexposed and unprocessed photographic material) with time, but it describes neither latent-image preservability nor the insufficiency of color formation.

SUMMARY OF THE INVENTION

Therefore, the first object of the present invention is to provide a silver halide color photographic material wherein the color formation of the cyan dye image is improved and the color balance of the image after processing is not lost, and thereby the image is improved.

The second object of the present invention is to provide a silver halide color photographic material good in preservability of the cyan color image.

The third object of the present invention is to provide a silver chloride color photographic material excellent in latent-image preservability.

The fourth object of the present invention is to provide a silver halide color photographic material whose color development can be effected in a short period of time; that is, whose rapid processability is excellent.

The above and other objects, features, and advantages of the present invention will become apparent from the detailed description to follow taken in conjunction with the appended claims.

DETAILED DESCRIPTION OF THE INVENTION

The inventors have studied keenly and have found that the above objects can be attained by providing the following color photographic materials.

One of preferred embodiments of the present invention is a multilayer silver halide color photographic material comprising a support having thereon a yellow color-forming silver halide emulsion layer, a magenta color-forming silver halide emulsion layer, and a cyan color-forming silver halide emulsion layer, which comprises, in said color forming silver halide emulsion layers, silver halide grains that are composed of silver chloride or silver chlorobromide having a silver chloride content of 80 mol% or more and substantially free from silver iodide, said silver halide grains in said cyan color-forming layer being spectrally sensitized with at least one red-sensitive sensitizing dye having a reduction potential of −1.25 V (vs SCE) or more negative, at least one compound represented by the following formula (I) or (II) and at least one compound represented by the following formula (III) or (IV) in said cyan color-forming silver halide emulsion layer:

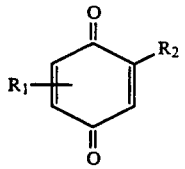

Formula (I)

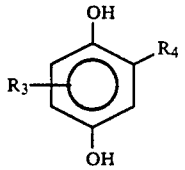

Formula (II)

-continued

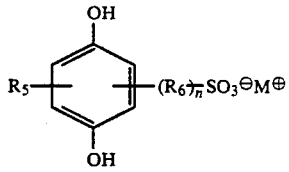

Formula (III)

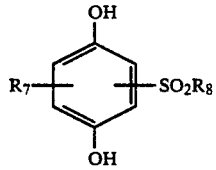

Formula (IV)

wherein $R_1$ and $R_3$ each represent a hydrogen atom, an alkyl group, or a halogen atom, $R_2$, $R_4$, $R_5$, $R_7$, and $R_8$ each represent independently an alkyl group, an aryl group, an alkoxy group, an aryloxy group, alkylthio group, an arylthio group, an amido group, an acyl group, an alkoxycarbonyl group, an aryloxycarbonyl group, a carbamoyl group, a sulfamoyl group, or a sulfoxido group, the number of carbon atoms of each of $R_2$ and $R_4$ is 6 or more, $R_6$ represents an alkylene group, n is 0 or 1, and $M^{\oplus}$ represents a cation (herein referred to as first embodiment).

Another preferable embodiment of the present invention is a multilayer silver halide color photographic material containing a support having thereon a yellow color-forming silver halide emulsion layer, a magenta color-forming silver halide emulsion layer, and a cyan color-forming silver halide emulsion layer, which comprises, in said cyan color forming silver halide emulsion layer, silver halide grains having a silver chloride content of 90 mol% or more, at least one oil-soluble cyan coupler that will couple with the oxidized product of an aromatic primary amine developing-agent to form a substantially nondiffusible dye, at least one compound selected from the group consisting of compounds represented by formulae (I) and (II), and at least one compound selected from the group consisting of compounds represented by formulae (III) and (IV) (herein referred to as second embodiment).

Compounds represented by formulae (I), (II), (III), and (IV) are described in detail.

In formulae (I) and (II), $R_1$ and $R_3$ each represent a hydrogen atom, an alkyl group, or a halogen atom. The alkyl group includes a substituted alkyl group and an unsubstituted alkyl group, with a linear or branched alkyl group having 1 to 40 carbon atoms, such as a methyl group, an n-hexyl group, and a sec-hexyl group particularly preferred. $R_1$ and $R_3$ each particularly preferably represent a halogen atom, more preferably Cl and Br.

In formulae (I), (II), (III), and (IV), $R_2$, $R_4$, $R_5$, $R_7$, and $R_8$ each represent independently an alkyl group (preferably one having 6 to 40 carbon atoms, which may be linear or branched, such as sec-dodecyl, n-hexadecyl, and sec-eicosyl), an aryl group (preferably one having 6 to 40 carbon atoms, such as phenyl and p-tolyl), an alkoxy group (preferably one having 6 to 40 carbon atoms, such as tetradecyloxy and hexadecyloxy), an aryloxy group (preferably one having 6 to 40 carbon atoms, such as phenoxy and p-acetamidophenoxy), an alkylthio group (preferably one having 6 to 40 carbon atoms, such as dodecylthio and octadecylthio), an arylthio group (preferably one having 6 to 40 carbon atoms, such as phenylthio), an amido group (preferably one having 6 to 40 carbon atoms, such as benzoylamino and hexadecaneamido), an acyl group (preferably one having 6 to 40 carbon atoms, such as benzoyl and hexadecanoyl), an alkoxycarbonyl group (preferably one having 6 to 40 carbon atoms, such as hexadecyloxycarbonyl), an aryloxycarbonyl group (preferably one having 7 to 40 carbon atoms, such as phenoxycarbonyl), a carbamoyl group (preferably one having6 to 40 carbon atoms, such as N-dodecylcarbamoyl and N,N- diphenylcarbamoyl), a sulfamoyl group (preferably one having 6 to 40 carbon atoms, such as N,N-dihexylsulfamoyland N-phenylsulfamoyl), or a sulfoxido group (preferably one having 6 to 40 carbon atoms, such as as hexadecasulfoxido). The number of carbon atoms of each of $R_2$, $R_4$, $R_5$, $R_7$, and $R_8$ is 6 or more.

The compounds represented by formula (I) and (II) may be in the bis-form, the tris-form, or the form of an oligomer or a polymer.

In formulae (I) and (II), preferably $R_2$ and $R_4$ each represent an alkyl group, an alkylthio group, or an amido group, most preferably an alkyl group.

$R_1$ and $R_2$ in formula (I) and $R_3$ and $R_4$ in formula (II) are preferably in the 2- and 5-positions relative to one another.

$R_6$ in formula (III) represents a linear or branched alkylene group preferably having 1 to 4 carbon atoms. $M^+$represents a hydrogen ion, an alkali metal ion, an alkali earth metal ion, an ammonium ion, or other cationic ion.

In formula (III), preferably n is 0 and the number of carbon atoms constituting $R_5$ is preferably 10 or more, particularly 15 or more, with an alkyl group preferred among them.

Specific examples of the compounds represented by formulas (I), (II), (III), and (IV) included in the present invention are shown below, but the present invention is not restricted to them.

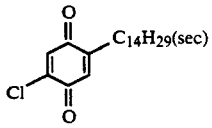

(I-1)

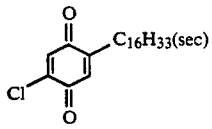

(I-2)

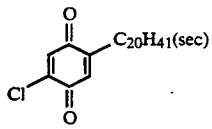

(I-3)

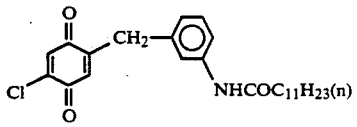

(I-4)

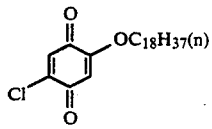

(I-5)

-continued

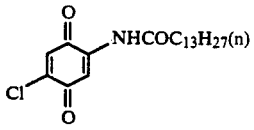

(I-6)

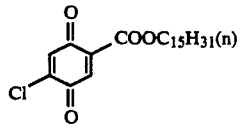

(I-7)

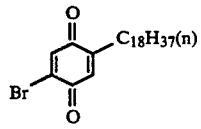

(I-8)

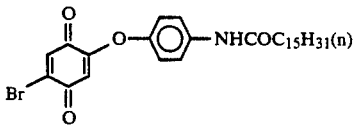

(I-9)

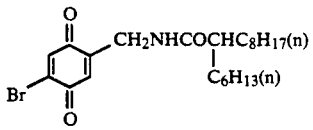

(I-10)

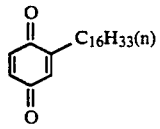

(I-11)

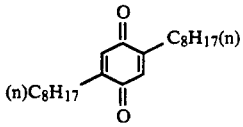

(I-12)

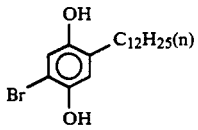

(II-1)

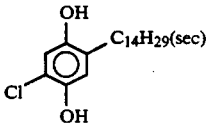

(II-2)

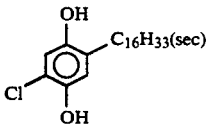

(II-3)

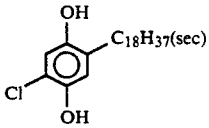

(II-4)

-continued
(II-5)
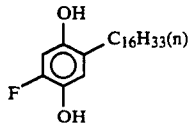
(II-6)
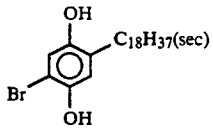
(II-7)
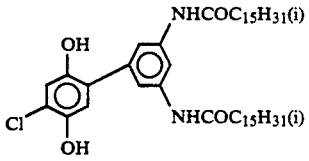
(II-8)
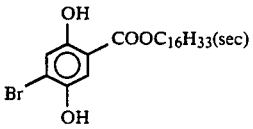
(II-9)
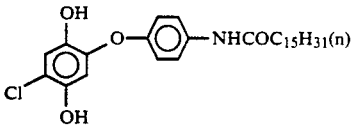
(II-10)
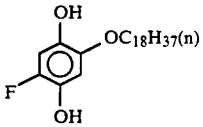
(II-11)
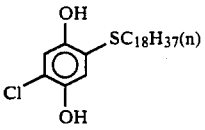
(II-12)
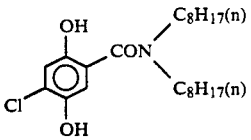
(II-13)
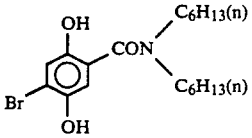
(II-14)
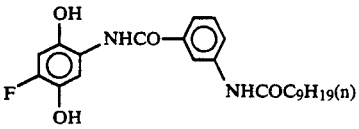
(II-15)
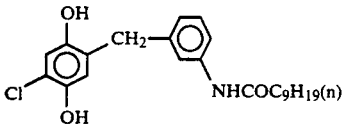
-continued
(II-16)
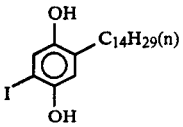
(II-17)
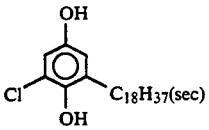
(II-18)
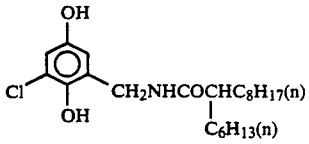
(II-19)
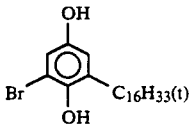
(II-20)
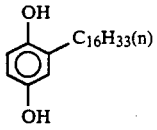
(II-21)
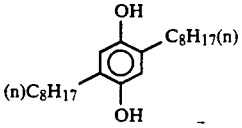
(II-22)
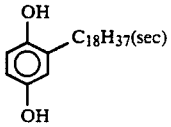
(II-23)
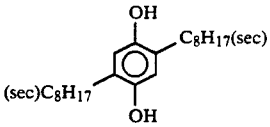
(III-1)
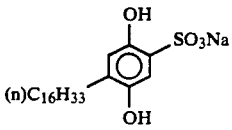
(III-2)
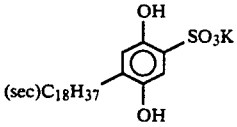
(III-3)
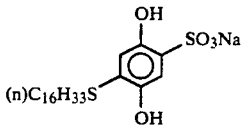

-continued (III-4)

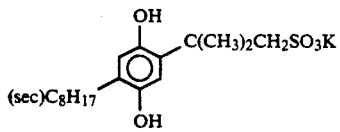

(III-5)

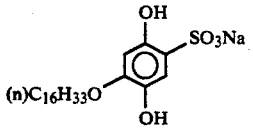

(III-6)

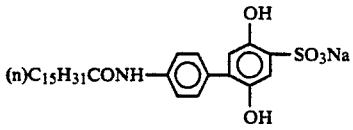

(III-7)

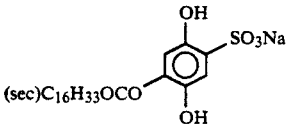

(III-8)

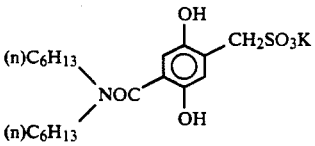

(III-9)

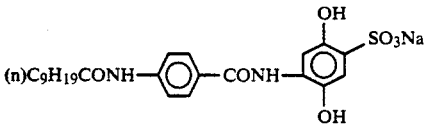

(III-10)

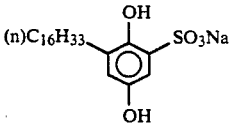

(IV-1)

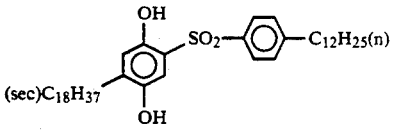

(IV-2)

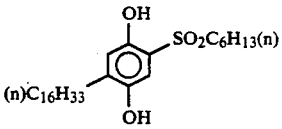

(VI-3)

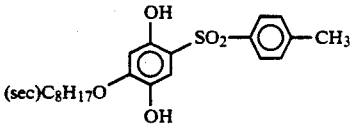

(IV-4)

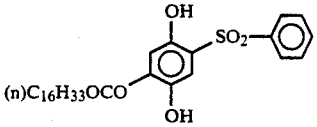

-continued (IV-5)

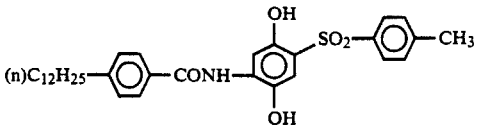

(IV-6)

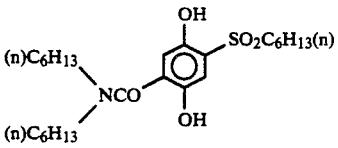

(IV-7)

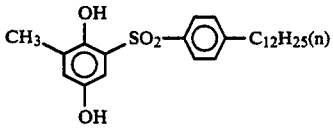

(IV-8)

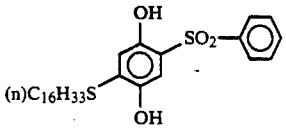

(IV-9)

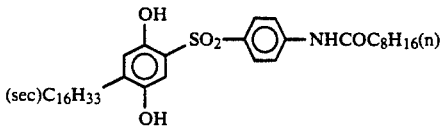

(IV-10)

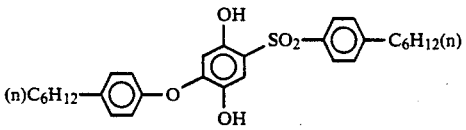

The quinones of formula (I) and/or the hydroquinones of formula (II) of the invention are used in an amount of 0.1 to 100 mol%, preferably 0.5 to 30 mol%, and more preferably 1 to 20 mol%, per mol of the cyan coupler.

When the compound of formula (I) and the compound of formula (II) are used in combination, although the ratio used can be varied, preferably the molar ratio of the compound of formula (I) to the compound of formula (II) is from 1/100 : 1 to 10 : 1.

The compound of formula (III) and/or the compound of formula (IV) of the present invention are used in an amount of 0.1 to 100 mol%, preferably 0.5 to 30 mol%, and more preferably 1 to 20 mol%, per mol of the cyan coupler.

When both the compound of formula (III) and the compound of formula (IV) are used, the ratio used can be varied arbitrarily.

The compounds of formulae (I), (II), (III), and (IV) can be added to the coating solution of the photographic constituting layer containing the cyan coupler directly or after being dissolved in a solvent that will not adversely affect the photographic material, such as water or an alcohol. Said compounds can be dissolved in a high-boiling organic solvent and/or a low-boiling organic solvent, and then the solution is emulsified and dispersed in an aqueous solution to be added. Also they can be used after emulsifying and dispersing them together with the cyan coupler.

The compound of formula (I), (II), (III), or (IV) of the invention is preferably present in the oil droplets in which the cyan coupler is present.

The use of the compound of formula (I), (II), (III), or (IV) of the present invention is particularly effective when a developing solution has interfused into a bleaching solution or a bleach-fix solution (which developing solution has been carried in from the bath preceding the bleaching bath or bleach-fix bath).

The compounds represented by formula (I), (II), (III), or (IV) can be synthesized on the basis of the following Synthesis Examples, or they can be synthesized generally in accordance with processes described in JP-A Nos. 109344/1981, 22237/1982, and 61287/1984, and British Patent No. 1,156,167.

SYNTHESIS EXAMPLE 1

(Synthesis of Exemplified Compound (II-3)

33.5 (0.1 mol) g of 2-sec-hexadecylhydroquinone was dissolved in 300 ml of methylene chloride, and 8.1 ml of sulfuryl chloride was added dropwise thereto over 30 min with stirring under room temperature. After stirring for 6 hours at room temperature the reaction mixture was allowed to stand overnight; then, ethyl acetate was added to carry out extraction, and after the ethyl acetate layer was washed three times with a 5% table salt solution, the ethyl acetate layer was dried with magnesium sulfate, concentrated, and purified by column chromatography(solvent: chloroform), to obtain 27 g of a pale brown oil of the intended 2-chloro-5-sec-hexadecylhydroquinone. The structure was identified by NMR and mass spectrometry.

Elemental analysis as $C_{22}H_{37}ClO_2$

Calculated (%) C: 71.61, H: 10.11

Found (%) C: 71.38, H: 10.35

SYNTHESIS EXAMPLE 2

Synthesis of Exemplified Compound (I-2)

18.5 g (0.05 mol) of the 2-chloro-5-sec-hexadecylhydroquinone obtained in Synthesis Example 1 was dissolved in 200 ml of ethyl acetate, 22 g of manganese dioxide (powder) was added to the solution, and they were stirred for 8 hours at 50° C. After allowed them to cool the manganese dioxide was filtered off, then the filtrate was condensed and was purified by column chromatography (solvent: chloroform), to obtain 15 g of a yellow oil of the intended 2-chloro-5-sec-hexadecyl-1,4- benzoquinone. The structure was identified by NMR and mass spectrometry.

Elemental analysis as $C_{22}H_{35}ClO_2$

Calculated (%) C: 72.01, H: 9.11

Found (%) C: 71.87, H: 9.35

The quinone of formula (I) and the hydroquinone of formula (II) of the present invention may be used alone or in combination.

The red-sensitive sensitizing dye used in the present invention is one having a reduction potential of −1.25 V (vs SCE) or more negative, preferably a reduction potential of −1.27 V (vs SCE) or more negative. The measurement of the reduction potential was carried out by phase discrimination-type second higher harmonics alternating current polarography. The details are described. As a solvent for the red-sensitive sensitizing dye, acetonitrile (spectral grade) dried in 4A-1/16 Molecular Sieve (trade name, manufactured by Wako Junyaku KK) was used, and as a support electrolyte, normal tetrapropyl ammonium perchlorate (an agent specially prepared for polarography) was used. The sample solution was prepared by dissolving the red-sensitive sensitizing dye in acetonitrile containing 0.1M of the support electrolyte, so that the amount of the red-sensitive sensitizing dye might be $10^{-3}$ to $10^{-5}$mol/l, and before the measurement the sample solution was deoxidized for more than 15 min with ultra-pure argon gas (99.999%) that had been first passed through a highly alkaline aqueous solution of pyrogallol, followed by calcium chloride. As the work electrode, a mercury dropping electrode was used, as the reference electrode, a saturated calomel electrode (SCE) was used, and as the counter electrode, platinum was used. The reference electrode and the sample solution were connected through a Luggin tube filled with acetonitrile containing 0.1M of the support electrolyte, and Vicor glass was used for the liquid-junction. The measurement was carried out at 25° C. with the tip of the Luggin tube and the tip of the mercury capillary spaced 5 to 8 mm apart. The measurement of the reduction potential by the phase discrimination-type second higher harmonics AC voltammetry using platinum as a reference electrode is described in "Journal of Imaging Science," Vol. 30, pages 27 to 35 (1986).

The red-sensitive sensitizing dyes to be used in the present invention are preferably represented by the following formulae (V), (VI), (VII), and (VIII):

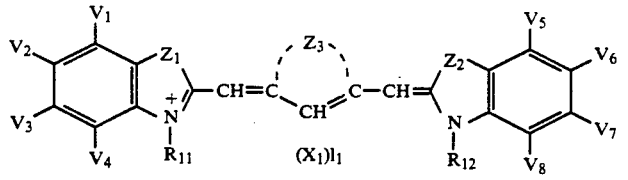

Formula (V)

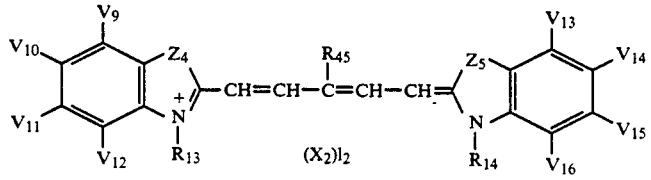

Formula (VI)

-continued

Formula (VII)

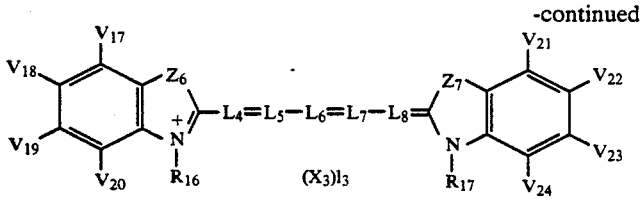

Formula (VIII)

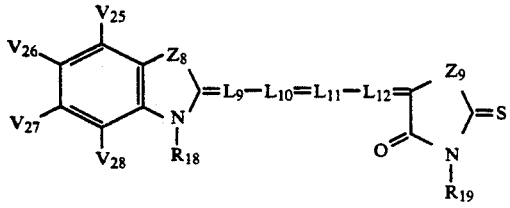

In formulae (V), (VI), (VII), and (VIII), $Z_1$, $Z_2$, $Z_4$, and $Z_5$ each represent a sulfur atom or a selenium atom.

$Z_6$ and $Z_7$ each represent an oxygen atom, a sulfur atom, a selenium atom, or a nitrogen atom, with at least one of them being an oxygen atom or a nitrogen atom.

$Z_8$ represents an oxygen atom, a sulfur atom, a selenium atom, or a nitrogen atom.

$Z_9$ represents an oxygen atom, a sulfur atom, or a nitrogen atom.

$Z_3$ represents a group of atoms required for forming a 5- or 6-membered ring.

$R_{11}$, $R_{12}$, $R_{13}$, $R_{14}$, $R_{16}$, $R_{17}$, and R18, which may be the same or different, each represent an alkyl group.

$R_{16}$ and $L_4$ and/or $R_{17}$ and $L_8$ and/or $R_{18}$ and $L_9$ may bond together to form a 5- or 6-membered ring.

$R_{19}$ represents an alkyl group, an aryl group, or a heterocyclic group.

$R_{15}$ represents an alkyl group or an alkoxy group.

$V_1$, $V_2$, $V_3$, $V_4$, $V_5$, $V_6$, $V_7$, $V_8$, $V_9$, $V_{10}$, $V_{11}$, $V_{12}$, $V_{13}$, $V_{14}$, $V_{15}$, $V_{16}$, $V_{17}$, $V_{18}$, $V_{19}$, $V_{20}$, $V_{21}$, $V_{22}$, $V_{23}$, $V_{24}$, $V_{25}$, $V_{26}$, $V_{27}$, and $V_{28}$ each represent a hydrogen atom, a halogen atom, an alkyl group, an acyl group, an acyloxy group, an alkoxycarbonyl group, a carbamoyl group, a sulfamoyl group, a carboxy group, a cyano group, a hydroxyl group, an amino group, an acylamino group, an alkoxy group, an alkylthio group, an alkylsulfonyl group, a sulfonic acid group, an aryloxy group, or an aryl group.

Among $V_{17}$ to $V_{28}$, these two which are bonded to adjacent carbon atoms may form a condensed ring.

The Hammett $\alpha p$ values of $V_1$ to $V_8$ are represented by $Y_1 \leqq -0.15$, wherein their Hammett $\sigma p$ value is designated $\sigma pi$ (i=1 to 8), and $Y_1 = \sigma pl + \sigma p_2 + \sigma p_3 + \sigma p4 + \sigma p5 + \sigma p6 + \sigma p7 + \sigma p8$.

The Hammett $\sigma p$ values of $V_9$ to $V_{16}$ are represented by $Y_2 \leqq -0.30$, wherein their Hammett $\sigma p$ value is designated $\sigma pi$ (i=9 to 16), and $Y_2 = \sigma p_9 + \sigma p10 + \sigma p_{11} + \sigma p_{12} + \sigma p_{13} + \sigma p_{14} + \sigma p_{15} + \sigma p_{16}$.

$(X_1)l_1$, $(X_2)l_2$, $(X_3)l_3$, each represent an electric charge balancing counter ion and $l_1$, $l_2$, $l_3$ and each represent a value required to neutralize the electric charge higher than 0.

$R_{11}$, $R_{12}$, $R_{13}$, $R_{14}$, $R_{16}$, $R_{17}$, and $R_{18}$ each preferably represent an unsubstituted alkyl group having up to 18 carbon atoms (e.g., methyl, ethyl, propyl, butyl, pentyl, octyl, decyl, dodecyl, and octadecyl) or a substituted alkyl group {e.g. an alkyl group having up to 18 carbon atoms substituted, for example, by a carboxyl group, a sulfo group, a cyano group, a halogen atom (e.g. fluorine, chlorine, and bromine), a hydroxyl group, an alkoxycarbonyl group having up to 8 carbon atoms (e.g., methoxycarbonyl, ethoxycarbonyl, phenoxycarbonyl, and benzyloxycarbonyl), an alkoxy group having up to 8 carbon atoms (e.g., methoxy, ethoxy, benzyloxy, and phenethyloxy), a monocyclic aryloxy group having up to 10 carbon atoms (e.g., phenoxy and p-tolyloxy), an acyloxy group having up to 3 carbon atoms (e.g., acetyloxy and propionyloxy), an acyl group having up to 8 carbon atoms (e.g., acetyl, propionyl, benzoyl, and mesyl), a carbamoyl group (e.g., carbamoyl, N,N-dimethylcarbamoyl, morpholinocarbonyl, and piperidinocarbonyl), a sulfamoyl group (e.g., sulfamoyl, N,N-dimethylsulfamoyl, pholinosulfonyl, and piperidinosulfonyl), or an aryl group having up to 10 carbon atoms (e.g., phenyl, 4-chlorophenyl, 4-methylphenyl, and α-naphthyl)}.

An unsubstituted alkyl group (e.g., methyl and ethyl) and a sulfoalkyl group (e.g. 2-sulfoethyl, 3-sulfopropyl, and 4-sulfobutyl) are particularly preferable.

$R_{16}$ and $L_4$ and/or $R_{17}$ and $L_8$ and/or $R_{18}$ and $L_9$ may bond together to form a 5- or 6-membered ring.

$R_{19}$ preferably is an alkyl group having 1 to 18 carbon atoms, preferably 1 to 7 carbon atoms, and particularly preferably 1 to 4 carbon atoms (e.g., methyl, ethyl, propyl, isopropyl, butyl, isobutyl, hexyl, octyl, dodecyl and octadecyl), a substituted alkyl group {e.g., an aralkyl group (e.g., benzyl and 2-phenylethyl), a hydroxyalkyl group (e.g., 2-hydroxyethyl and 3-hydroxypropyl), a carboxyalkyl group (e.g., 2-carboxyethyl, 3-carboxypropyl, 4-carboxybutyl, and carboxymethyl), an alkoxyalkyl group (e.g., 2-methoxyethyl and 2-(2-methoxyethoxy)ethyl), a sulfoalkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl, and 3-sulfopropoxyethoxyethyl), a sulfatoalkyl group (e.g., 3-sulfatopropyl and 4-sulfatobutyl), a heterocycle-substituted alkyl group (e.g., 2-(pyrrolidin-2-on-1-yl)-ethyl, tetrahydrofurfuryl, and 2-morpholinoethyl), 2-acetoxyethyl, carbomethoxyethyl, and 2-methanesulfonylaminoethyl}, an allyl group, an aryl group (e.g., phenyl and 2-naphthyl), a substituted aryl group (e.g., 4-carboxyphenyl, 4-sulfophenyl, 3-chlorophenyl, and 3-methylphenyl), or a heterocyclic group (e.g., 2-pyridyland 2-thiazolyl).

Preferably $R_{15}$ is, for example, an unsubstituted alkyl group having 1 to 3 carbon atoms (e.g., methyl, ethyl, and propyl), a substituted alkyl group having 1 to 4 carbon atoms {e.g., an alkyl group substituted by an alkoxy group having 1 to 2 carbon atoms (e.g., methoxy and ethoxy)}, or an alkoxy group having 1 to 3 carbon atoms (e.g., methoxy and ethoxy), more preferably, a methyl group, an ethyl group, or a methoxy group, and particularly preferably a methyl group.

Preferably $Z_3$ is a 2,2-dimethyl-trimethylene group.

$Z_1$, $Z_2$, $Z_4$ and $Z_5$ each represent a sulfur atom or a selenium atom, preferably a sulfur atom.

$Z_6$ and $Z_7$ each represent an oxygen atom, a sulfur atom, a selenium atom, or a nitrogen atom (R—N, R having the same meaning as $R_{19}$), preferably a sulfur atom or an oxygen atom and at least one of them represents an oxygen atom or a nitrogen atom.

$Z_8$ represents an oxygen atom, a sulfur atom, a selenium atom, or a nitrogen atom (R'—N, R' having the same meaning as $R_{19}$), preferably a sulfur atom.

$Z_9$ represents an oxygen atom, a sulfur atom, or a nitrogen atom (R''—N, R'' having the same meaning as $R_{19}$), preferably a sulfur atom.

$V_1$, $V_2$, $V_3$, $V_4$, $V_5$, $V_6$, $V_7$, $V_8$, $V_9$, $V_9$, $V_{10}$, $V_{11}$, $V_{12}$, $V_{13}$, $V_{14}$, $V_{15}$, $V_{16}$, $V_{17}$, $V_{18}$, $V_{19}$, $V_{20}$, $V_{21}$, $V_{22}$, $V_{23}$, $V_{24}$, $V_{25}$, $V_{26}$, and $V_{27}$ each represent a hydrogen atom, a halogen atom (e.g., chlorine, fluorine, and bromine), an unsubstituted alkyl group, preferably an unsubstituted alkyl group having up to 10 carbon atoms (e.g., methyl and ethyl), a substituted alkyl group, preferably a substituted alkyl group having up to 18 carbon atoms (e.g., benzoyl, α-naphthylmethyl, 2-phenylethyl, and trifluoromethyl), an acyl group, preferably an acyl group having up to 10 carbon atoms (e.g., acetyl, benzoyl, and mesyl), an acyloxy group, preferably an acyloxy group having up to 10 carbon atoms (e.g., acetyloxy), an alkoxycarbonyl group, preferably an alkoxycarbonyl group having up to 10 carbon atoms (e.g., methoxycarbonyl, ethoxycarbonyl, and benzyloxycarbonyl), a substituted or unsubstituted carbamoyl group (e.g., carbamoyl, N,N-dimethylcarbamoyl, morpholinocarbonyl, and piperidinocarbonyl), a substituted or unsubstituted sulfamoyl group (e.g., sulfamoyl, N,N-dimethylsulfamoyl, morpholinosulfonyl, and piperidinosulfonyl), a carboxy group, a cyano group, a hydroxyl group, an amino group, an acylamino group, preferably an acylamino group having up to 8 carbon atoms (e.g., acetylamino), an alkoxy group, preferably an alkoxy group having up to 10 carbon atoms (e.g., methoxy, ethoxy, and benzyloxy), an alkylthio group (e.g., ethylthio), an alkylsulfonyl group (e.g., methylsulfonyl), a sulfonic acid group, an aryloxy group (e.g., phenoxy), or an aryl group (e.g., phenyl and tolyl). Among $V_{17}$ to $V_{28}$, these two which are bonded to adjacent carbon atoms may bond together to form a condensed ring. For example, as a condensed ring, a benzene ring and a heterocyclic ring (e.g., pyrrole, thiophene, furan, pyridine, imidazole, triazole, and thiazole) can be mentioned.

The Hammett σp values of $V_1$ to $V_8$ are represented by $Y_1 \leqq -0.15$, wherein their Hammett σp value is designated σpi (i=1 to 8), and $Y_1 = \alpha p_1 + \alpha p_2 + \alpha p_3 + \sigma p_4 + \sigma p_5 + \sigma p_6 + \sigma p_7 + \sigma p_8$.

The Hammett σp values of $V_9$ to $V_{16}$ are represented by $Y_2 \leqq -0.30$, wherein their Hammett σp value is designated σpi (i=9 to 16), and $Y_2 = \sigma p_9 + \sigma p_{10} + \sigma p_{11} + \sigma p_{12} + \sigma p_{13} + \sigma p_{14} + \sigma p_{15} + \sigma p_{16}$.

Preferably, the value of $Y_1$ is such that $Y_1 \leqq -0.30$ and the value of $Y_2$ is such that $Y_2 \leqq -0.45$.

Herein, αp indicates the value described in *Yakubutsu no Kozokassei Sokan—Doraqqu Dezain to Savokisa Kenkvu heno Shishin in Kaqaku no RYoiki* edited by Kozo Kassei Sokan Konwakai, Extra issue No. 122, pages 96 to 103, Nankodo, and by Corwin Hansch and Albert Leo in *Substituent Constants for Correlation Analysis in Chemistry and Biology*, John Wiley and Sons, pages 69 to 161. The method for measuring p is described in *Chemical Reviews, Vol.* 17, pages 125 to 136 (1935).

More preferably $V_1$ to $V_{16}$ each represents a hydrogen atom, an unsubstituted alkyl group having up to 6 carbon atoms (e.g., methyl, ethyl, n-propyl, isopropyl, n-butyl, t-butyl, pentyl, cyclopropyl, cyclobutyl, cyclopentyl, and cyclohexyl), a substituted alkyl group having up to 8 carbon atoms (e.g., carboxymethyl, 2-carboxyethyl, benzyl, phenetyl, and dimethylaminopropyl), a hydroxyl group, an amino group (e.g., amino, hydroxyamino, methylamino, dimethylamino, and diphenylamino), an alkoxy group (e.g., methoxy, ethoxy, isopropoxy, propoxy, butoxy, and pentoxy), an aryloxy group (e.g., phenoxy) or an aryl group (e.g., phenyl).

$L_4$, $L_5$, $L_6$, $L_7$, $L_8$, $L_9$, $L_{10}$, $L_{11}$, and $L_{12}$ each represent a methine group, which may be substituted by a substituted or unsubstituted alkyl group (e.g., methyl and ethyl), a substituted or unsubstituted aryl group (e.g., phenyl), or a halogen atom (e.g., chlorine and bromine), or may form a ring together with other methine group. $(X_1)l_1$, $(X_2)l_2$, $(X_3)l_3$, and $(X_4)l_4$ each is included in the formula to indicate the presence or absence of a cation or an anion when the ion charge of the dye is required to be neutralized. Therefore, $l_1$, $l_2$, $l_3$, and $l_4$ can take a suitable value of down to 0 as required. Whether the dye is a cation or an anion or has no net ion charge depends on its auxochromous group and substituent. Typical cations are inorganic or organic ammonium ions and alkali metal ions and specific anions may be either inorganic anions or organic anions such as a halide anion (e.g., a fluoride ion, a chloride ion, a bromide ion, and an iodide ion), a substituted arylsulfonate ion (e.g., a p-toluene-sulfonate ion and a p-chlorobenzenesulfonate ion), an aryldisulfonate ion (e.g., a 1,3-benzenesulfonate ion, a 1,5-naphthalenedisulfonate ion, and a 2,6-naphthalenedisulfonate ion), an alkylsulfate ion (e.g., a methylsulfate ion), a sulfate acid ion, a thiocyanate ion, a perchlorate ion, a tetrafluoroborate ion, a picrate ion, an acetate ion, and a trifluoromethanesulfonate ion with an iodide ion preferable.

Specified examples of the sensitizing dyes represented by formula (V), (VI), (VII), and (VIII) of the present invention are shown below, but the present invention is not restricted to them.

Specified examples (V-1) to (V-17) are indicated so that the substituent of formula (V) may be specified. (With $Z_1$ and $Z_2$=S, and $V_1$, $V_4$, $V_5$, and $V_8$=H)

| No. | $R_{11}$ | $R_{12}$ | $V_2$ | $V_3$ | $V_6$ | $V_7$ | $X_1$ | $l_1$ | $E_R$ (VvsSCE) |
|---|---|---|---|---|---|---|---|---|---|
| V-1 | $CH_2CH_3$ | $CH_2CH_3$ | $CH_3$ | H | H | H | $I^-$ | 1 | −1.27 |
| V-2 | " | " | $CH_3$ | $CH_3$ | H | H | " | " | −1.29 |
| V-3 | " | " | $CH_3$ | H | $CH_3$ | H | " | " | −1.29 |
| V-4 | " | " | $CH_3$ | H | H | $CH_3$ | " | " | −1.28 |
| V-5 | " | " | H | $CH_3$ | H | $CH_3$ | " | " | −1.27 |
| V-6 | " | " | $CH_3O$ | H | H | H | " | " | −1.27 |

-continued

| No. | $R_{11}$ | $R_{12}$ | $V_2$ | $V_3$ | $V_6$ | $V_7$ | $X_1$ | $l_1$ | $E_R$ (VvsSCE) |
|---|---|---|---|---|---|---|---|---|---|
| V-7 | " | " | H | $CH_3O$ | H | H | " | " | −1.27 |
| V-8 | " | " | $CH_3O$ | $CH_3O$ | H | H | " | " | −1.29 |
| V-9 | " | " | $CH_3O$ | H | $CH_3O$ | H | " | " | −1.30 |
| V-10 | " | " | H | $CH_3O$ | H | $CH_3O$ | " | " | −1.28 |
| V-11 | " | " | $CH_3$ | $CH_3$ | $CH_3$ | $CH_3$ | " | " | −1.33 |
| V-12 | " | " | $CH_3O$ | $CH_3O$ | $CH_3O$ | $CH_3O$ | " | " | −1.34 |
| V-13 | " | " | $N(CH_3)_2$ | H | H | H | " | " | −1.28 |
| V-14 | $(CH_2)_3SO_3^-$ | " | $CH_3$ | H | $CH_3$ | H | — | — | −1.29 |
| V-15 | $(CH_2)_4SO_3^-$ | " | $CH_3$ | H | $CH_3$ | H | — | — | −1.29 |
| V-16 | $(CH_2)_3SO_3^-$ | $(CH_2)_3SO_3^-$ | $CH_3$ | H | $CH_3$ | H | $HN^+(C_2H_5)_3$ | 1 | −1.29 |
| V-17 | $(CH_2)_4CH_3$ | $CH_2CH_3$ | $CH_3$ | H | $CH_3$ | H | $I^-$ | 1 | −1.29 |

V-18

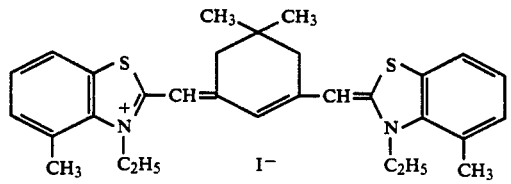

$E_R = -1.29$

V-19

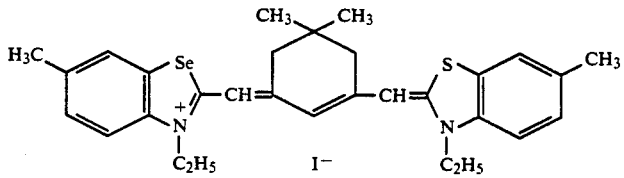

$E_R = -1.28$ (VI-1)

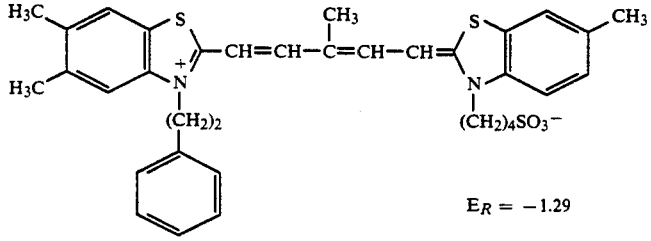

$E_R = -1.29$ (VI-2)

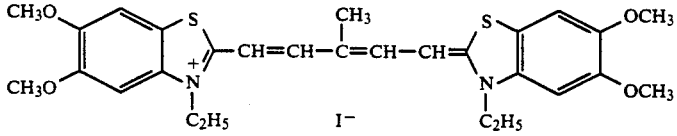

$E_R = -1.30$ (VI-3)

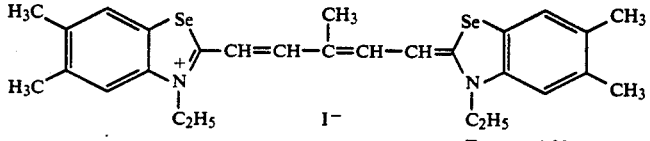

$E_R = -1.29$ (VII-1)

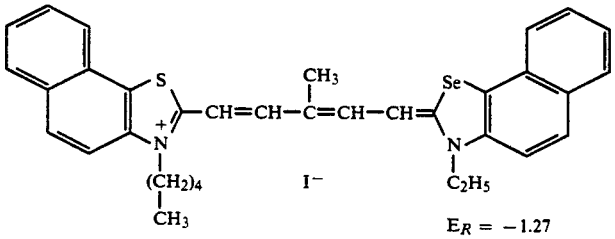

$E_R = -1.27$

-continued
| No. | $R_{11}$ | $R_{12}$ | $V_2$ | $V_3$ | $V_6$ | $V_7$ | $X_1$ | $l_1$ | $E_R$ (VvsSCE) |
|---|---|---|---|---|---|---|---|---|---|
| (VII-2) | | | | | | | | | |
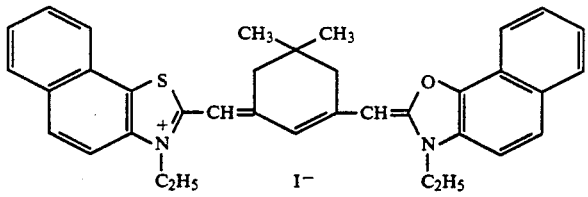
$E_R = -1.33$
(VII-3)
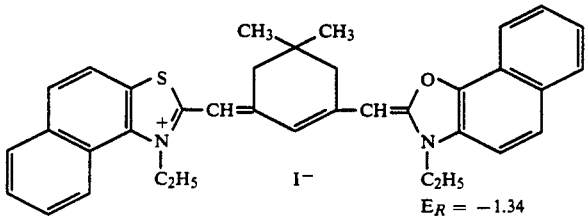
$E_R = -1.34$
(VII-4)
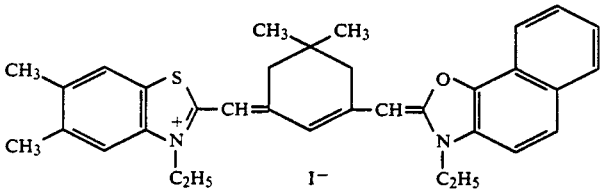
$E_R = -1.34$
(VII-5)
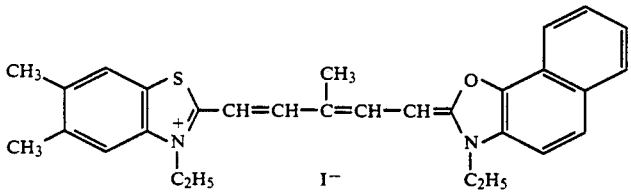
$E_R = -1.28$
(VIII-1)
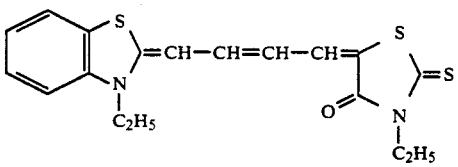
$E_R = -1.42$
(VIII-2)
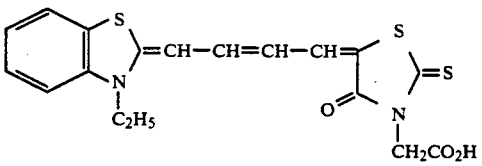
$E_R = -1.42$
(VIII-3)
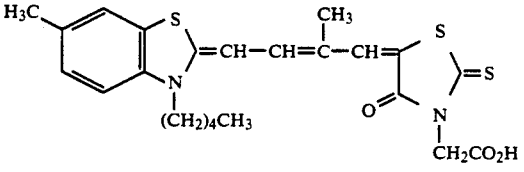
$E_R = -1.46$ -continued

| No. | $R_{11}$ | $R_{12}$ | $V_2$ | $V_3$ | $V_6$ | $V_7$ | $X_1$ | $l_1$ | $E_R$ (VvsSCE) |
|---|---|---|---|---|---|---|---|---|---|
| (VIII-4) | 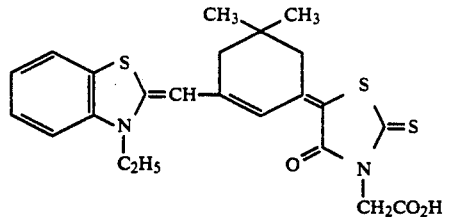 | | | | | | | | $E_R = -1.49$ |

Dyes represented by formulae (V), (VI), (VII), and (VIII) to be used in the present invention can be easily synthesized in accordance with methods described in, for example, F. M. Hamer, *Heterocyclic Compounds—Cyanine Dyes and Related Compounds,* Chapter IX, pp. 270 to 287, Chapter VII, pp. 200 to 243, and Chapter XIV, pp. 511 to 611, published by John Wiley and Sons (1964), and D. M. Sturmer, *Heterocyclic Compounds—Special Topics in Heterocyclic Chemistry,* Chapter VIII, sec, IV, pp. 482 to 515, published by John Wiley and Sons (1977).

Well known methods in the art can be applied to incorporate compounds represented by formulae (V), (VI), (VII), and (VIII) of the present invention into a silver halide emulsion. Generally, the compound is added to a silver halide emulsion by dissolving it in individual or combined water-soluble solvents, such as methanol, ethanol, pyridine, methyl cellosolve, and acetone. Further, it may be added in a silver halide emulsion by dissolving into a mixed solvent of the above solvent and water.

The period during the addition may be any time of producing process of silver halide emulsion, but it is preferably added during the chemical ripening of the emulsion, after the completion of chemical ripening, or before or after the addition of a stabilizing agent and a fogging inhibitor.

Although the amount to be added of the compound represented by formula (V), (VI), (VII), or (VIII) of the present invention is not particularly restricted, the amount can be selected in the range from $1\times10^{-6}$ to $1\times10^{-3}$ mol, preferably in the range from $1\times10^{-5}$ to $5\times10^{-4}$ mol, per mol of silver halide. Further, a supersensitizing agent can be used.

With respect to the supersensitization, there is described in, for example, *Photographic Science and Engineering,* Vol. 13, pp. 13 to 17 (1969), *ibid,* Vol. 18, pp 418 to 430 (1974), and *The Theory of the Photographic Process,* edited by James, 4th Ed., p. 259 (1977), published by McMillan Publisher, and it is known that a higher sensitivity can be obtained by selecting proper sensitizing dye and supersensitizing agent.

Although any supersensitizing agent can be used, compound represented by formula (IX) is particularly preferable:

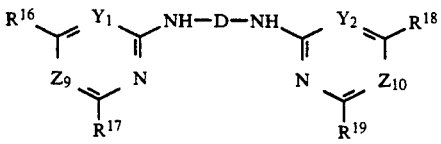

Formula (IX)

wherein D represents a divalent aromatic residue, and $R^{16}$, $R^{17}$, $R^{18}$, and $R^{19}$ each represent a hydrogen atom, a hydroxyl group, an alkoxy group, an aryoxy group, a halogen atom, a heterocyclic group, a mercapto group, an alkylthio group, an arylthio group, a heterocyclylthio group, an amino group, an alkylamino group, a cyclohexylamino group, an arylamino group, a heterocyclylamino group, an aralkylamino group, or an aryl group. $Z_9$ and $Y_1$ each represent —N= or —CH= provided that at least one of $Z_9$ and $Y_1$ is —N=, and $Z_{10}$ and $Y_2$ each represent —N= or —CH= provided that at least one of $Z_{10}$ and $Y_2$ is —N=.

Compound represented by formula (IX) will be described in detail.

D represents a divalent aromatic residue (e.g., a single aromatic nuclear residue, a residue of compound condensed at least two aromatic nuclei, or a residue of compound bonded at least two aromatic nuclei through an atom or atomic group; e.g., compounds having biphenyl, naphthylene, stilbene, or bibenzyl skeleton), and, in particular, compounds represented by the following formulae $D_1$ and $D_2$ are preferable:

$D_1$:

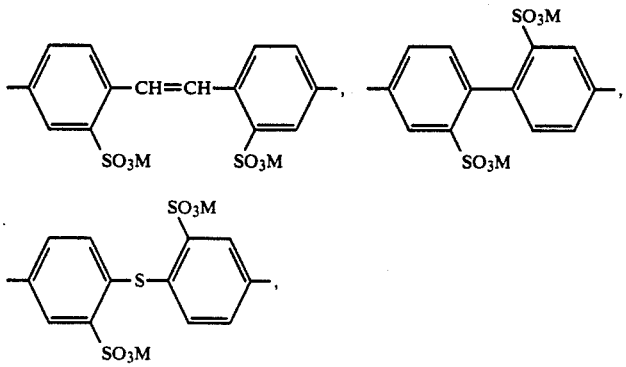

-continued

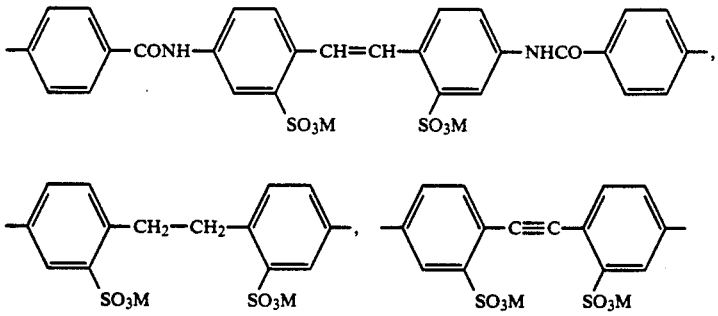

wherein M represents a hydrogen atom or a cation to give water-solubility (e.g., an alkali metal ion, such as Na and K, and an ammonium ion).

$D_2$:

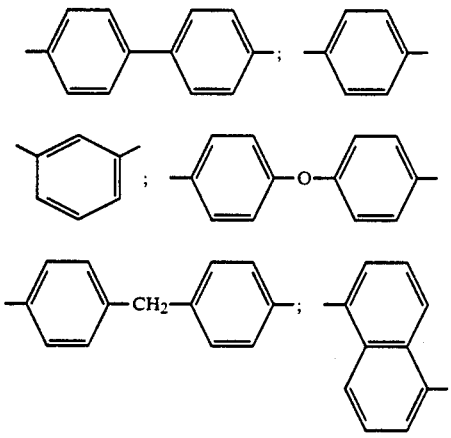

In the case of $D_2$, at least one of $R^{16}$, $R^{17}$, $R^{18}$, and $R^{19}$ has a substituent containing $SO_3M$ wherein M has the meaning defined above.

$R^{16}$, $R^{17}$, $R^{18}$, and $R^{19}$ each represent a hydrogen atom, a hydroxyl group, an alkoxy group (e.g., methoxy and ethoxy), an aryloxy group (e.g., phenoxy, naphthoxy, p-troxy, and p-sulfophenoxy), a halogen atom (e.g., chlorine and bromine), a heterocyclic group (e.g., morpholyl and piperidyl), a mercapto group, an alkylthio group (e.g., methylthio and ethylthio), an arylthio group (e.g., phenylthio and tolylthio), heterocyclylthio group (e.g., benzothiazoylthio, benzoimidazoylthio, and phenyltetrazolylthio), an amino group, an alkylamino group (e.g., methylamino, ethylamino, propylamino, dimethylamino, diethylamino, dodecylamino, β-hydroxyethylamino, di-β-hydroxyethylamino, and β-sulfoethylamino), a cyclohexylamino group, an arylamino (e.g., anilino, o-, m-, or p-sulfoanilino, o-, m-, or p-chloroanilino, o-, m-, or p-anisidino, o-, m-, or p-toluidino, o-, m-, p-carboxyanilino, hydroxyanilino, sulfonaphthylamino, o-, m-, or p-aminoanilino, and o-acetamino-anilino), a heterocyclylamino group (e.g., 2-benzothiazolylamino and 2-pyrimidylamino), an aralkylamino group (e.g., benzylamino), or an aryl group (e.g., phenyl).

Among the compounds represented by formula (IX), compounds wherein at least one of $R_{16}$ to $R_{19}$ is an aryloxy group, a heterocyclylthio group, or a heterocyclylamino group are particularly preferable.

Typical examples of the compound represented by formula (IX) are shown below, but the present invention is not restricted to them.

(IX-1) 4,4'-bis[2,6-di(benzothiazolyl-2-thio)pyrimidin-4-ylamino}stylbene-2,2'-disulfonic acid disodium salt (IX-2) 4,4'-bis{2,6-di(benzothiazolyl-2-amino)pyrimidin-4-ylamino}stylbene-2,2'-disulfonic acid disodium salt (IX-3) 4,4'-bis[2,6-di(1-phenyltetrazolyl-5-thio)pyrimidin-4-ylamino]stylbene-2,2'-disulfonic acid disodium salt (IX-4) 4,4'-bis[2,6-di(benzothiazolyl-2-thio)pyrimidin-4-ylamino]stylbene-2,2'-bisulfonic acid disodium salt (IX-5) 4,4'-bis[2-chloro-6-(2-naphthyloxy)pyrimidin-4-ylamino]biphenyl-2,2,-disulfonic acid disodium salt (IX-6) 4,4'-bis[2,6-di(naphthyl-2-oxy)pyrimidin-4-ylamino]stylbene-2,2,-disulfonic acid disodium salt (IX-7) 4,4'-bis[2,6-di(naphthyl-2-oxy)pyrimidin-4-ylamino]bibenzyl-2,2,-disulfonic acid disodium salt (IX-8) 4,4'-bis(2,6-diphenoxypyrimidin-4-ylamino)-stilbene-2,2,-disulfonic acid disodium salt (IX-9) 4,4'-bis(2,6-diphenylthiopyrimidin-4-ylamino)-stilbene-2,2'-disulfonic acid disodium acid disodium salt (IX-10) 4,4'-bis(2,6-dichloropyrimidin-4-ylamino)stilbene-2,2'-disulfonic acid disodium salt (IX-11) 4,4'-bis(2,6-dianilinopyrimidin-4-ylamino)-stilbene-2,2'-disulfonic acid disodium salt (IX-12) 4,4'-bis[4,6-di(naphthyl-2-oxy)triazine-2-ylamino]stilbene-2,2,-disulfonic acid disodium salt (IX-13)4,4'-bis(4,6-dianilinotriazin-2-ylamino)stilbene-2,2'-disulfonic acid disodium salt (IX-14) 4,4'-bis(2,6-dimercaptopyrimidin-4-ylamino)-biphenyl- 2,2,-disulfonic acid disodium salt (IX-15) 4,4'-bis[4,6-di(naphthyl-2-oxy)pyrimidin-2-ylamino]stylbene-2,2'-disulfonic acid disodium salt (IX-16) 4,4'-bis[4,6-di(benzothiazolyl-2-thio)pyrimidin-2-ylamino}stylbene-2,2'-disulfonic acid disodium salt (IX-17)4,4'-bis[4,6-di(1-phenyltetrazolyl-2-amino)-pyrimidin-2-ylamino]stylbene-2,2'-disulfonic acid disodium salt (IX-18) 4,4'-bis[4,6-di(naphthyl-2-oxy)pyrimidin-2-ylamino}bibenzyl-2,2'-disulfonic acid disodium salt With respect to the order of the addition of at least one of the compounds (V), (VI), (VII), and (VIII) and the compound (IX), any of them can be added first or they may be added at the same time. Further, at least one of the compounds (V), (VI), (VII), and (VIII) and the compound (IX) may be added in the form of a mixed solution.

The compound represented by formula(IX) is added in an amount in the range from $1\times10^{-6}$ to $1\times10^{-1}$ mol, preferably $5\times10^{-5}$ to $1\times10^{-2}$ mol, per mol of the silver halide. A preferable molar ratio of the compounds represented by formulae (V), (VI), (VII), and (VIII) to the compound represented by formula (IX) to be added is chosen from the range of from 1/50 to 10/1.

The cyan coupler to be used preferably in the present invention is represented by the following formula (X)

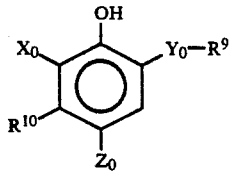

Formula (X)

wherein $Y_0$ represents —NHCO— or —CONH—, $R^9$ represents an alkyl group, an aryl group, a heterocyclic group, or an amino group, $X_0$ represents a hydrogen atom, a halogen atom, an alkoxy group, or an acylamino group, $R^{10}$ represents an alkyl group or an acylamino group, $X_0$ and $R^{10}$ together may represent a group of nonmetallic atoms to form a 5- to 7-membered ring, and $Z_0$ represents an atom or a group capable of being released upon coupling reaction with the oxidized product of a developing agent.

In formula (X), $R^9$ represents an alkyl group (preferably a linear, branched, or cyclic alkyl group having 1 to 32 carbon atoms, such as methyl, butyl, pentadecyl, and cyclohexyl), an aryl group (e.g., phenyl and naphthyl), aheterocyclic group (e.g., 2-pyridyl, 3-pyridyl, 2-furanyl, and 2-oxazolyl), or an amino group, which is preferably substituted by a substituent selected from the group consisting of an alkyl group, an aryl group, an alkyloxy or aryloxy group (e.g., methoxy, dodecyloxy, methoxyethoxy, phenyloxy, 2,4-di-tert-amylphenoxy, 3-tert-butyl-4-hydroxy- phenyloxy, and naphthyl), a carboxyl group, an alkylcarbonyl or arylcarbonyl group (e.g., acetyl, tetradecanoyl, and benzoyl), an alkyloxycarbonyl or aryloxycarbonyl group (e.g., methoxycarbonyl, benzyloxycarbonyl, and phenoxycarbonyl), an acyloxy group (e.g., acetoxy, benzoyloxy, and phenylcarbonyloxy), a sulfamoyl group (e.g., N-ethylsulfamoyl and N-octadecylsulfamoyl), a carbamoyl group (e.g., N-methylcarbamoyl and N-methyldodecylcarbamoyl), a sulfonamido group (e.g., methanesulfonamido and benzenesulfonamido), an acylamino group (e.g., acetylamino, benzamido, ethoxycarbonylamino, and phenylaminocarbonylamino), an imido group (e.g., succinimido and hydantoinyl), a sulfonyl group (e.g., methanesulfonyl), a hydroxyl group, a cyano group, a nitro group, and a halogen atom.

In formula (X), $R^{10}$ preferably represents an alkyl group having 1 to 20 carbon atoms (e.g., methyl, ethyl, butyl, and pentadecyl), or an acylamino group (e.g., tetradecanoylamino, benzoylamino, and 2-(2,4-di-tert-amylphenoxy)butaneamido). The alkyl group represented by $R^{10}$ may be substituted, for example, by a substituent exemplified for $R^9$.

In formula (X), $X_0$ represents a hydrogen atom, a halogen atom (e.g., fluorine, chlorine, and bromine), an alkoxy group (e.g., methoxy and butoxy), or an acylamino group (e.g., acetamido).

The compound represented by formula (X) may include, in addition to the phenol cyan couplers mentioned above, condensed ring cyan couplers formed by linking $R^{10}$ and $X_0$ to form a 5-, 6-, or 7-membered ring. As such condensed ring cyan coupler, oxyindol cyan couplers and imidazole-2-one cyan couplers are preferable.

In formula (X), $Z_0$ represents a hydrogen atom or an atom and group capable of being released upon coupling reaction, such as a halogen atom (e.g., fluorine, chlorine, and bromine), an alkoxy group (e.g., ethoxy, dodecyloxy, methoxycarbamoylmethoxy, carboxypropyloxy, and methylsulfonylethoxy), an aryloxy group (e.g., 4-chlorophenoxy, 4-methoxyphenoxy, and 4-carboxyphenoxy), an acyloxy group (e.g., acetoxy, tetradecanoyloxy, and benzoyloxy), a sulfonyloxy group (e.g., methanesulfonyloxy and toluenesulfonyloxy), an amido group (e.g., dichloroacetylamino, heptabutyrylamino, methanesulfonylamino, and toluenesulfonylamino), an alkoxycarbonyloxy group (e.g., ethoxycarbonyloxy and benzoyloxycarbonyloxy), an aryloxycarbonyloxy group (e.g., phenoxycarbonyloxy), an aliphatic or aromatic thio group (e.g., ethylthio, phenylthio, and tetrazolylthio), an imido group (e.g., succinimido and hidantoinyl), an N-heterocyclic ring (e.g., 1-pyrazolyl and 1-benztriazolyl), and an aromatic azo group (e.g., phenylazo), which may contain a photographically useful group.

In formula (X), preferably $Y_0$ is —NHCO— and preferable $R^9$ is an alkyl group or an aryl group, with an alkyl group being most preferable.

In formula (X), preferable $R^{10}$ is an alkyl group having 1 to 15 carbon atoms, with an alkyl group having 1 to 4 carbon atoms more preferred.

In formula (X), preferable $Z_0$ is a hydrogen atom or a halogen atom with a halogen atom more preferred.

In formula (X), preferable $X_0$ is a halogen atom and it is also preferably that $X_0$ forms a heterocyclic ring together with $R^{10}$.

Synthesis of the cyan couplers represented by formula (X) is known from the following literature.

Synthesis of phenol cyan couplers having an alkyl group in the 5-position is described, for example, in U.S. Pat. Nos. 2,369,929, 4,518,687, 4,511,647, and 3,772,020; synthesis of 2,5-diacylaminophenol cyan couplers is described, for example, in U.S. Pat. No. 2,772,162, 2,895,826, 4,334,011, and 4,500,653, and JP-A No. 164555/1984; and synthesis of phenol cyan couplers wherein a nitrogen-containing heterocyclic ring is condensed with a phenol nucleus is described, for example, in U.S. Pat. Nos. 4,327,173, 4,564,586, and 4,430,423, and JP-A Nos. 390441/1986 and 257158/1987. The coating amount of cyan coupler of the present invention is preferably $1.0\times10^{-5}$ to $2.0\times10^{-3}$ mol, more preferably $1.0\times10^{-4}$ to $1.0\times10^{-3}$ mol, per square meter of photographic material. The cyan coupler of the present invention may be used by arbitrary mixing with couplers other than that of the present invention, and preferably 5 mol% or more, more preferably 30 mol% or more of cyan coupler of the present invention may be included in the mixture.

In the cyan color-forming layer of the present invention, preferably at least one high-boiling organic solvent having a viscosity of 200 cps at 25° C.

The high-boiling organic solvent is preferably selected from the group of compounds represented by the following formulae ($II_s$), ($III_s$), ($IV_s$), ($V_s$), ($VI_s$), and ($VII_s$).

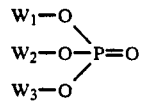

Formula ($II_s$)

$W_1—COOW_2$ Formula ($III_s$)

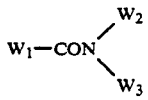

Formula ($IV_s$)

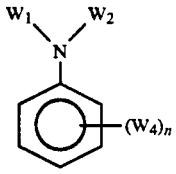

(Formula ($V_s$)

$W_1—O—W_2$ Formula ($VI_s$)

$W_5—X$ Formula ($VII_s$)

wherein $W_1$, $W_2$, and $W_3$ each represent a substituted or unsubstituted alkyl group, cycloalkyl group, alkenyl group, aryl group, or heterocyclic group, $W_4$ represents $—W_1$, $—O—W_1$, or $—S—W_1$, n is an integer of 1 to 5, when n is 2 or over, the $W_4$ groups may be the same or different, and in formula ($VI_s$), $W_1$ and $W_2$ may together form a condensed ring. $W_5$ represents a substituted or unsubstituted alkyl group, cycloalkyl group, or aryl group, the total number of carbon atoms constituting of $W_5$ being 12 or more, and X represents a halogen atom.

When the group represented by the above $W_1$, $W_2$, and $W_5$ have substituents, the substituent may be a group having one or more bonding groups selected from $$—\overset{O}{\overset{\|}{C}}O—,$$

$—CON<$, $—R^8N<$($R^8$ represents a 2- to 6-valent group being removed hydrogen atom from a phenyl group).

Alkyl group represented by $W_1$, $W_2$, $W_3$, $W_4$, and $W_5$ may be either straight chain or branched chain group, for example, methyl group, ethyl group, propyl group, butyl group, benzyl group, hexyl group, heptyl group, octyl group, nonyl group, decyl group, undecyl group, dodecyl group, tridecyl group, tetradecyl group, pentadecyl group, hexadecyl group, heptadecyl group, octadecyl group, nonadecyl group, or eicocyl group.

The acceptable substituents for these alkyl group include, for example, a halogen atom, a cycloalkyl group, an aryl group, and an ester group, and as such substituted alkyl group can be mentioned, for example, a substitution product of halogen (e.g., $—C_2HF_4$, $—C_5H_3F_8$, $—C_9H_3F_{16}$, $—C_2H_4Cl$, $—C_3H_5Cl_2$, $—C_3H_5ClBr$, and $—C_3H_5Br_2$), a substitution product of cycloalkyl group (e.g., 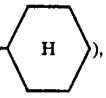 ), a substitution product of aryl group (e.g., 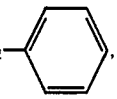 , 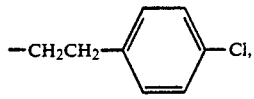 , and

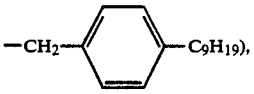 ), a substituent to give an ester of dibasec acid (e.g., 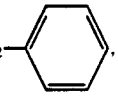 , $—CH_2CH_2COOC_{12}H_{25}$, $—(CH_2)_4COOC_{10}H_{21}$, $—(CH_2)_4COOCH_2(CF_2(CF_2CF_2)_2H$, $—(CH_2)_2H$, $—(CH_2)_7COOC_4H_9$, and $—((CH_2)_8COOC_{12}H_{25}$, a substituent to give an ester of lactic acid (e.g., 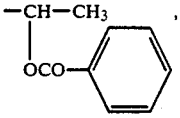 , 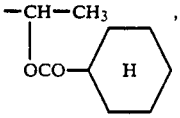 ,

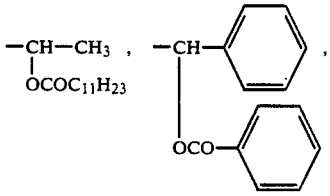 , and ), a substituent to give an ester of citric acid or the like (e.g., 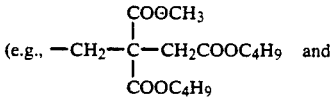 and

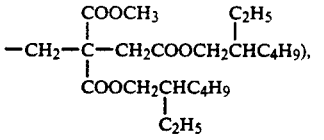 ), a substituent to give an ester of malic acid (e.g., $—CH_2CH(OH)COOC_6H_{13}$ and $—CH_2CH(H-)COOC_{12}H_{25}$), and a substituent to give an ester of tartalic acid (e.g., $—CH(OH)CH(OH)COOC_8H_{17}$, $—CH(OH)CH(OH)COOC_{18}H_{37}$, 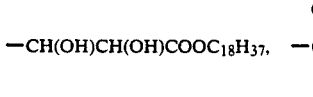 and

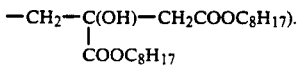 ).

Further, in formula ($VI_2$), $W_1$ and $W_2$ may be a group that contain oxirane, oxalane, and oxane ring being formed a condensated ring.

The cycloalkyl group represented by $W_1$, $W_2$, $W_3$, $W_4$, or $W_5$ include, for example

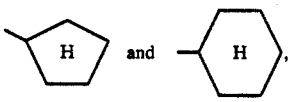

and the substituted cycloalkyl groups include, for example,

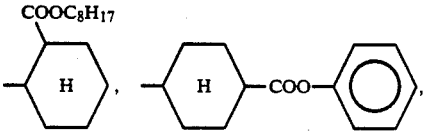

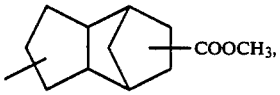

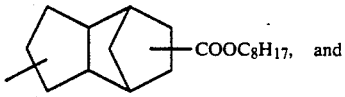

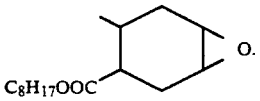

The aryl groups represented by $W_1$, $W_2$, $W_3$, $W_4$, or $W_5$ include, for example,

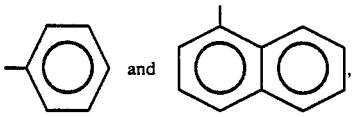

and the substituted aryl groups include, for example,

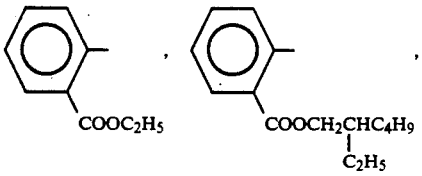

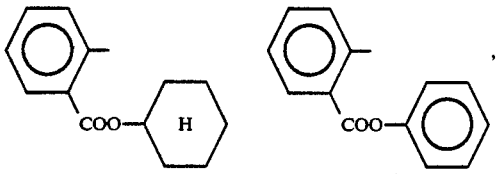

-continued

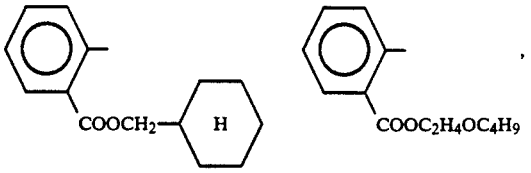

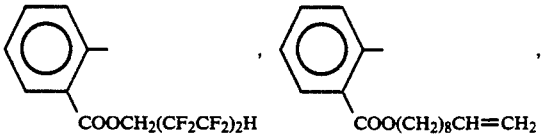

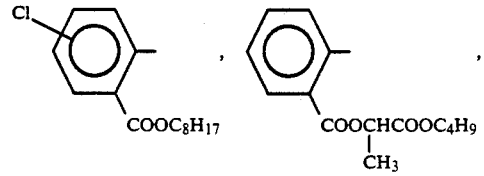

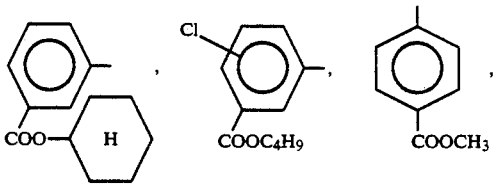

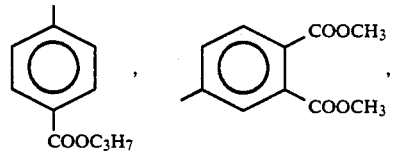

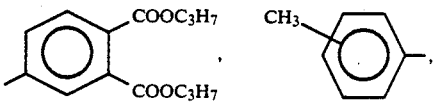

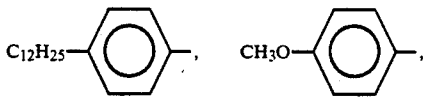

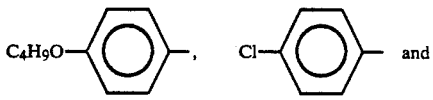

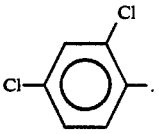

The alkenyl groups $W_5$ include, for example, $—C_4H_7$, $—C_5H_9$, $—C_6H_{11}$, $—C_7H_{13}$, $—C_8H_{15}$, $—C_{10}H_{19}$, $—C_{12}H_{23}$, and $—C_{13}H_{35}$, and the substituted alkenyl groups include, for example, substituted groups of a halogen atom (e.g., F, Cl, and Br), $-OC_8H_{17}$, $-OC_{12}H_{25}$, 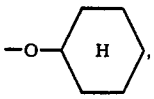

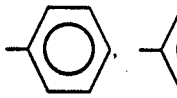 , 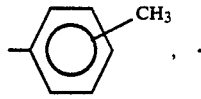 , 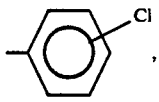 ,

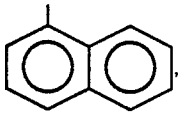 , 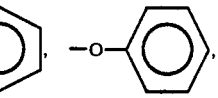 , $-OCOC_8H_{17}$,

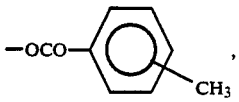 , that is, $-CH{=}CH-COOCH_2\underset{\underset{C_2H_5}{|}}{C}HC_4H_9$, $-CH{=}CH-COOC_{12}H_{25}$, and 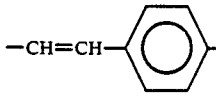 .

The heterocyclic groups represented $W_1$, $W_2$, $W_3$, and $W_4$ include, for example, the followings:

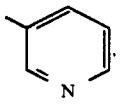 , 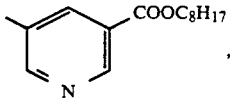 , 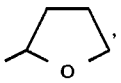 ,

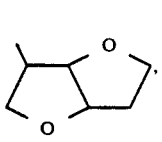 , 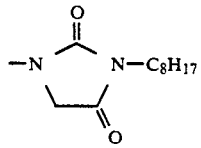 and 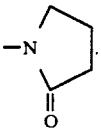 .

Preferably the boiling point of the high-boiling organic solvent used in the present invention is 140° C. or over, and more preferably 160° C. or over. Preferably $W_1$ to $W_5$ of these compounds each represent an alkyl group, preferably having 8 or more carbon atoms in all.

Although, generally the term "organic solvents" means solvents that are liquid, in the present invention the term "organic solvents having a viscosity of 200 cp or over measured at 25° C." includes solid solvents, preferably having a viscosity of 500 cp or over, and more preferably 700 cp or over, and further preferably solid solvents selected from compounds having a melting point of 25° C. or over represented by formulae ($II_s$) to ($VIII_s$). Above all those represented by formulae ($II_s$) and ($III_s$) are preferable, with esters of dialkyls (secondary and tertiary alkyls) or dicycloalkyls of phosphoric acid and phthalic acid particularly preferred. The most preferable ones are dicyclo esters of phthalic acid. The viscosity can be measured by a cone plate-type rotational viscometer (VISCONISEMD manufactured by Tokyo Keiki).

Although the amount of the above high-boiling organic solvent to be used can be varied suitably depending on the type and the amount of the cyan coupler to be used, preferably the weight ratio of the highboiling organic solvent to the cyan coupler is in the range of from 0.05 to 20.

The high-boiling organic solvents according to the present invention may be used alone or in combination, or they may be used together with other conventionally known high-boiling organic solvents in a range that attains the object of the present invention. As the conventionally known high-boiling organic solvents, for example, phosphate solvents, such as tricresyl phosphate, tri-2-ethylhexyl phosphate, 7-methyloctyl phosphate, and tricyclohexyl phosphate, and phenol solvents, such as 2,5-di-tert-amylphenol and 2,5-di-sec-amylphenol, can be mentioned.

Specific examples of the high-viscosity high-boiling organic solvents according to the present invention are listed below.

| Compound No. | Structural Formula | Remarks |
|---|---|---|
| S-1 | 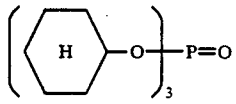 | Solid (m.p.*: 60° C.) |
| S-2 | $(ClCH_2\underset{\underset{Cl}{\vert}}{C}HCH_2O)_3P{=}O$ | Solid (m.p.: 26.8° C.) |
| S-3 | 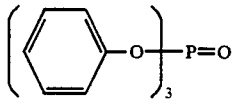 | Solid (m.p.: 48.5° C.) |
| S-4 | 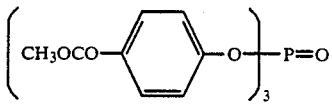 | Solid (m.p.: 101° ~ 103° C.) |

-continued
| Compound No. | Structural Formula | Remarks |
|---|---|---|
| S-5 | 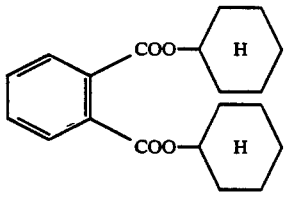 | Solid (m.p.: 58°~65° C.) |
| S-6 | 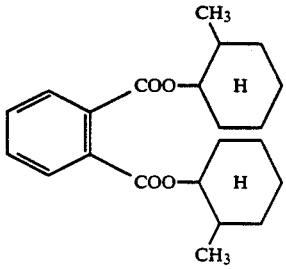 | Solid |
| S-7 | 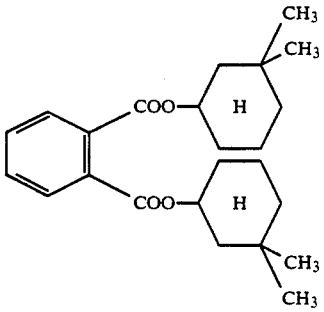 | Solid |
| S-8 | 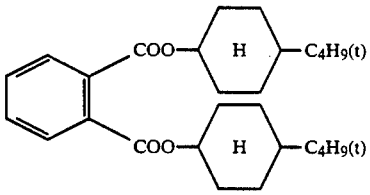 | Solid |
| S-9 | 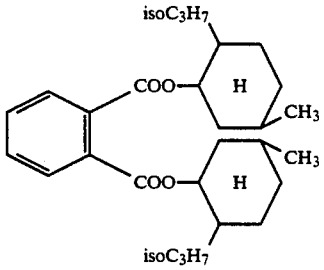 | Solid (m.p.: 29°~130° C.) |
| S-10 | 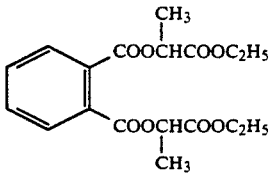 | Solid (m.p.: 50°~53° C.) |

-continued
| Compound No. | Structural Formula | Remarks |
|---|---|---|
| S-11 | 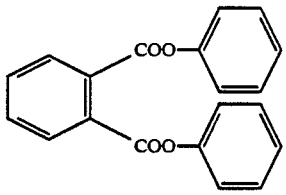 | Solid (m.p.: 69° C.) |
| S-12 | 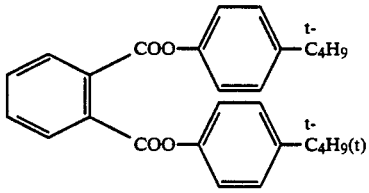 | Solid (m.p.: 142 ° C.) |
| S-13 | 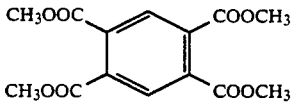 | Solid (m.p.: 144° C.) |
| S-14 | 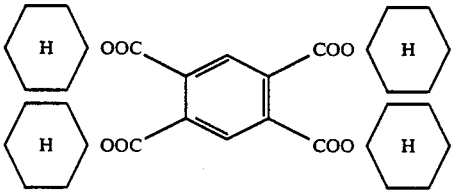 | Solid (m.p.: 148° C.) |
| S-15 | 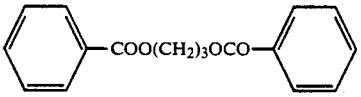 | Solid (m.p.: 47° C.) |
| S-16 | 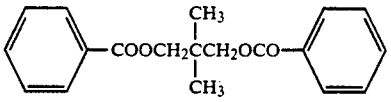 | Solid (m.p.: 49° C.) |
| S-17 | 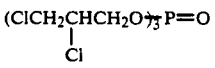 | 1500 cp |
| S-18 | 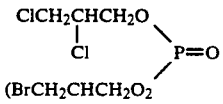 | 4260 cp |
| S-19 | 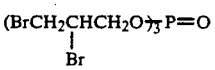 | 6810 cp |
| S-20 | 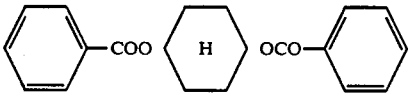 | Solid (m.p.: 113° C.) |
| S-21 | 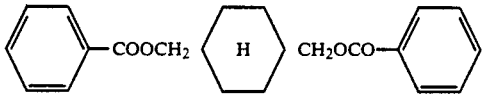 | Solid (m.p.: 24° C.) |

-continued
| Compound No. | Structural Formula | Remarks |
|---|---|---|
| S-22 | 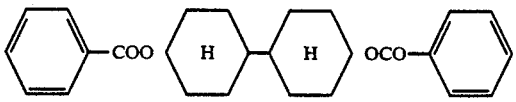 | Solid (m.p.: 194° C.) |
| S-23 | 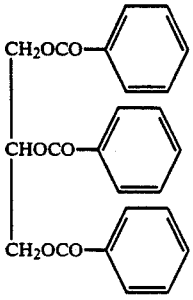 | Solid (m.p.: 71° C.) |
| S-24 | 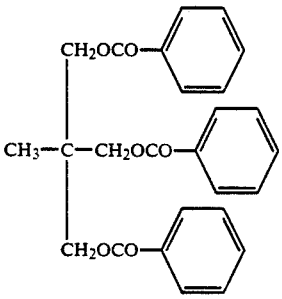 | Solid (m.p.: 81° C.) |
| S-25 | 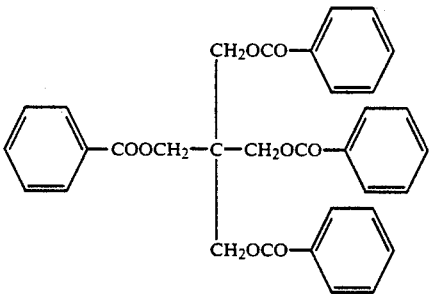 | Solid (m.p.: 99) |
| S-26 | 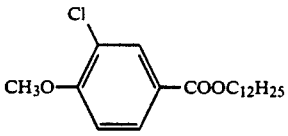 | Solid (m.p.: 43° C.) |
| S-27 | $C_{15}H_{31}COOC_{18}H_{37}$ | Solid (m.p.: 58° C.) |
| S-28 | $n\text{-}C_{17}H_{35}COOCH_3$ | Solid (m.p.: 38° C.) |
| S-29 | $C_{17}H_{35}COOC_{16}H_{33}$ | Solid (m.p.: 58° C.) |
| S-30 | $CH_2OCOC_{11}H_{23}\text{-}n$<br>\|<br>$CHOCOC_{11}H_{23}\text{-}n$<br>\|<br>$CH_2OCOC_{11}H_{23}\text{-}n$ | Solid (m.p.: 47° C.) |
| S-31 | 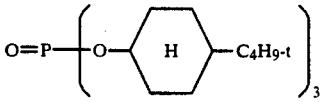 | Solid |
| S-32 | $O{=}P{+}OC_{14}H_{29})_3$ | Solid |

-continued
| Compound No. | Structural Formula | Remarks |
|---|---|---|
| S-33 | $O{=}P{\leftarrow}OC_{16}H_{33})_3$ | Solid |
| S-34 | 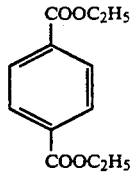 | Solid |
| S-35 | 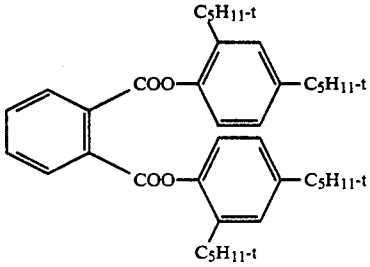 | Solid |
| S-36 | 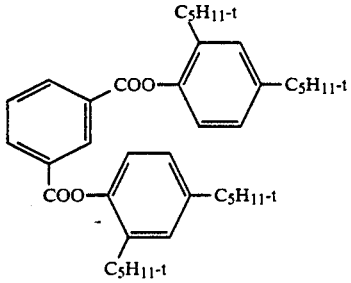 | Solid |
| S-37 | 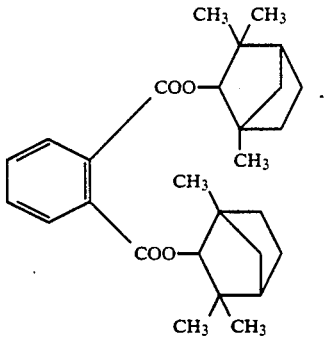 | Solid |
| S-38 | 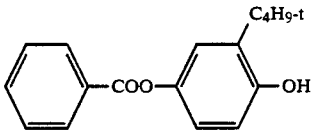 | Solid |
| S-39 | 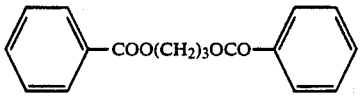 | Solid |
| S-40 | 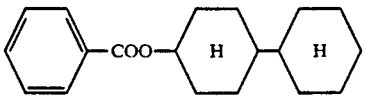 | Solid |

-continued
| Compound No. | Structural Formula | Remarks |
|---|---|---|
| S-41 | 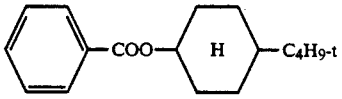 | Solid |
| S-42 | 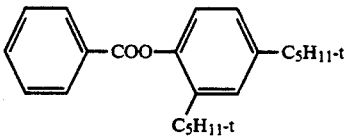 | Solid |
| S-43 | 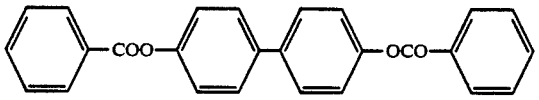 | Solid |
| S-44 | 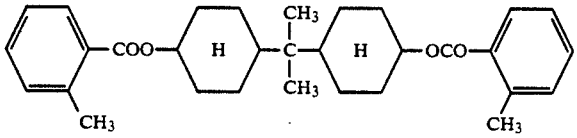 | Solid |
| S-45 | 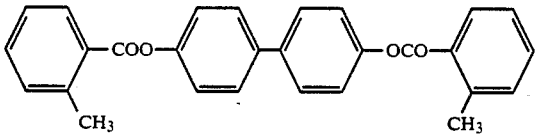 | Solid |
| S-46 | 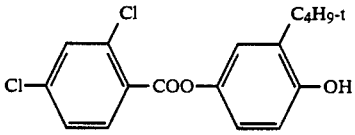 | Solid |
| S-47 | 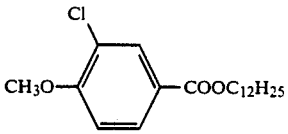 | Solid |
| S-48 | $C_{15}H_{31}COOC_{16}H_{33}$ | Solid |
| S-49 | $CH_2OCOC_{17}H_{35}$<br>\|<br>$CHOCOC_{17}H_{35}$<br>\|<br>$CH_2OCOC_{17}H_{35}$ | Solid |
| S-50 | $C_8H_{17}CH{=}CH(CH_2)_7CONH_2$ | Solid |
| S-51 | 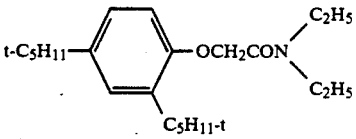 | Solid |
| S-52 | 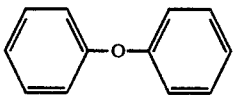 | Solid |
| S-53 | 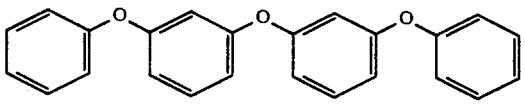 | Solid |

-continued
| Compound No. | Structural Formula | Remarks |
|---|---|---|
| S-54 | 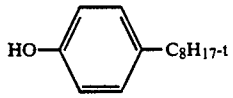 | Solid |
| S-55 | 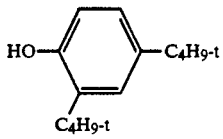 | Solid |
| S-56 | $C_{24}H_{29}Cl_{21}$ (Chlorinated Parraffin) | Solid |
| S-57 | 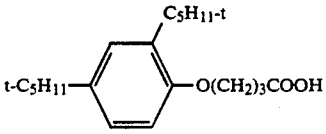 | Solid |
| S-58 | 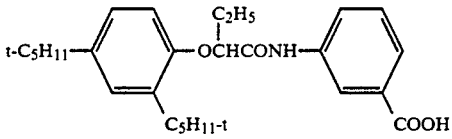 | Solid |
| S-59 | 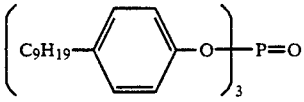 | 15,600 cp |
| S-60 | 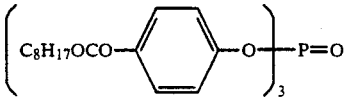 | 20,800 cp |
| S-61 | 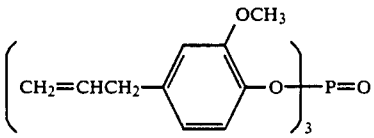 | 21,600 cp |
| S-62 | 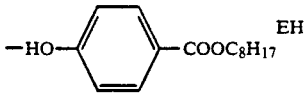 | 14,300 cp |
| S-63 | 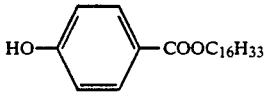 | Solid |
Note:
*m.p.: melting point
Of the compounds of formula ($III_5$), other preferable high-boiling organic solvents are represented by formulae ($III_2$-1 and ($III_2$—2):
Formula ($III_5$-1)
-continued
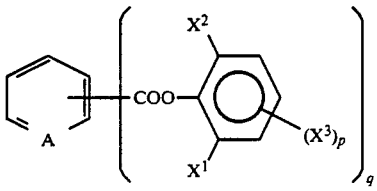

wherein A represents =CH— or =N—; $X^1$, $X^2$, and $X^3$ each represent independently —H, halogen, —$R^2$, —CH=NO$R^2$, —CO$R^2$, —$SO_2R^2$, —$Y_1$=$R_2$, —$Y_1$—CO$R^2$, or —$SO_2$—$Y_1$—$R^2$, or represent an atomic group to form a carbocyclic ring or heterocyclic ring by combining two X groups in $X^1$ to $X^3$, $Y_1$ represents —O—, —S—, or —N—, wherein $R^3$ represents —H or —$R^2$; $R^2$ represents a substituted or unsubstituted alkyl group having 1 to 20 carbon atoms (e.g., methyl, ethyl, isopropyl, s-butyl, t-butyl, t-pentyl, 2-ethylhexyl, and octadecyl), a substituted or unsubstituted aryl group having 6 to 20 carbon atoms (e.g., phenyl, m-tolyl, p-tolyl, p-hydroxyphenyl, and α-naphthyl), or a substituted or unsubstituted heterocyclic group having 2 to 20 carbon atoms (e.g., pyrazolyl, benzoxazolyl, benzothiazolyl, benzotriazole, and phenyltetrazolyl); q is 2, 3, or 4, and p is 1, 2, or 3, provided that at least one pair of the substituent groups $X^1$ and $X^2$ bonded to the same benzene ring must contain two or more non-hydrogen atoms in all.

In the present invention, it is preferable that q is 2 or 4, p is 1, A represents =CH—, $X^1$ represents an alkyl group having 1 to 6 carbon atoms, a heterocyclic group, or —CO$R^4$ (wherein $R^4$ represents a phenyl group or —O$R^5$ that is an alkyl group having 1 to 6 carbon atoms), $X^2$ represents —H or an alkyl group having 1 to 6 carbon atoms, and $X_3$ represents —H, a methoxy group, or an alkyl group having 2 to 6 carbon atoms.

It is particularly preferable that $X^1$ and $X^2$ each are a sterically bulky group.

Next, the special examples of compound represented by formula ($III_5$—1) for use in the present invention are described.

Formula ($III_5$-1-a):

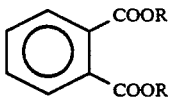

In the above formula ($III_5$-1-a), R represents the followings:

(S-64)

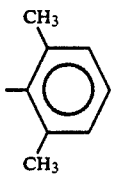

(S-65)

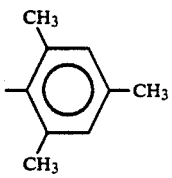

(S-66)

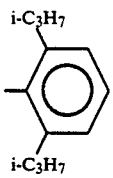

(S-67)

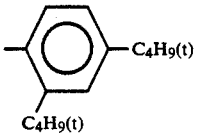

(S-68)

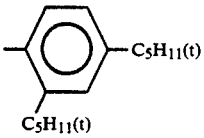

-continued (S-69)

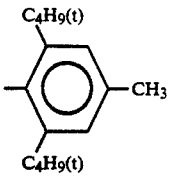

(S-70)

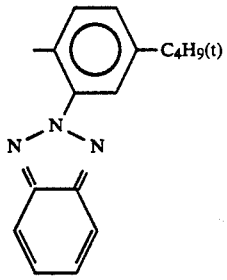

(S-71)

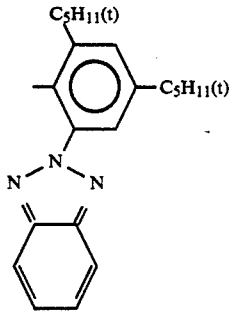

(S-72)

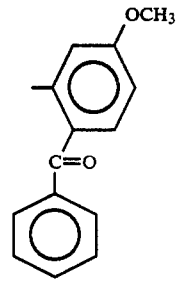

(S-73)

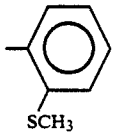

(S-74)

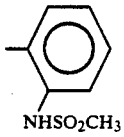

Formula ($III_5$-1-b)

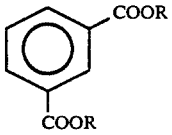

In the above formula ($III_5$-1-b), R represents the followings:

(S-75)

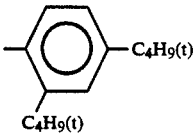

(S-76)

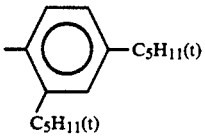

(S-77)

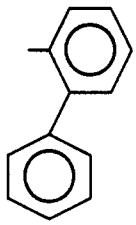

(S-78)

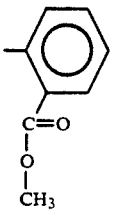

-continued (S-79) (S-80)

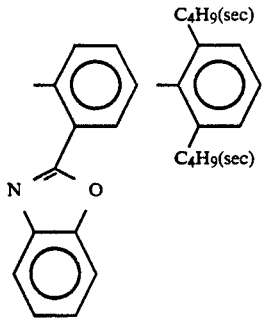

Formula ($III_5$-1-c)

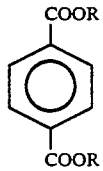

In the above formula ($III_2$-1-c), R represents the following:

(S-81) (S-82)

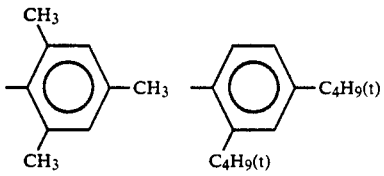

Formula ($III_5$-1-d)

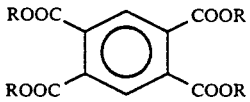

In the above formula ($III_2$-1-d), R represents the followings:

(S-83)

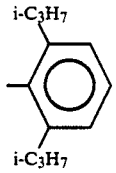

Formula ($III_5$-1-e)

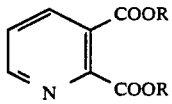

In the above formula ($III_2$-1-e), R represents the followings:

(S-84) (S-85)

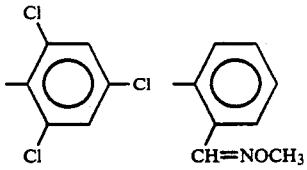

Formula ($III_5$-1-f)

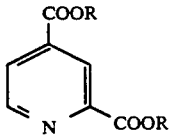

In the above formula ($III_2$-1-f), R represents the followings:

(S-86) (S-87)

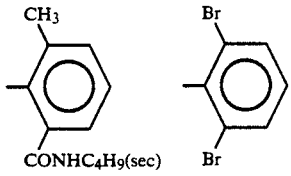

Formula ($III_5$-1-g)

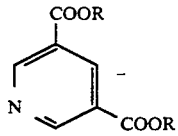

In the above formula ($III_2$-1-g), R represents the followings:

(S-88)

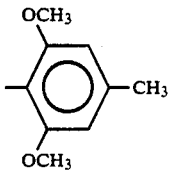

Formula ($III_5$-1-h)

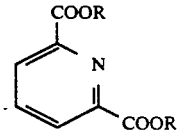

In the above formula ($III_2$-1-h), R represents the followings:

(S-89) (S-90) (S-91)

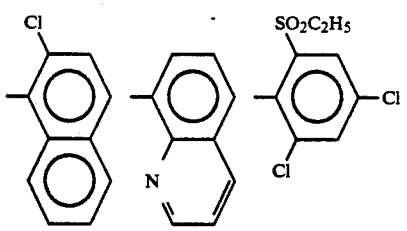

Formula ($III_5$-1-i)

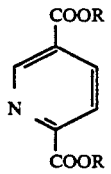

In the above formula ($III_2$-1-i), R represents the following:

(S-92) (S-93) (S-94)

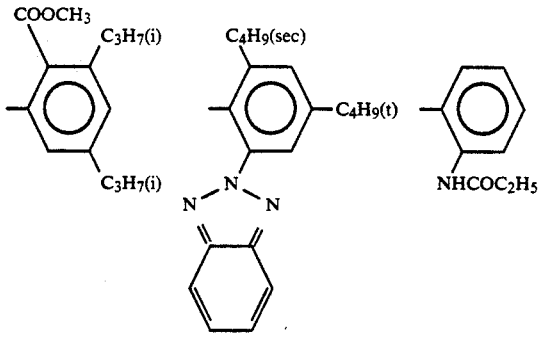

The compounds represented by formula ($III_2$-1) of the present invention can be commercially available and can be synthesized, for example, by the method described in JP-A No. 134642/1987.

Formula ($III_2$-2) will now be described.

Formula ($III_5$-2)

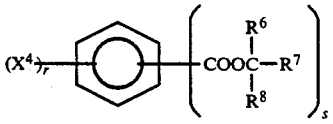

In formula ($III_2$-2), $X^4$ represents a halogen atom (e.g., fluorine, chlorine, bromine, and iodine), an alkyl group having 1 to 20 carbon atoms, an alkoxy group having 1 to 20 carbon atoms, or an alkoxycarbonyl group having 2 to 21 carbon atoms, r is an integer of 0 to 5, $R^6$, $R^7$, and $R^8$ each represent independently a straight-chain or branched alkyl group having 1 to 12 carbon atoms, a cycloalkyl group having 3 to 12 carbon atoms, an aralkyl group having 7 to 20 carbon atoms, an aryl group having 6 to 20 carbon atoms, or a heterocyclic group having 3 to 12 carbon atoms, s is an integer of 1 to 4, with the total of r and s being 6 or below, the $X^4$ groups may be the same or different, when r is 2 or more, the

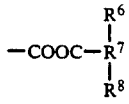

groups may be the same or different, $R^6$ may be a hydrogen atom, and $R^7$ and $R^8$ may together bond to form a ring.

Now, the compounds represented by formula ($III_5$-2) will be described in detail.

In formula ($III_5$-2), specific examples of $X^4$ includes, in addition to the above halogen atoms, an alkyl group (e.g., methyl, ethyl, isopropyl, t-butyl, cyclopentyl, cyclohexyl, 2-ethylhexyl, dodecyl, benzyl, and trifluoromethyl), an alkoxy group (e.g., methoxy, ethoxy, 2-ethylhexyloxy, benzyloxy, dodecyloxy, and methoxyethoxy), and an alkoxycarbonyl group (e.g., methoxycarbonyl, ethoxycarbonyl, butoxycarbonyl, and hexadecyloxycarbonyl).

In formula ($III_2$-2), specific examples of $R^6$, $R^7$, and $R^8$ include a straight-chain or branched alkyl group (e.g., methyl, ethyl, trifluoromethyl, isopropyl, sec-butyl, n-propyl, n-butyl, isopentyl, isobutyl, sec-pentyl, isohexyl, and sec-decyl), a cycloalkyl group (e.g., cyclopropyl, cyclobutyl, cyclopentyl, cyclohexyl, 4-methylcyclohexyl, 4-methylcyclohexenyl, 4-t-butylcyclohexyl, cycloheptyl, menthyl, bornyl, bicyclo[2,2,1-]heptane-2-yl), an aralkyl group (e.g., benzyl, 4-methoxybenzyl, 1-naphthylmethyl, and phenethyl), an aryl group (e.g., phenyl, 4-methoxyphenyl, 2,4-dichlorophenyl, p-tolyl, and 1-naphthyl), and a heterocyclic group (e.g., furyl, thienyl, pyridyl, N-methylimidazolyl, N-methylpyrrolyl, tetrahydrofurfuryl, N-ethylindolyl, and quinolyl).

In formula ($III_5$-2), when $R^7$ and $R^8$ bond together to form a ring, for example,

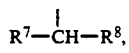

its examples include cyclopentyl, cyclohexyl, menthyl, fenchyl, bornyl, and bicyclo[2,2,1]heptane-2-yl.

Out of the compounds represented by formula ($III_5$-2), compounds that are used preferably in the present invention satisfy one of the following conditions (1) or (2):

(1) The total number of α-hydrogen atoms of $R^6$, $R^7$, and $R^8$ does not exceed 7.

(2) When $R^6$ is a hydrogen atom, one of the following (a) or (b) is satisfied:

(a) When $R^7$ and $R^8$ bond together to form a ring, the total number of α-hydrogen atoms or $R^7$ and $R^8$ does not exceed 1.

(b) When $R^7$ and $R^8$ do not form a ring, the α-position of $R^7$ or $R^8$ is substituted by two different substituents.

More preferably, in the compounds represented by formula ($III_5$-2), γ is 0 and s is 2, and particularly preferably the compounds are represented by the following formula ($III_5$-3) or ($III_5$-4)

Formula ($III_5$-3)

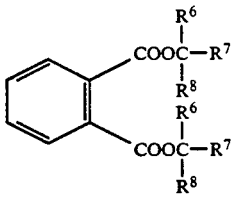

Formula ($III_5$4)

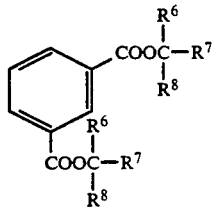

$R^6$, $R^7$and $R^8$ in formulae ($III_2$-3) and ($III_2$-2) have the same meanings as those defined in formula ($III_5$-2).

Particularly preferably

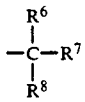

in formula ($III_5$-2) satisfies one of the following conditions (3) or (4).

(3) $R^6$, $R^7$, and $R^8$ are all alkyl groups (including cycloalkyl and aralkyl groups), provided that $R^6$, $R^7$, and $R^8$ are not methyl groups at the same time.

(4) $R^6$ is a hydrogen atom or an alkyl group, and $R^7$ and $R^8$ bond together to form a substituted or unsubstituted cyclohexane ring or cyclohexene ring.

Specific examples of

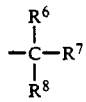

in formula ($III_5$-2) are given below.

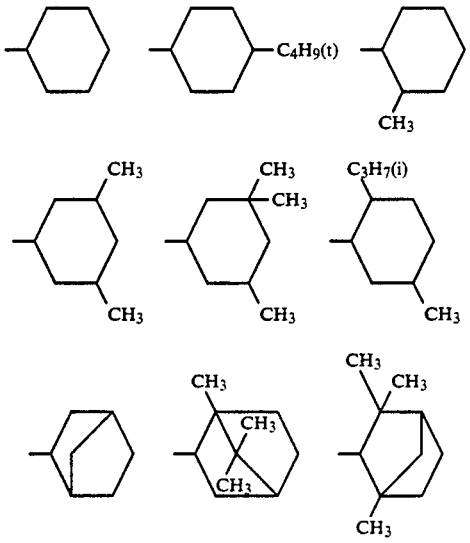

-continued

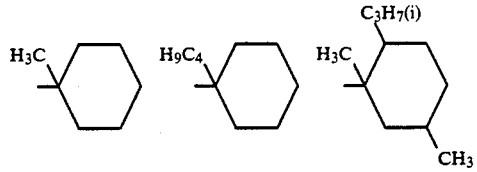

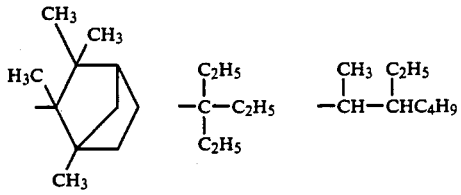

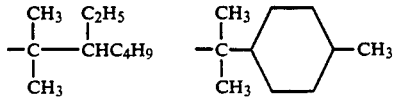

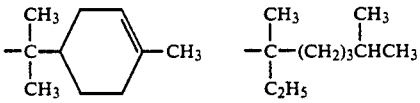

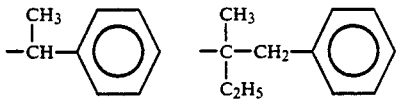

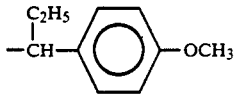

Specific examples of the compound represented by formula ($III_5$-2) are given below, but the present invention is not limited to them.

Formula [$III_5$-2-a]:

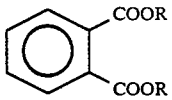

In the above formula ($III_2$-2-a), R represents the followings:

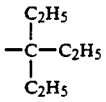

(S-95)

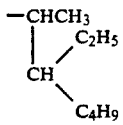

(S-96)

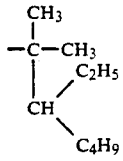

(S-97)

-continued
(S-98)
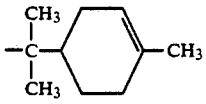
(S-99)
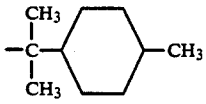
(S-100)
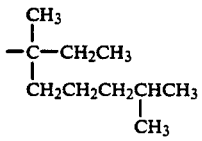
(S-101)
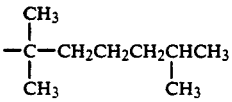
(S-102)
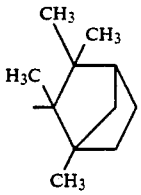
(S-103)
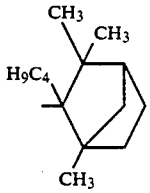
(S-104)
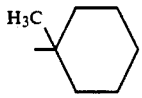
(S-105)
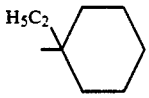
(S-106)
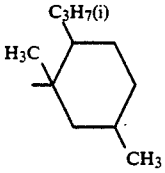
(S-107)
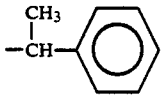
(S-108)
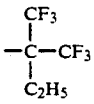
-continued
(S-109)
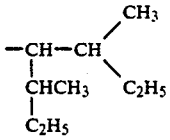
(S-110)
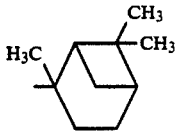
(S-111)
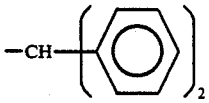
(S-112)
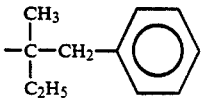
(S-113)
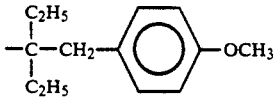
(S-114)
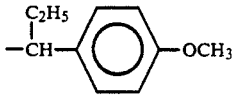
(S-115)
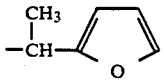
(S-116)
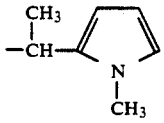
Formula ($III_5$-2-b)
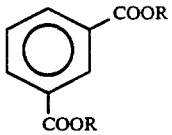
In the above formula ($III_2$-2-b), R represents the followings:
(S-117)
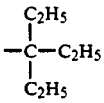
(S-118)
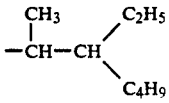
(S-119)
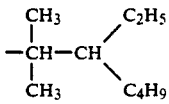

-continued
(S-120)
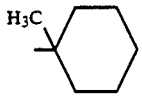
(S-121)
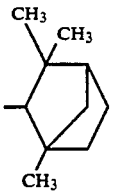
Besides the above, specific examples of the compound included in those represented by formula ($III_2$-2) that can be mentioned are as follows:
(S-122)
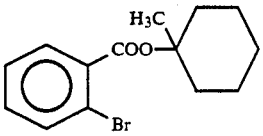
(S-123)
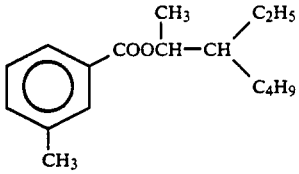
(S-124)
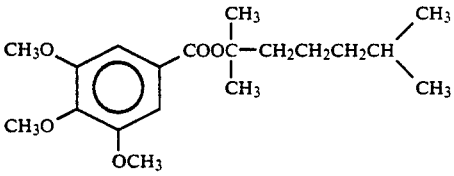
(S-125)
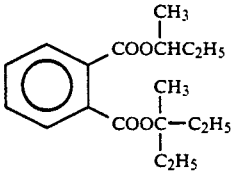
(S-126)
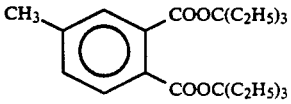
(S-127)
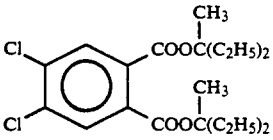
(S-128)
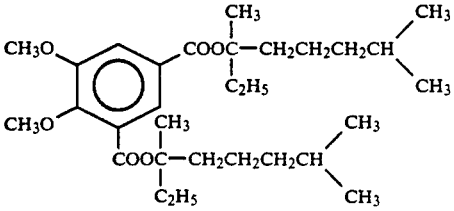
-continued
(S-129)
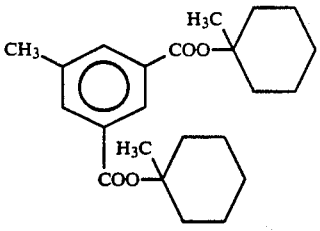
(S-130)
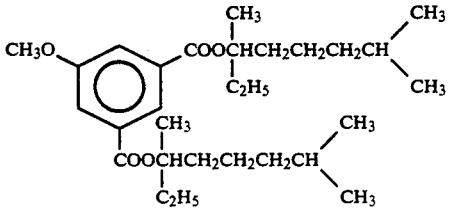
(S-131)
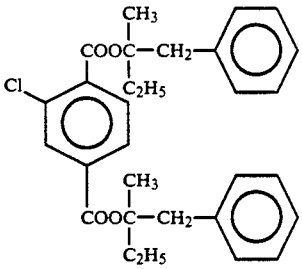
(S-132)
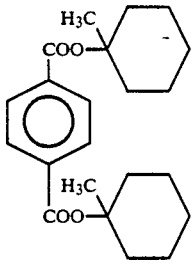
(S-133)
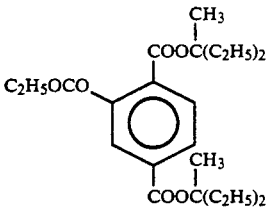
(S-134)
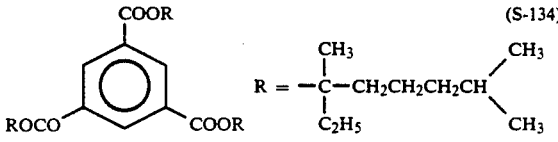
(S-135)
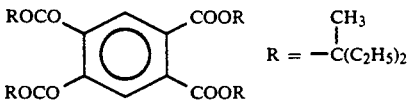

-continued (S-136)

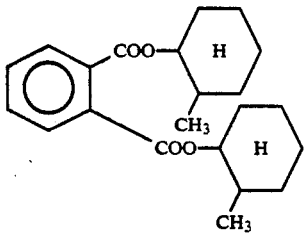

(S-137)

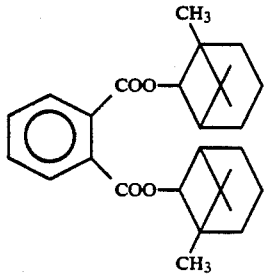

(S-138)

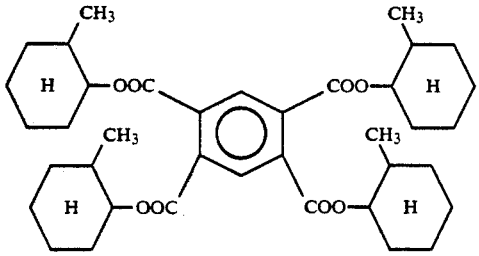

(S-139)

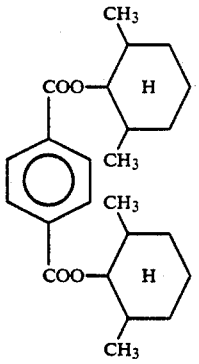

(S-140)

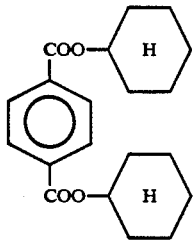

(S-141)

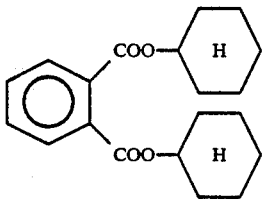

-continued (S-142)

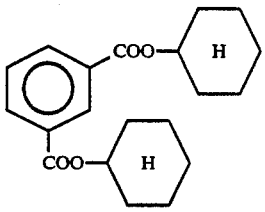

(S-143)

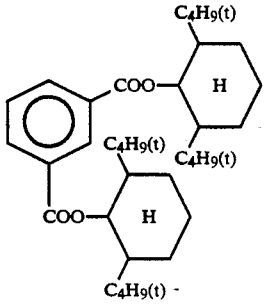

These compounds represented by formula ($III_5$-2) can be synthesized according to the following synthesis method:

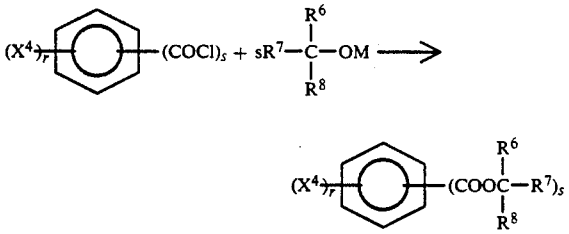

wherein M represents a hydrogen atom, Li, Na, or K. When M is a hydrogen atom, for example, pyridine, triethylamine, tetramethylguanidine, DBN, DBU, sodium carbonate, and potassium carbonate can be used as the base. As the reaction solvent, for example, acetonitrile, dimethylformamide, dimethylacetamide, N,N-dimethylimidazolidinone, sulfolane, dimethylsulfoxide, benzene, toluene, xylene, dioxane, and tetrahydrofuran are preferable.

Specific examples produced by this synthesis process are described, for example, in Published European Patent Application (EP) No. 228064.

Preferable water-insoluble organic polymers (hereinafter referred to as polymers) used in the silver halide photographic material according to the present invention are those having a relative fluorescence efficiency K value of 0.10 or over, and more preferably 0.20 or over. The higher this value is, the better.

The above K value is the relative fluorescence efficiency of a compound A, in the polymer, which has the structure given below and is a kind of dye that is used as a so-called fluorescence probe, and which is defined by the expression given below.

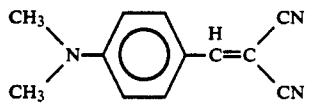

Compound A $K = \phi a/\phi b$ wherein $\phi a$ and $\phi b$ are respectively the fluorescence efficiencies of the compound A in polymer a and polymer b, and $\phi a$ and $\phi b$ are determined, for example, by following the method described in *Macromolecules*, 14, 587 (1981). Specifically, the value K was determined from $\phi a$ and $\phi b$ measured at room temperature by using the polymer thin film (note: the thickness of the thin film was adjusted by spin coating on a slide glass so that the absorbance of the compound A at $\lambda max$ might be 0.05 to 0.1). In the present invention, the K value was obtained using, as the polymer b, polymethyl methacrylate (having a number-average molecular weight of 20,000).

Specific examples of the polymer according to the present invention are listed and described below, but the present invention is not limited to them.

(A) Vinyl Polymers

As monomers that will form the vinyl polymer of the present invention, can be mentioned acrylates, specifically, methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, diemthylaminoethyl acrylate, benzyl acrylate, methoxybenzyl acrylate, 2-chlorocyclohexyl acrylate, cyclohexyl acrylate, furfuryl acrylate, tetrahydrofrufuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-iso-propoxy acrylate, 2-butoxyethyl acrylate, 2-(2-methoxyethoxy)ethyl acrylate, 2-(2-butoxyethoxy)ethyl acrylate, $\omega$-methoxypolyethylene glycol acrylate (the adduct number =9), 1-bromo-2-methoxyethyl acrylate, and 1,1-dichloro-2-ethoxyethyl acrylate.

And the monomers described below can be used.

Methacrylates, for example, methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, $\omega$-methoxypolyethylene glycol methacrylate (the adduct number =6), allyl methacrylate, and methacrylic acid dimethylaminoethylmethyl chloride salt;

Vinyl esters: for example, vinyl acetate, vinyl propionate, vinyl butylate, vinyl isobutylate, vinyl caproate, vinyl chloroacetate, vinyl methoxyacetate, vinyl phenylacetate, vinyl benzoate, and vinyl salicylate;

Acrylamides: for example, methyl acrylamide, ethyl acrylamide, propyl acrylamide, butyl acrylamide, tert-butyl acrylamide, cyclohexyl acrylamide, benzyl acrylaylamide, methoxyethyl acrylamide, dimethylaminoethyl acrylamide, phenyl acrylamide, dimethyl acrylamide, diethyl acrylamide, $\beta$-cyanoethyl acrylamide, N-(2-acetoacetoxyethyl) acrylamide, diacetone acrylamide, and tert-octyl acrylamide;

Methacrylamides: for example, methacrylamide, methyl methacrylamide, ethyl methacrylamide, propyl methacrylamide, butyl methacrylamide, tert-butyl methacrylamide, cyclohexyl methacrylamide, benzyl methacrylamide, hydroxymethyl methacrylamide, methoxyethyl methacrylamide, dimethylaminoethyl methacrylamide, phenyl methacrylamide, dimethyl methacrylamide, diethyl methacrylamide, $\beta$-cyanoethyl methacrylamide, and N-(2-acetoacetoxyethyl) methacrylamide;

Olefins: for example, dicyclopentadiene, ethylene, propylene, 1-butene, 1-pentene, vinyl chloride, vinylidene chloride, isoprene, chloroprene, butadiene, and 2,3-dimethylbutadiene;

Styrenes such: for example, styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, and vinyl benzoic acid methyl ester;

Vinyl ethers: for example, methyl vinyl ether, butyl vinyl ether, hexyl vinyl ether, methoxy vinyl ether, and dimethylaminoethyl vinyl ether; and Others: for example, butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylenemalonitrile, and vinylidene.

With respect to the monomers used for the polymer of the present invention (e.g., the above-mentioned monomers), two or more monomers can be used as comonomers in relation to each other in accordance with various purposes (e.g., in order to improve the solubility). In order to adjust the color forming properties and the solubility, monomers having an acid group exemplified below as comonomers can be used in the range wherein the copolymer will not become insoluble in water:

acrylic acid; methacrylic acid; itaconic acid; maleic acid; monoalkyl itaconates such as monomethyl itaconate, monoethyl itaconate, and monobutyl itaconate; monoalkyl maleates such as monomethyl itaconate, monoethyl itaconate, and monobutyl itaconate; citraconic acid; styrenesulfonic acid; vinylbenzylsulfonic acid; vinylsulfonic acid; acryloyloxyalkylsulfonic acids such as acryloyloxymethylsulfonic acid, acryloyloxyethylsulfonic acid, and acryloyloxypropylsulfonic acid; methacryloyloxyalkylsulfonic acids such as methacryloyloxymethylsulfonic acid, methacryloyloxyethylsulfonic acid, and methacryloyloxypropylsulfonic acid; acrylamidoalkylsulfonic acids such as 2-acrylamido-2-methylethanesulfonic acid, 2-acrylamido-2-methylpropanesulfonic acid, and 2-acrylamido-2-methylbutanesulfonic acid; and methacrylamidoalkylsulfonic acids such as 2-methacrylamido-2-methylethanesulfonic acid, 2-methacrylamido-2-methylpropanesulfonic acid, and 2-methacrylamido-2-methylbutanesulfonic acid.

These acids may be in the form of salts of an alkali metal (e.g., Na and K) or ammonium ion(s).

When, from among the vinyl monomers mentioned above and other vinyl monomers used in the present invention, hydrophilic monomers (herein by "hydrophilic monomers" is meant monomers that the polymer obtained by homopolymerization the monomer is soluble in water.) are used as comonomers, there is no limit on the proportion of the hydrophilic monomer in the copolymer, unless the copolymer becomes insoluble in water, but generally the proportion of the hydrophilic monomer in the copolymer is preferably 40 mol% or below, more preferably 20 % or below, and further more preferably 10 mol% or below. Further, if the hydrophilic comonomer that will be copolymerized with the monomer of the present invention has an acid group, the proportion of the comonomer having an acid group in the copolymer is generally 20 mol% or below, preferably 10 mol% or below, and most preferably nil, in view of the image stability as stated above.

The monomer of the polymer of the present invention is preferably a methacrylate monomer, an acrylamide monomer, or a methacrylamide monomer, with particular preference given to an acrylamide monomer or a methacrylamide monomer.

(B) Polyester obtained by condensation polymerization or addition polymerization As polymers by condensation polymerization, polyester obtained from polyhydric alcohol and polybasic acid and polyamide obtained from diamine and dibasic acid or ω-amino-ω-carbonic acid are generally known, and as polymers by addition polymerization, polyurethane obtained from diisocyanate and dihydric alcohol or the like is known.

As polyhydric alcohols, glycols having the structure of HO—$R_2$—OH (wherein $R_1$ represents a hydrocarbon chain, particularly an aliphatic hydrocarbon chain, having about 2 to about 12 carbon atoms) or polyalkylene glycols are effective, and as polybasic acids, HOOC—$R_2$—COOH (wherein $R_2$ represents simply a bond or a hydrocarbon chain having 1 to about 12 carbon atoms) is effective.

As specific examples of the polyhydric alcohols, can be mentioned ethylene glycol, diethylene glycol, triethylene glycol, 1,2-propylene glycol, 1,3-propylene glycol, trimethylolpropane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, glycerine, diglycerine, triglycerine, 1-methylglycerine, erythrite, mannitol, and sorbitol.

As specific examples of the polybasic acids, can be mentioned oxalic acid, succinic acid, glutaric acid, adipic acid, pimelic acid, cork acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, metaconic acid, isopimelic acid, cyclopentadiene/maleic anhydride adduct, and rosin/maleic anhydride adduct.

As specific examples of the diamine, can be mentioned hydrazine, methylenediamine, ethylenediamine, trimethylenediamine, tetramethylenediamine, hexamethylenediamine, dodecylmethylenediamine, 1,4-diaminocyclohexane, 1,4-diaminomethylcyclohexane, o-aminoaniline, p-aminoaniline, 1,4-diaminomethylbenzene, and di(4-aminophenyl)ether.

As specific examples of ω-amino-ω-carbonic acid, cam be mentioned glycine, β-alanine, 3-aminopropanoic acid, 4-aminobutanoic acid, 5-aminopentanoic acid, 11-aminoethyl)benzoic acid, and 4-(4-aminophenyl)butanoic acid.

As specific examples of diisocyanate, can be mentioned ethylene diisocyanate, hexamethylene diisocyanate, m-phenylene diisocyanate, p-phenylene diisocyanate, p-xylene diisocyanate, and 1,5-naphtyldiisocyanate.

(C) Others

For example, a polyester obtained by ring opening polymerization as follows:

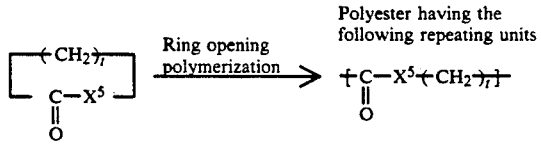

wherein $X^5$ represents —O— or —NH, t is an integer of 4 to 7, and the group —$CH_2$— may be branched.

Suitable monomers that can be used for producing the above polyester include, for example, β-propiolactone, -caprolactone, dimethylpropiolactone, α-pyrrolidone, α-piperidone, ε-caprolactam, and α-methyl-ε-caprolactam.

Further, a polymer represented by the following formula (P) can be used:

Formula (P)

wherein A represents a repeating unit having, in the main chain, at least one bond selected from an ether linkage and —$SO_2$— linkage; B represents a repeating unit having, in the main chain, at least one bond selected from a linkage

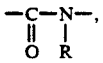

an ether linkage,a linkage

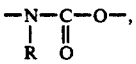

a linkage —$SO_2$—, an ester linkage, or a single bond, and it may be the same as A; R represents a hydrogen atom, an alkyl group, an aryl group, or an aralkyl group that may be substituted; and u is an integer of 5 or over.

Two or more of the above polymers of the present invention may be optionally used in combination.

As the polymer of the present invention, vinyl polymers are preferable above all, acrylic polymers are more preferable, and acrylamide polymers are particularly preferable.

Although the molecular weight and the polymerization degree of the polymers of the present invention do not influence substantially the effect of the present invention, as the molecular weight increases, it takes a longer time to dissolve the polymer in a co-solvent, and also it becomes difficult to emulsify and disperse it, since the solution viscosity becomes high, so that coarse particles may be formed, and as a result such problems are liable to occur that the color-forming properties lower and the coarse particles cause the coatability to be defective. To solve these problems, if the co-solvent is used in a larger amount, to lower the viscosity of the solution, a new problem will arise in the process. Taking the above into consideration, preferably the viscosity of the polymer is such that when 30 g of the polymer is dissolved in 100 m of a co-solvent, the viscosity is 5,000 cps or below and more preferably 2,000 cps or below. Preferably the molecular weight of the polymer that can be used in the present invention is 150,000 or below, and more preferably 100,000 or below.

In the present invention, by "water-insoluble polymers" is meant polymers whose solubility is such that 3 g or below, preferably 1 g or below, of the polymer are soluble per 100 g of distilled water.

The ratio of the polymer of the present invention to the co-solvent will change depending on the type of polymer to be used and will vary over a wide range depending, for example, on the solubility in the co-solvent, the polymerization degree of the polymer, and the solubility of the coupler. Generally, a co-solvent is used in an amount required to make the solution consisting of at least the coupler, the high-boiling coupler solvent, and the polymer in the co-solvent have a viscosity low enough to allow the solution to be easily dispersed in water or an aqueous hydrophilic colloid solution. The higher the polymerization degree of a polymer is, the higher the viscosity of the solution is, and therefore, although it is difficult to determine absolutely the proportion of polymers to a particular co-solvent without considering the type of the polymer, generally preferably the weight ratio is in the range of about 1 : 1 to 1 : 50. Preferably the weight ratio of the polymer of the present invention to the coupler is 1 : 20 to 20 : 1, and more preferably 1 : 10 to 10 : 1.

Some specific examples of the polymer used in the present invention are given below, but the present invention is not limited to them.

P-1) poly(methyl methacrylate)
P-2) poly(ethyl methacrylate)
P-3) polyisopropyl methacrylate
P-4) polymethyl chloroacrylate
P-5) poly(2-tert-butylphenyl acrylate)
P-6) poly(4-tert-butylphenyl acrylate)
P-7) ethyl methacrylate/n-butyl acrylate copolymer (70 : 30)
P-8) methyl methacrylate/acrylonitrile copolymer (65 : 35)
P-9) methyl methacrylate/styrene copolymer (90 : 10)
P-10) N-tert-butyl methacrylamide/methyl methacrylate/acrylic acid copolymer (60 : 30 : 10)
P-11) methyl methacrylate/styrene/vinyl sulfonamide copolymer (70 : 20 : 10)
P-12) methyl methacrylate/cyclohexyl methacrylate copolymer (50 : 50)
P-13) methyl methacrylate/acrylic acid copolymer (95 : 5)
P-14) methyl methacrylate/n-butyl methacrylate copolymer (65 : 35)
P-15) methyl methacrylate/N-vinyl-2-pyrrolidone copolymer (90 : 10)
P-16) poly(N-sec-butyl acrylamide)
P-17) poly(N-tert-butyl acrylamide)
P-18) polycyclohexyl methacrylate/methyl methacrylate copolymer (60 : 40)
P-19) n-butyl methacrylate/methyl methacrylate/acrylamide copolymer (20 : 70 : 10)
P-20) diacetone acrylamide/methyl methacrylate copolymer (20 : 80)
P-21) N-tert-butyl acrylamide/methyl methacrylate copolymer (40 : 60)
P-22) poly(N-n-butyl acrylamide)
P-23) tert-butyl methacrylate/N-tert-butyl acrylamide copolymer (50 : 50)
P-24) tert-butyl methacrylate/methyl methacrylate copolymer (70 : 30)
P-25) poly(N-tert-butyl methacrylamide)
P-26) N-tert-butyl acrylamide/methyl methacrylate copolymer (60 : 40)
P-27) methyl methacrylate/acrylonitrile copolymer (70 : 30)
P-28) methyl methacrylate/styrene copolymer (75 : 25)
P-29) methyl methacrylate/hexyl methacrylate copolymer (70 : 30)
P-30) poly(4-biphenyl acrylate)
P-31) poly(2-chlorophenyl acrylate)
P-32) poly(4-chlorophenyl acrylate)
P-33) poly(pentachlorophenyl acrylate)
P-34) poly(4-ethoxycarbonylphenyl acrylate)
P-35) poly(4-methoxycarbonylphenyl acrylate)
P-36) poly(4-cyanophenyl acrylate)
P-37) poly(4-methoxyphenyl acrylate)
P-38) poly(3,5-dimethyladamantyl acrylate)
P-39) poly(3-dimethylaminophenyl acrylate)
P-40) poly(2-naphthyl acrylate)
P-41) poly(phenyl acrylate)
P-42) poly(N,N-dibutyl acrylamide)
P-43) poly(isohexyl acrylamide)
P-44) poly(isooctyl acrylamide)
P-45) poly(N-methyl-N-phenyl acrylamide)
P-46) poly(adamantyl methacrylate)
P-47) poly(sec-butyl methacrylate)
P-48) N-tert-butyl acrylamide/acrylic acid copolymer (97 : 3)
P-49) poly(2-chloroethyl methacrylate)
P-50) poly(2-cyanoethyl methacrylate)
P-51) poly(2-cyanomethylphenyl methacrylate)
P-52) poly(4-cyanophenyl methacrylate)
P-53) poly(cyclohexyl methacrylate)
P-54) poly(2-hydroxypropyl methacrylate)
P-55) poly(4-methoxycarbonylphenyl methacrylate)
P-56) poly(3,5-dimethyladamantyl methacrylate)
P-57) poly(phenyl methacrylate)
P-58) poly(4-butoxycarbonylphenyl methacrylamide)
P-59) poly(4-carboxyphenyl methacrylamide)
P-60) poly(4-ethoxycarbonylphenyl methacrylamide)
P-61) poly(4-methoxycarbonylphenyl methacrylamide)
P-62) poly(cyclohexyl chloroacrylate)
P-63) poly(ethyl chloroacrylate)
P-64) poly(isobutyl chloroacrylate)
P-65) poly(isopropyl chloroacrylate)
P-66) poly(N-phenyl acrylamide)
P-67) poly(N-phenyl methacrylamide)

P-68) poly(N-cyclohexyl acrylamide)
P-69) poly(N-cyclohexyl methacrylamide)

Polymers to be used in the present invention can be synthesized by, for example, the methods described below or methods corresponding thereof.

SYNTHESIS EXAMPLE (1)

Synthesis of methyl methacrylate polymer (P-1)

500 g of methyl methacrylate, 0.5 g of sodium polyacrylate, and 200 ml of distilled water were charged into a 500 ml three-necked flask and heated to 80° C. under a flow of nitrogen with stirring. 500 mg of dimethyl azo-bis-isolactate as a polymerization initiator was added to start polymerization.

After two hours of polymerization, the polymeric liquid was cooled, and the polymer, in the form of beads, was filtered and washed with water, to produce 48.7 g of P-3.

SYNTHESIS EXAMPLE (2)

Synthesis of t-butyl acrylamide polymer (P-17)

A mixture of 500 g of t-butyl acrylamide and 250 ml of toluene was charged into a 500 ml three-necked flask and heated to 80° C. under a flow of nitrogen with stirring. Then, as a polymerization initiator, 10 ml of a toluene solution containing 500 ml of azo-bis-isobutyronitrile was added to start polymerization.

After 3 hours of polymerization, the polymeric liquid was cooled and poured into 1 liter of hexane, and the deposited solid was filtered, washed with hexane, and heated under reduced pressure with stirring, to obtain 47.9 g of P-17.

The dispersion of lipophilic fine particles containing compounds to be used in the present invention (that is, an oil-soluble cyan coupler represented by formula (X), compounds represented by formula (I) or (II) and formula (III) or (IV), and, further, a high-boiling organic solvent having a viscosity of 200 cps (25° C.) or more and an water-soluble organic polymer which may be used by needs) is prepared in the following manner.

The compounds for use in the present invention are dissolved completely in an organic co-solvent with photographic additives, then the obtained solution is dispersed as fine particles into water, preferably into an aqueous hydrophilic colloid emulsion, and more preferably into an aqueous gelatin solution, by means of ultrasonic waves, a colloid mill, or the like, with the aid of a dispersant, and then the dispersion is incorporated into a silver halide emulsion. Alternately, it is also possible that water or an aqueous hydriphilic colloid solution, such as an aqueous gelatin solution, is added into an organic co-solvent containing a dispersant, such as a surface-active agent, compounds to be used in the present invention, to cause phase reversal so that an oil-in-water dispersion may be formed. After the organic co-solvent may be removed from the thus prepared dispersion by means, for example, of distillation, noodle washing, or ultrafiltration, the dispersion may be mixed with a photographic emulsion. Herein the term "organic co-solvent" means organic solvents useful at the time of emulsification and dispersion, which solvents will be eventually be removed substantially from the photographic material during the drying step after coating, or, for example, by the above means; they have a low boiling point and a certain extent of solubility in water, and can be removed by washing with water or the like. As the organic co-solvent, acetates of lower alcohols, such as ethyl acetate and butyl acetate, ethyl propionate, secondary butyl alcohol, methyl ethyl ketone, methyl isobutyl ketone, β-ethoxyethyl acetate, methyl Cellosolve acetate, methyl Carbitol acetate, methyl Carbitol propionate, and cyclohexane can be exemplified.

Further, if required, an organic solvent completely compatible with water, such as methyl alcohol, ethyl alcohol, acetone, and tertahydrofuran, can be used partly in addition.

The combination use with the above mentioned high-boiling organic solvent and/or water-insoluble polymer is more effective for preventing the insufficiency of color formation and fading.

As the silver halide emulsion to be used in the present invention, in particular, for the purpose of rapid processing, it is preferable to use a silver chloride or silver chlorobromide emulsion substantially free from silver iodide and containing silver chloride of 80 mol% or more, preferably 95 mol% or more, particularly preferably 98 mol% or more.

In the photographic material of the present invention, in order to improve, for example, the sharpness of an image, preferably a dye that can be processed to be decolored (in particular an oxonol dye), as described in European Patent EP 0,337,490A2, pages 27 to 76, is added to the hydrophilic colloid layer, so that the optical reflection density of the photographic material at 680 nm may be 0.7 or over, or titanium oxide, whose surface has been treated with a dihydric to tetrahydric alcohol (e.g., trimethylolethane) is contained in an amount of 12% by weight or more (more preferably 14% by weight or more) in the water resistant resin layer of the base.

In the photographic material of the present invention, an image dye preservability improving compound, as described in European Patent EP 0,277,589A2, is preferably used in combination with the coupler.

In particular, a combination with a pyrazoloazole coupler is preferable.

That is, the use of a compound (F) which will chemically combine with the aromatic primary aminedeveloping agent remaining after color development processing to produce a chemically inactive and substantially colorless compound, and/or a compound (G) which will chemically combine with the oxidized product of the aromatic primary amine developing agent remaining after color development processing to produce a chemically inactive and substantially colorless compound is preferable because the occurrence of stain due to the production of a color-formed dye by the reaction between the coupler and the color developing agent remaining in the film or its oxidized product and other side effects on storage after the processing can be prevented.

Preferable as compound (F) are those that can react with p-anisidine at the second-order reaction-specific rate $k_2$ (in trioctyl phosphate at 80° C.) in the range of 1.0 l/mol.sec to $1\times10^{-5}$ l/mol.sec. The second-order reaction-specific rate can be determined by the method described in JP-A No. 158545/1983.

If $k_2$ is over this range, the compound itself becomes unstable, and in some cases the compound reacts with gelatin or water to decompose. On the other hand, if $k_2$ is below this range, the reaction with the remaining aromatic amine developing agent becomes slow, resulting, in some cases, in the failure to prevent the side effects of the remaining aromatic amine developing agent, which is an object of the present invention.

More preferable as compound (F) are those that can be represented by the following formula (FI) or (FII):

$$R_{21}-(A_1)_n-X_{21} \qquad \text{Formula (FI)}$$

$$R_{22}-\underset{\underset{B_1}{|}}{C}=Y_1 \qquad \text{Formula (FII)}$$

wherein $R_{21}$ and $R_{22}$ each represent an aliphatic group, an aromatic group, or a heterocyclic group, n is 1 or 0, $A_1$ represents a group that will react with an aromatic amine developing agent to form a chemical bond therewith, $X_{21}$ represents a group that will react with the aromatic amine developing agent and split off, $B_1$ represents a hydrogen atom, an aliphatic group, an aromatic group, a heterocyclic group, an acyl group, or a sulfonyl group, $Y_1$ represents a group that will facilitate the addition of the aromatic amine developing agent to the compound represented by formula (FII), and $R_{21}$ and $X_{21}$, or $Y_1$ and $R_{22}$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 283338/1987, European Published Patent Nos. 298,321 and 277,589.

On the other hand, more preferable examples of compound (G), which will chemically bond to the oxidized product of the aromatic amine developing agent remaining after color development processing, to form a chemically inactive and colorless compound, can be represented by the following formula (GI):

$$R_{23}-Z \qquad \text{Formula (GI)}$$

wherein $R_{23}$ represents an aliphatic group, an aromatic group, or a heterocyclic group, Z represents a nucleophilic group or a group that will decompose in the photographic material to release a nucleophilic group. Preferably the compounds represented by formula (GI) are ones wherein $^{n}CH_3I$ value (R. G. Pearson, et al., *J. Am. Cem. Soc.*, 90, 319 (1968)) is 5 or over, or a group derived therefrom.

Specific examples of compounds represented by formula (GI) are described, for example, in European Published Patent No. 255722, JP-A Nos. 143048/1987 and 229145/1987, Japanese Patent Application Nos. 136724/1988 and 214681/1987, and European Published Patent Nos. 298,321 and 277,589.

Details of combinations of compound (G) and compound (F) are described in European Published Patent No. 277,589.

To the photographic material according to the present invention, a mildew-proofing agent, as described in JP-A No. 271247/1988, is preferably added in order to prevent the growth of a variety of mildews and fungi that will propagate in the hydrophilic colloid layer and deteriorate the image.

As a base to be used for the photographic material of the present invention, a white polyester base for display may be used, or a base may be used wherein a white pigment is placed on the side that will have the silver halide emulsion layer. Further, in order to improve sharpness, preferably an anti-halation layer is applied on the side of the base where the silver halide emulsion layer is applied or on the undersurface of the base. In particular, preferably the transmission density of the base is set in the range of 0.35 to 0.8, so that the display can be appreciated through either reflected light or transmitted light.

The photographic material of the present invention may be exposed to visible light or infrared light. The method of exposure may be low-intensity exposure or high-intensity short-time exposure, and particularly in the latter case, the laser scan exposure system, wherein the exposure time per picture element is less than $10^{-4}$ sec is preferable.

When exposure is carried out, the band stop filter, described in U.S. Pat. No. 4,880,726, is preferably used. Thereby light color mixing is eliminated and the color reproduction is remarkably improved.

The exposed photographic material may be subjected to conventional black-and-white development processing or color processing, and in the case of a color photographic material, preferably it is subjected to color development processing and then is bleached and fixed for the purpose of rapid processing. In particular, when the above-mentioned high-silver-chloride emulsion is used, the pH of the bleach-fix solution is preferably about 6.5 or below, more preferably about 6 or below, for the purpose of the acceleration of desilvering, etc.

With respect to silver halide emulsions, other materials (e.g., additives) and photographic component layers (e.g., layer arrangement) that will be applied to the photographic material of the present invention, as well as processing methods and processing additives that will be applied to the photographic material of the present invention, particularly those described in below-mentioned patent publications, particularly in European Patent EP 0,355,660A2 (JP-A No. 107011/1989), are preferably used.

In the present invention, magenta couplers and yellow couplers may be contained in an amount of 0.1 to 1.0 mol, preferably 0.20 to 0.5 mol, per mol of the silver halide, respectively.

| Element constituting photographic material | JP-A No. 215272/1987 | JP-A No. 33144/1990 | EP 0,355,660A2 |
|---|---|---|---|
| Silver halide emulsion | p. 10 upper right column line 6 to p. 12 lower left column line 5, and p. 12 lower right column line 4 from the bottom to p. 13 upper left column line 17 | p. 28 upper right column line 16 to p. 29 lower right column line 11 and p. 30 lines 2 to 5 | p. 45 line 53 to p. 47 line 3 and p. 47 lines 20 to 22 |
| Solvent for silver halide | p. 12 lower left column line 6 to 14 and | — | — |

-continued

| Element constituting photographic material | JP-A No. 215272/1987 | JP-A No. 33144/1990 | EP 0,355,660A2 |
|---|---|---|---|
| | p. 13 upper left column line 3 from the bottom to p. 18 lower left column last line | | |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 38 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magent, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthen agent | P. 121 upper left column line 7 to p. 125 upper right column line 1 | — | — |
| Ultra violet absorbent | p. 125 upper right column line 2 to p. 127 lower left column last line | p. 37 lower right column line 14 to p. 38 upper left column line 11 | p. 65 lines 22 to 31 |
| Discoloration inhibitor (Image-dye stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |
| High-boiling and/or low-boiling solvent | p. 137 lower left column line 9 to p. 144 upper right column last line | p. 35 lower right column line 14 to p. 36 upper left column line 4 | p. 64 lines 1 to 51 |
| Method for dispersing additives for photograph | p. 144 lower left column line 1 to p. 146 upper right column line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left column line 4 | — | — |
| Developing Agent precursor | p. 155 lower left column line 5 to p. 155 lower right column line 2 | — | — |
| Compound releasing development restrainer | p. 155 lower right column lines 3 to 9 | — | — |
| Base | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layer | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower ringt column last line | p. 38 upper left column line 12 to upper right column line 7 | p. 66 lines 18 to 22 |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor | p. 188 lower right column line 9 to p. 193 lower right column line 10 | p. 37 upper left column last line to lower right column line 13 | p. 65 line 32 to p. 66 line 1 |
| Surface-active agent | p. 201 lower left column line 1 to p. 210 upper right column last line | p. 18 upper right column line 1 to p. 24 lower right column last line and | — |

-continued

| Element constituting photographic material | JP-A No. 215272/1987 | JP-A No. 33144/1990 | EP 0,355,660A2 |
|---|---|---|---|
| | | p. 27 lower left column line 10 from the bottom to lower right column line 9 | |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | — |
| Binder (Hydrophilic colloid) | p. 222 lower left column line 6 to p. 225 upper left column last line | p. 38 upper right column lines 8 to 18 | p. 66 lines 23 to 28 |
| Thickening agent | p. 225 upper right column line 1 to p. 227 upper right column line 2 | — | — |
| Antistatic agent | p. 227 upper right column line 3 to p. 230 upper left column line 1 | — | — |
| Polymer latex latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note:
In the cited part of JP-A No. 21572/1987, amendment filed on March 16, 1987 is included.

Next, the present invention will be described in more detail in accordance with examples, but the invention is not limited to them.

EXAMPLE 1

A multilayer color printpaper having layer compositions shown below was prepared by coating various photographic constituting layers on a paper base laminated on both sides thereof with polyethylene film, followed by subjecting to a corona discharge treatment on the surface thereof and provided a gelatin prime coat layer containing sodium dodecylbenzenesulfonate. Coating solutions were prepared as follows:

Preparation of the fifth layer coating solution

To a mixture of 9.6 g of cyan coupler (ExC), 0.9 g of image-dye stabilizer (Cpd-2), 0.6 g of image-dye stabilizer (Cpd-4), 5.4 g of image-dye stabilizer (Cpd-6),12 g of image-dye stabilizer (Cpd-7), 1.5 g of image-dye stabilizer (Cpd-8), 0.9 g of image-dye stabilizer (Cpd-9), and 4.2 g of solvent (Solv-6), 25.0 ml of ethyl acetate was added and dissolved. The resulting solution was dispersed and emulsified in 402 ml of 10% aqueous gelatin solution containing 20.0 ml of sodium dodecylbenzenesulfonate, thereby prepared emulsified dispersion A. Separately silver chlorobromide emulsion A (cubic grains, 1 : 4 (silver mol ratio) blend of grains having 0.58 μm and 0.45 μm of average grain size, and 0.09 and 0.11 of deviation coefficient of grain size distribution, respectively, each in which 0.6 mol% of AgBr was located at the surface of grains) was prepared. Red-sensitive sensitizing dye, shown below, was added in this emulsion C in such an amount of the dye that corresponds to $0.9\times10^{-4}$ mol to the large size emulsion C and $1.1\times10^{-4}$ mol to the small size emulsion C, per mol of silver, respectively. The chemical ripening of this emulsion was carried out by adding sulfur and golf sensitizing agents. The above-described emulsified dispersion A and this silver chlorobromide emulsion C were mixed together and dissolved to give the composition shown below, thereby preparing the fifth layer coating solution.

Coating solutions for the second to fourth, sixth and seventh layers were also prepared in the same manner as the fifth layer coating solution. As a gelatin hardener for the respective layers, 1-hydroxy-3,5-dichloro-s-triazine sodium salt was used.

Further, Cpd-11 and Cpd-12 were added in each layer in such amounts that the respective total amount becomes 25.0 mg/m$^2$ and 50 mg/m$^2$.

As spectral-sensitizing dyes for the respective layers, the following compounds were used:

Sensitizing dye A for blue-sensitive emulsion layer

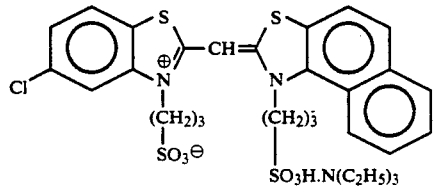

-continued

Sensitizing dye B for blue-sensitive emulsion layer

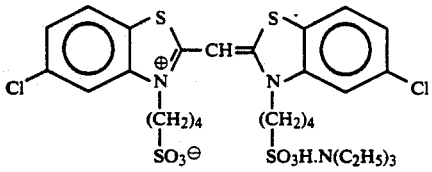

(each $2.0 \times 10^{-4}$ mol to the large size emulsion A and $2.5 \times 10^{-4}$ mol to the small size emulsion B, per mol of silver halide.)

Sensitizing dye C for green-sensitive emulsion layer

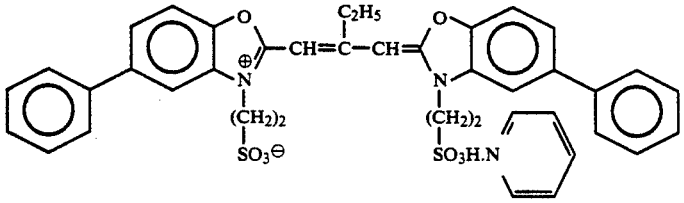

($4.0 \times 10^{-4}$ mol to the large size emulsion B and $5.6 \times 10^{-4}$ mol to the small size emulsion B, per mol of silver halide)

and

Sensitizing dye D for green-sensitive emulsion layer

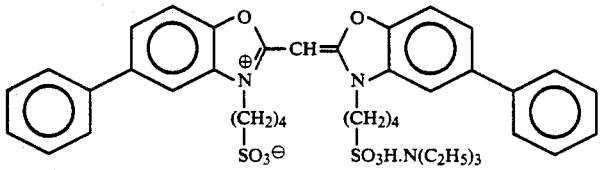

($7.0 \times 10^{-5}$ mol to the large size emulsion B and $1.0 \times 10^{-5}$ mol to the small size emulsion B, per mol of silver halide)

Sensitizing dye (Exemplified compound V-17) for red-sensitive emulsion layer

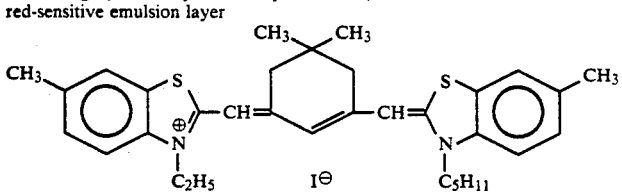

($0.9 \times 10^{-4}$ mol to the large size emulsion C and $1.1 \times 10^{-4}$ mol to the small size emulsion C, per mol of silver halide)

To the red-sensitive emulsion layer, the following compound was added in an amount of $2.6 \times 10^{-3}$ mol per mol of silver halide:

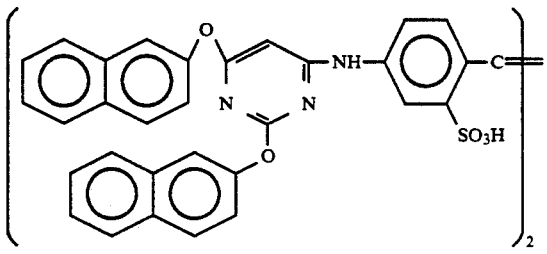

Further, 1-(5-methylureidophenyl)-5-mercaptotetrazole was added to the blue-sensitive emulsion layer, the green-sensitive emulsion layer, and the red-sensitive emulsion layer in amount of $8.5 \times 10^{-5}$ mol, $7.0 \times 10^{-4}$ mol, and $2.5 \times 10^{-4}$ mol, per mol of silver halide, respectively.

Further, 4-hydroxy-6-methyl-1,3,3*a*,7-tetrazaindene was added to the blue-sensitive emulsion layer and the green-sensitive emulsion layer in amount of $1 \times 10^{-4}$ mol and $2 \times 10^{-4}$ mol, per mol of silver halide, respectively.

The dyes shown below (figure in parentheses represents coating amount) were added to the emulsion layers for prevention of irradiation.

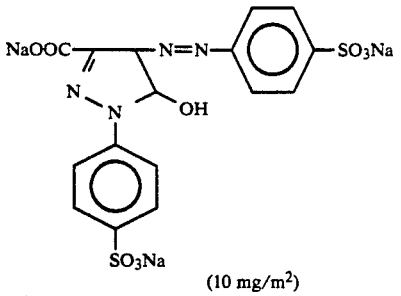

(10 mg/m²)

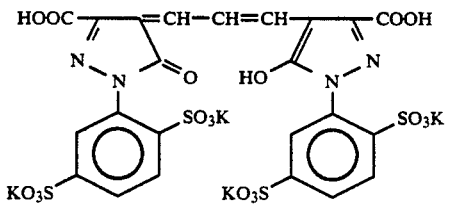

(10 mg/m²)

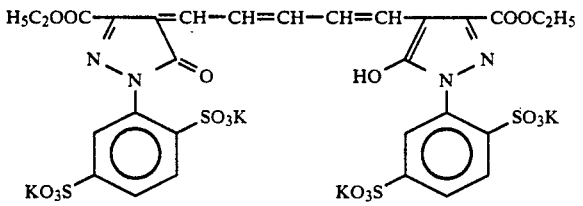

(40 mg/m²)

and

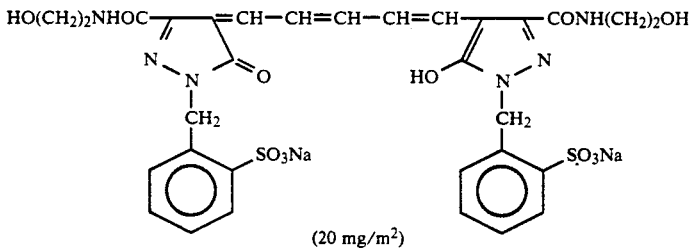

(20 mg/m²)

Composition of Layers

The composition of each layer is shown below. The figures represent coating amount (g/m²). The coating amount of each silver halide emulsion is given in terms of silver.

Supporting Base

Paper laminated on both sides with polyethylene (a white pigment, $TiO_2$, and a bluish dye, ultramarine, were included in the first layer side of the polyethylene-laminated film)

| | |
|---|---|
| First Layer (Blue-sensitive emulsion layer) | |
| Silver chlorobromide emulsion (cubic grains, 3:7 (Ag mol ratio) blend of large size emulsion A having average grain size of 0.88 μm and small size emulsion A having average grains size of 0.70 μm, whose deviation coefficient of grain size distribution is 0.08 and 0.10, respectively, each in which 0.3 mol % of AgBr was located at the surface of grains) | 0.30 |
| Gelatin | 1.86 |
| Yellow coupler (ExY) | 0.82 |
| Image-dye stabilizer (Cpd-1) | 0.19 |
| Solvent (Solv-3) | 0.18 |
| Solvent (Solv-7) | 0.18 |
| Image-dye stabilizer (Cpd-7) | 0.06 |
| Second Layer (Color-mix preventing layer) | |

-continued

| | |
|---|---|
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer) | |
| Silver chlorobromide emulsions (cubic grains, 1:3 (Ag mol ratio) blend of large size emulsion B having average grain size of 0.55 μm and small size emulsion B having average grain size of 0.39 μm, whose deviation coefficient of grain size distribution is 0.10 and 0.08, respectively, each in which 0.8 mol % of AgBr was located at the surface of grains) | 0.12 |
| Gelatin | 1.24 |
| Magenta coupler (ExM) | 0.23 |
| Image-dye stabilizer (Cpd-2) | 0.03 |
| Image-dye stabilizer (Cpd-3) | 0.16 |
| Image-dye stabilizer (Cpd-4) | 0.02 |
| Image-dye stabilizer (Cpd-10) | 0.02 |
| Solvent (Solv-4) | 0.40 |
| Fourth Layer (Ultraviolet ray-absorbing layer) | |
| Gelatin | 1.58 |
| Ultraviolet ray-absorber (UV-1) | 0.47 |
| Color-mix inhibitor (Cpd-5) | 0.05 |
| Solvent (Solv-5) | 0.24 |
| Fifth Layer (Red-sensitive emulsion layer) | |
| Silver chlorobromide emulsions (cubic grains, 1:4 (Ag mol ratio) blend of large size emulsion C having average grain size of 0.58 μm and small size emulsion C having average grain size of 0.45 μm, whose deviation coefficient of grain size distribution is 0.09 and 0.11, respectively, each in which 0.6 mol % of AgBr was located at the surface of grains) | 0.23 |
| Gelatin | 1.34 |
| Cyan coupler (ExC) | 0.32 |
| Image-dye stabilizer (Cpd-2) | 0.03 |
| Image-dye stabilizer (Cpd-4) | 0.02 |
| Image-dye stabilizer (Cpd-6) | 0.18 |
| Image-dye stabilizer (Cpd-7) | 0.40 |
| Image-dye stabilizer (Cpd-8) | 0.05 |
| Image-dye stabilizer (Cpd-9) | 0.03 |
| Solvent (Solv-6) | 0.14 |
| Sixth layer (Ultraviolet ray-absorbing layer) | |
| Gelatin | 0.53 |
| Ultraviolet ray-absorber (UV-1) | 0.16 |
| Color-mix inhibitor (Cpd-5) | 0.02 |
| Solvent (Solv-5) | 0.08 |
| Seventh layer (Protective layer) | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler

Mixture ((a):(b) = 1:1 in molar ratio) of (a) R = 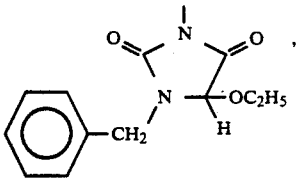 , X = Cl;

(b) R = 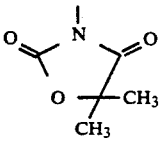 , X = $OCH_3$ of the following formula

-continued
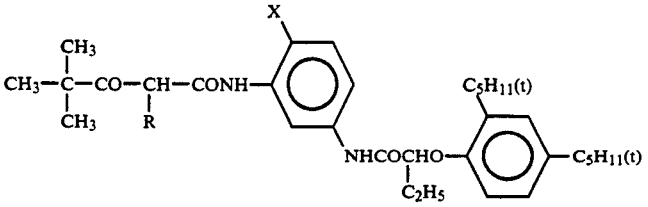
(ExM) Magenta coupler
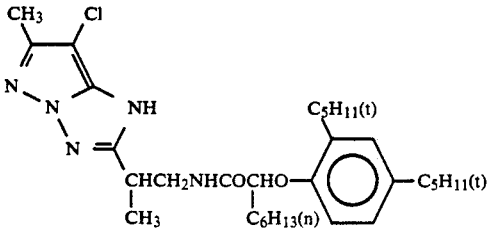
(ExC) Cyan coupler
Mixture (1:1:1 in molar ratio) of
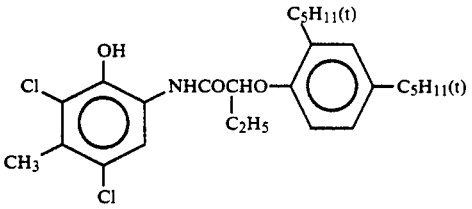
and
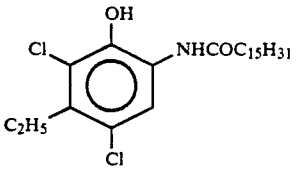
(Cpd-1) Image-dye stabilizer
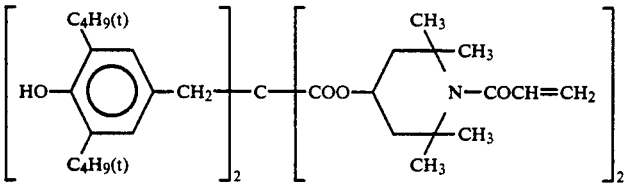
(Cpd-2) Image-dye stabilizer
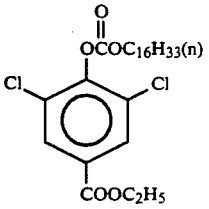
(Cpd-3) Image-dye stabilizer -continued
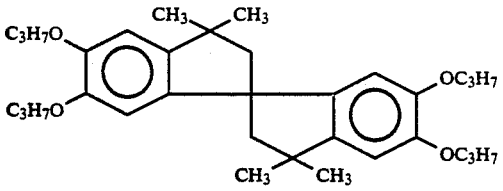
(Cpd-4) Image-dye stabilizer
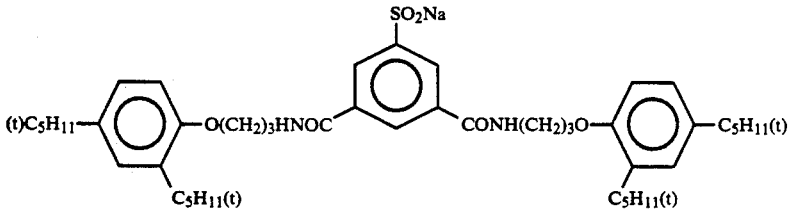
(Cpd-5) Color-mix inhibitor
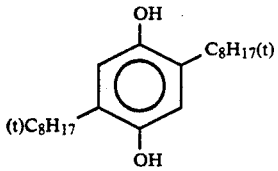
(Cpd-6) Image-dye stabilizer
Mixture (2:4:4 in weight ratio) of
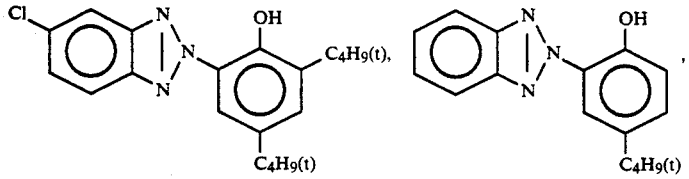
and
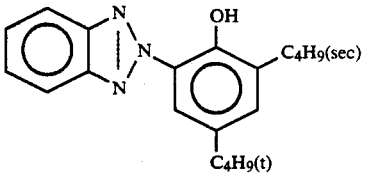
(Cpd-7) Image-dye stabilizer
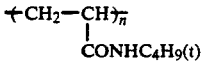
Average molecular weight: 60,000
(Cpd-8) Image-dye stabilizer
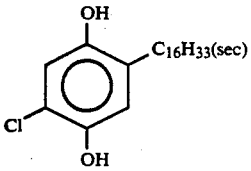
(Exemplified compound II-3)
(Cpd-9) Image-dye stabilizer -continued
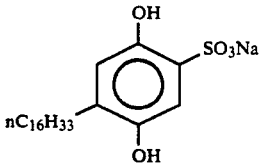
(exemplified compound III-1)
(Cpd-10) Image-dye stabilizer
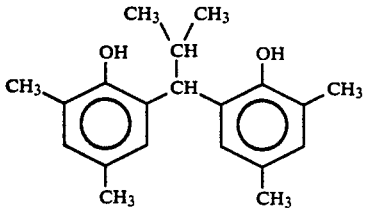
(Cpd-11) Antiseptic
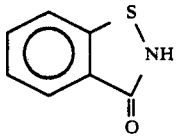
(Cpd-12) Antiseptic
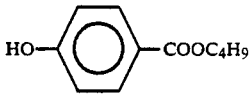
(UV-1) Ultraviolet ray absorber
Mixture (4:2:4 in weight ratio) of
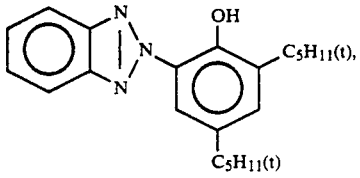
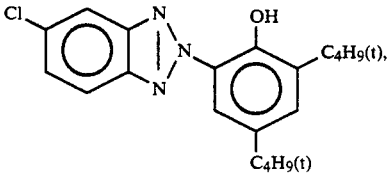
and
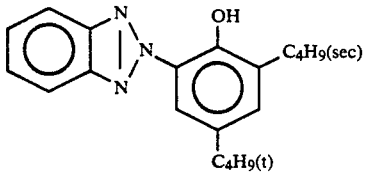
(Solv-1) Solvent
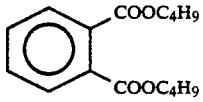
(Solv-2) Solvent
Mixture (1:1 in volume ratio)
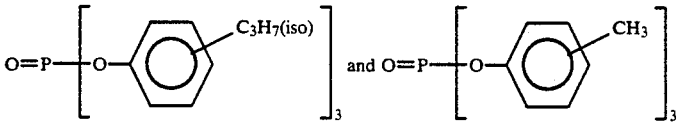

-continued (Solv-3) Solvent $O{=}P{+}O{-}C_9H_{19}(iso)]_3$ (Solv-4) Solvent

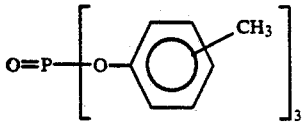

(Solv-5) Solvent $COOC_8H_{17}$
|
$(CH_2)_8$
|
$COOC_8H_{17}$ (Solv-6) Solvent
Mixture (80:20 in volume ratio) of

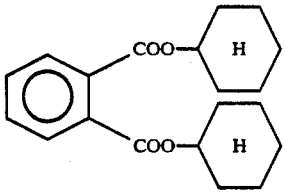

and $C_8H_{17}CHCH(CH_2)_7COOC_8H_{17}$ (epoxide)

(Solv-7) Solvent $C_8H_{17}CHCH(CH_2)_7COOC_8H_{17}$ (epoxide)

The thus-prepared color print paper was named Sample 103. Other color print papers were prepared in the same manner as Sample 103, except that the species of compound in red-sensitive emulsion layer was changed as shown in Table 1.

First, each of the samples was subjected to a gradation exposure to light through a three-color separated filter for sensitometry using a sensitometer (FWH model made by Fuji Photo Film Co., Ltd.; the color temperature of the light source was 3200° K.). At that time, the exposure was carried out in such a manner that the exposure amount was 250 CMS with the exposure time being 0.1 sec.

After exposure to light, each sample was subjected to a continuous processing (running test)according to the processing process shown below by using a paper processor, until the replenishing amount reached twice the volume of color developer in the tank.

| Processing step | Temperature | Time | Replenisher* | Tank Volume |
|---|---|---|---|---|
| Color developing | 35° C. | 45 sec | 102 ml | 17 liter |
| Bleach-fixing | 30–35° C. | 45 sec | 215 ml | 17 liter |
| Rinse (1) | 30–35° C. | 20 sec | — | 10 liter |
| Rinse (2) | 30–35° C. | 20 sec | — | 10 liter |
| Rinse (3) | 30–35° C. | 20 sec | 350 ml | 10 liter |
| Drying | 70–80° C. | 60 sec | | |

Note:
*Replenisher amount per $m^2$ of photographic material.
Rinsing steps were carried out in a 3-tank countercurrent mode from the tank of rinse (3) toward the tank of rinse (1).

The composition of each processing solution is as followed, respectively:

| | Tank Solution | Replenisher |
|---|---|---|
| Color-developer | | |
| Water | 800 ml | 800 ml |
| Ethylenediamine-N,N,N',N,-tetramethylene phosphonic acid | 1.5 g | 3.0 g |
| Potassium bromide | 0.015 g | — |
| Triethanolamine | 8.0 g | 14.5 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 9.5 g |
| N,N-Bis(carboxymethyl)hydrazine | 5.5 g | 7.0 g |
| Fluorescent whitening agent (WHITEX-4B, made by Sumitomo Chemical Ind.) | 1.0 g | 2.5 g |
| Water to make | 1000 ml | 1000 ml |
| pH (25° C.) | 10.05 | 10.60 |
| Bleach-fixing solution | | |
| Water | 400 ml | 150 ml |
| Ammonium thiosulfate (700 g/l) | 100 ml | 250 ml |
| Sodium sulfite | 17 g | 34 g |
| Iron (III) ammonium ethylenediaminetraacetate | 55 g | 110 g |
| Disodium ethylenediaminetetraacetate | 5 g | 8.5 g |
| Ammonium bromide | 40 g | 75.0 g |
| Water to make | 1000 ml | 1000 ml |
| pH (25° C.) | 5.8 | 5.6 |

Rinse solution (Both tank solution and replenisher)
Ion-exchanged water (calcium and magnesium each are 3 ppm or below)
With respect to thus-prepared samples the following evaluations (1) and (2) were carried out.

Evaluation (1)

-continued

The cyan density of the thus obtained color images was measured by a Fuji-densitometer (Mad-8509 model). These Samples were subjected to oxidation processing as follows:

| Oxidation processing | | |
|---|---|---|
| Processing step | Temperature | Time |
| Oxidation bath | 38° C. | 5 min |
| Washing with water | 15 to 23° C. | 10 min |
| Drying | 70 to 80° C. | 50 sec |
| Oxidation bath | | |
| Potassium ferricyanide | | 5 g |
| Water to make | | 1000 ml |

The cyan density of the Samples that had been subjected to the oxidation processing was again measured, the density before the oxidation processing at the exposure amount, where gave the Dmax after the oxidation processing, was read, and the extent of decrease of the density before the oxidation processing from the density after the oxidation processing was determined; that is, how much the insufficiency of color formation occurred was examined.

Evaluation (2)

The Samples that had been subjected to the oxidation processing was subjected to a 36-hour fading test by using a light fade-o-meter (xenon lamp: about 150,000 luxes). The density after the fading test at the exposure amount, where gave a cyan density of 2.0 after the oxidation processing, was read, and the extent of the fading was evaluated based on the difference in density.

Further, to evaluate the latent-image preservability, the Samples were exposed to light for sensitometry as described above, and 10 min and 36 hours after the exposure to light, the color developments were carried out respectively. They were compared, and in the Samples processed 10 min after the exposure to light, the change in density due to the passage of time (after 36 hours) at the exposure amount where a cyan density of 0.5 was given was used to evaluate the latent-image preservability.

TABLE 1

| Sample No. | Compound of formula (I) or formula (II) | Compound of formula (III) or formula (IV) | Compound of formula (V) to formula (VIII) |
|---|---|---|---|
| 101 | — | — | V-17 |
| 102 | II-3 | — | V-17 |
| 103 | II-3 | III-1 | V-17 |
| 104 | — | III-1 | V-17 |
| 105 | I-2 | — | V-17 |
| 106 | I-2 | III-1 | V-17 |
| 107 | II-20 | III-1 | V-17 |
| 108 | II-9 | III-1 | V-17 |
| 109 | II-3/I-2* | III-4/III-1** | V-17 |
| 110 | II-3 | IV-1 | V-17 |
| 111 | II-3 | IV-7 | VIII-1 |
| 112 | II-3 | III-1 | V-3 |
| 113 | II-3 | III-1 | VI-1 |
| 114 | II-3 | III-1 | VII-3 |
| 115 | II-3 | III-1 | Sens-1 |
| 116 | II-3 | III-1 | Sens-2 |
| 117 | II-3 | III-1 | Sens-3 |

Note;
*Mixture (1:1 in molar ratio)
** Mixture (1:1 in molar ratio)

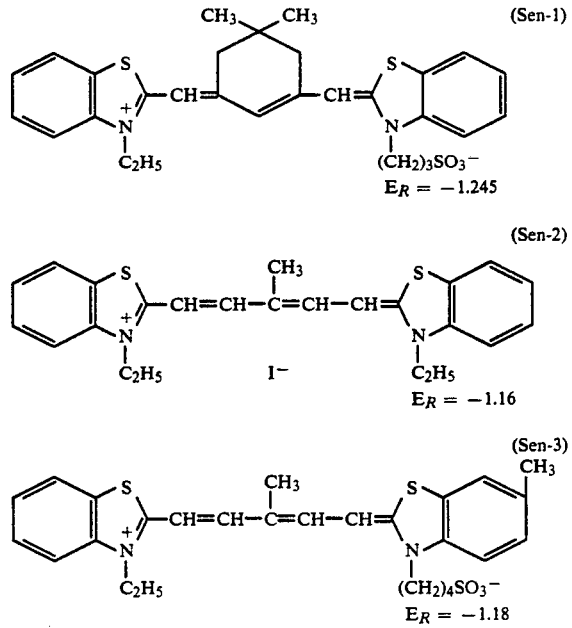

TABLE 2

| Sample No. | Insufficiency of color formation | Light-fading | Latent-image Preservability | Remarks |
|---|---|---|---|---|
| 101 | 0.22 | 0.07 | 0.07 | Comparative example |
| 102 | 0.08 | 0.12 | 0.12 | Comparative example |
| 103 | 0.04 | 0.04 | 0.02 | This invention |
| 104 | 0.23 | 0.12 | 0.07 | Comparative example |
| 105 | 0.08 | 0.13 | 0.12 | Comparative example |
| 106 | 0.05 | 0.05 | 0.02 | This invention |
| 107 | 0.04 | 0.04 | 0.02 | This invention |
| 108 | 0.04 | 0.04 | 0.01 | This invention |
| 109 | 0.04 | 0.04 | 0.01 | This invention |
| 110 | 0.04 | 0.05 | 0.02 | This invention |
| 111 | 0.05 | 0.04 | 0.01 | This invention |
| 112 | 0.05 | 0.05 | 0.02 | This invention |
| 113 | 0.05 | 0.05 | 0.02 | This invention |
| 114 | 0.05 | 0.05 | 0.01 | This invention |
| 115 | 0.04 | 0.05 | 0.18 | Comparative example |
| 116 | 0.05 | 0.04 | 0.21 | Comparative example |
| 117 | 0.05 | 0.05 | 0.21 | Comparative example |

As is apparent form the result in Table 2, from Samples 101, 102, and 105, by using compounds represented by formula (I) or (II), the color formation can be made better but the light-fading and the latent-image. preservability become poor. In contrast, it can be understood that, from Samples 102 to 104 and 113 to 117, when these compounds are used in combination with compounds represented by formula (III) or (IV) and red-sensitive sensitizing dyes having a reduction potential of −1.25 V (vs SCE) or more negative are also used, the color formation, the light fading, and the latent-image preservability are simultaneously improved.

That is, by comparing Sample 101 with Sample 102, it can be understood that when a compound of formula (II) is added, the color formation is improved but the light-fading and the latent-image preservability become poor. On the other hand, by comparing Sample 101 with Sample 104, it can be understood that when a compound of formula (III) is added, the light-fading becomes rather poor.

In contrast, from a comparison of Samples 102 and 104 with Sample 103, it can be understood that the addition of a combination of a compound of formula (I) and/or a compound of formula (II) with a compound of formula (III) and/or a compound of formula (IV) improves the color formation and the light-fading as well as the latent-image preservability more than expected.

From a comparison of Samples 103 and 106 to 114 with Samples 115 to 117, it can be understood that even when, for example, a compound of formula (I) and/or a compound of formula (II) and a compound of formula (III) and/or a compound of formula (IV) are added in combination, if the reduction potential of the used red-sensitive sensitizing dye is nobler than −1.25 V, the latent-image preservability is extremely poor, while if the reduction potential of the used red-sensitive sensitizing dye is baser than −1.25 V, the latent-image preservability is improved more than expected.

EXAMPLE 2

The procedure for Sample 103 in Example 1 was repeated, except that the cyan coupler was changed as shown in Table 3, thereby preparing Color Papers 201 to 206. Evaluation was carried out similarly to Example 1, and such results were obtained that, according to the present invention, regardless of the type of the cyan coupler, the extent of the insufficiency of color formation was 0.06 or less, the extent of the light fading was 0.06 or less, and the latent-image preservability was good.

TABLE 3

| Sample No. | Type of Cyan coupler |
|---|---|
| 201 | C-2/C-5 (3:2 in molar ratio) |
| 202 | C-4/C-5 (7:3 in molar ratio) |
| 203 | C-2/C-10 (i:2 in molar ratio) |
| 204 | C-5 |
| 205 | C-2/C-11 (1:1 in molar ratio) |
| 206 | C-18 |

Note:
The cyan couplers were used in a molar amount equivalent to the cyan coupler of Sample 101.

EXAMPLE 3

A multilayer color print paper (Sample 301) was prepared in the same manner as Sample 103 in Example 1. Then, Samples 302 to 314 were prepared in the sam manner, except that the species of compound in the red-sensitive emulsion layer were changed as shown in Table 4.

The thus prepared samples of color print paper were processed in the same manner as in Example 1.

After processing, each sample was subjected to the following tests.

Color Formation Test

The cyan density of the thus obtained color images was measured by a Fuji-densitometer (Mad-8509 model). These Samples were subjected to oxidation processing as follows:

| Oxidation processing | | |
|---|---|---|
| Processing step | Temperature | Time |
| Oxidation bath | 38° C. | 5 min |
| Washing with water | 15 to 23° C. | 10 min |
| Drying | 70 to 80° C. | 50 sec |
| Oxidation bath | | |
| Potassium ferricyanide | 5 g | |
| Water to make | 1000 ml | |

The cyan density of the Samples that had been subjected to the oxidation processing was again measured, the density before the oxidation processing, which gave the Dmax after the oxidation processing, was read, and the extent of decrease of the density before the oxidation processing from the density after the oxidation processing was determined; that is, how much the insufficiency of color formation occurred was examined.

Light-Fading Test

The Samples that had been subjected to the oxidation processing was subjected to a 36-hour fading test by using a light fade-o-meter (xenon lamp: about 150,000 luxes). The density after the fading test, which gave a cyan density of 2.00 after the oxidation processing, was read, and the extent of the fading was evaluated based on the difference in density.

Results are shown in Table 4.

TABLE 4

| Sample No. | Compound of formula (I) or (II) | Compound of formula (II) or (IV) | High-boiling solvent | Organic polymer compound | Insufficiency of color formation | Light-fading | Remarks |
|---|---|---|---|---|---|---|---|
| 301 | II-2 | III-1 | Solv-6 | P-17 | 0.04 | 0.04 | This invention |
| 302 | I-2/II-3*1 | III-1 | Solv-6 | P-17 | 0.04 | 0.04 | " |
| 303 | II-3 | III-1 | High-boiling solvent (A) | P-17 | 0.05 | 0.05 | " |
| 304 | I-2/II-3*1 | III-1 | High-boiling solvent (B) | P-17 | 0.05 | 0.05 | " |
| 305 | II-3 | III-1 | Solv-6 | — | 0.05 | 0.06 | " |
| 306 | I-2/II-3*1 | III-1 | Solv-6 | — | 0.05 | 0.06 | " |
| 307 | II-3 | III-1 | High-boiling solvent (A) | — | 0.08 | 0.07 | " |
| 308 | I-2/II-3*1 | III-1 | High-boiling solvent (B) | — | 0.08 | 0.06 | — |
| 309 | II-3 | — | High-boiling solvent (A) | — | 0.08 | 0.11 | Comparative example |
| 310 | I-2/II-3*1 | — | High-boiling solvent (B) | — | 0.08 | 0.11 | " |
| 311 | — | III-1 | High-boiling solvent (A) | — | 0.22 | 0.12 | " |
| 312 | — | III-1 | High-boiling solvent (B) | — | 0.21 | 0.13 | " |
| 313 | — | — | High-boiling solvent (A) | — | 0.22 | 0.04 | Comparative example |
| 314 | — | — | High-boiling | — | 0.22 | 0.04 | " |

TABLE 4-continued

| Sample No. | Compound of formula (I) or (II) | Compound of formula (II) or (IV) | High-boiling solvent | Organic polymer compound | Insufficiency of color formation | Light-fading | Remarks |
|---|---|---|---|---|---|---|---|
| | | | solvent (B) | | | | |

Note: *1Mixture (1:1 in weight ratio)
Solv-6 Mixture (80:20 in volume ratio) of

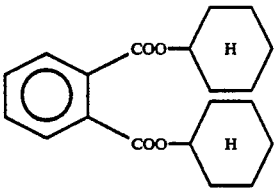

and $C_8H_{17}CHCH(CH_2)_7COOC_8H_{17}$ (O)

(Exemplified Compound S-5)
(Solid at 25° C.)
(40 cps at 25° C.)
Comparative high-boiling solvent (B)

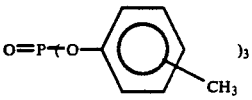

)3 (58 cps at 25° C.)

Comparative High-boiling solvent (C)

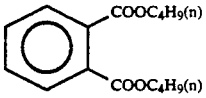

(20 cps at 25° C.)

As is apparent from the results in Table 4, by using a compound selected from the group consisting of those represented by formulae (I) and (II), the insufficiency of color formation can be improved, but the light-fading is deteriorated (comparison of Samples 309 and 310 with Samples 313 and 314). Further, when a compound selected from the group consisting of those represented by formulae (III) and (IV) is used, the effect for improving the insufficiency of color formation can not be attained at all, and the light-fading is deteriorated (comparison of Samples 311 and 312 with Samples 313 and 314).

On the other hand, when a compound selected from the compound group represented by formulae (I) and (II) and a compound selected from the compound group represented by formulae (III) and (IV) are used together, the insufficiency of color formation is improved and furthermore the deterioration on light-fading is reduced (Samples 307 and 308). Further, by using a high-boiling organic solvent having a viscous of 200 cps or more or an water-insoluble organic polymer, the insufficiency of color formation and the light-fastness are more improved. In particular, by the combination use thereof the insufficiency of color formation is improved without the deterioration of light-fastness (Samples 301 and 302).

EXAMPLE 4

Samples 401 to 424 of color print paper were prepared in the same manner as Sample 301 in Example 3, except that the compound of formula (I) or (II), the compound of formula (III) or (IV), the high-boiling organic solvent, and the organic polymer of Sample 301 were changed to compounds of equal weight as shown in Table 5, and the cyan coupler was changed to an equimolar mixture (7:3 in molar ratio) of Exemplified compounds V-4 and V-5. These samples were evaluated in the same manner as in Example 3. Results are shown in Table 5.

TABLE 5

| Sample No. | Compound of formula (I) or (II) | Compound of formula (II) or (IV) | High-boiling solvent | Organic polymer compound | Insufficiency of color formation | Light-fading | Remarks |
|---|---|---|---|---|---|---|---|
| 401 | II-2/II-3*1 | III-1 | S-1 | — | 0.05 | 0.06 | This invention |
| 402 | II-2/II-3*1 | III-1 | S-5 | — | 0.05 | 0.05 | This invention |
| 403 | II-2/II-3*1 | III-1 | S-16 | — | 0.05 | 0.06 | This invention |
| 404 | II-2/II-3*1 | III-1 | S-16 | — | 0.05 | 0.06 | This invention |
| 405 | II-2/II-3*1 | III-1 | High-boiling solvent (A) | — | 0.08 | 0.07 | This invention |
| 406 | II-2/II-3*1 | III-1 | High-boiling solvent (B) | — | 0.08 | 0.07 | This invention |
| 407 | II-2/II-3*1 | III-1 | High-boiling solvent (C) | — | 0.08 | 0.07 | This invention |
| 408 | II-2/II-3*1 | III-1 | High-boiling solvent (C) | P-1 | 0.05 | 0.06 | This invention |
| 409 | II-2/II-3*1 | III-1 | High-boiling solvent (C) | P-17 | 0.05 | 0.05 | This invention |
| 410 | II-2/II-3*1 | III-1 | High-boiling solvent (C) | P-53 | 0.05 | 0.06 | This invention |
| 411 | II-2/II-3*1 | III-1 | S-5 | P-1 | 0.04 | 0.04 | This invention |
| 412 | II-2/II-3*1 | III-1 | S-5 | P-17 | 0.04 | 0.04 | This invention |
| 413 | II-2/II-3*1 | III-1 | S-5 | P-53 | 0.04 | 0.04 | This invention |
| 414 | II-2/II-3*1 | — | High-boiling solvent (B) | — | 0.08 | 0.12 | Comparative example |

TABLE 5-continued

| Sample No. | Compound of formula (I) or (II) | Compound of formula (II) or (IV) | High-boiling solvent | Organic polymer compound | Insufficiency of color formation | Light-fading | Remarks |
|---|---|---|---|---|---|---|---|
| 415 | II-2/II-3*[1] | — | High-boiling solvent (C) | — | 0.08 | 0.12 | Comparative example |
| 416 | — | III-1 | High-boiling solvent (B) | — | 0.22 | 0.12 | Comparative example |
| 417 | — | III-1 | High-boiling solvent (C) | — | 0.22 | 0.12 | Comparative example |
| 418 | — | — | High-boiling solvent (B) | — | 0.22 | 0.04 | Comparative example |
| 419 | — | — | High-boiling solvent (C) | — | 0.22 | 0.04 | Comparative example |
| 420 | I-II | III-5 | High-boiling solvent (C) | — | 0.07 | 0.06 | This invention |
| 421 | II-15 | III-5 | High-boiling solvent (C) | — | 0.07 | 0.06 | This invention |
| 422 | II-21 | III-5 | High-boiling solvent (C) | — | 0.07 | 0.06 | This invention |
| 423 | II-2/II-3*[1] | IV-1 | High-boiling solvent (C) | — | 0.07 | 0.06 | This invention |
| 424 | II-2/II-3*[1] | IV-5 | High-boiling solvent (C) | — | 0.07 | 0.06 | This invention |

Note: *[1]Mixture (1:1 in weight ratio)
Comparative high-boiling solvent (C)

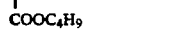

(20 cps at 25° C.)

As is apparent from the results in Table 5, in the case of being changed the cyan coupler, the combination use of the compound of formula (I) or (II) with the compound of formula (III) or (IV) is better in order to improve the insufficiency of color formation and light-fastness at the same time. It can be also understood that the additional use of the high-boiling organic solvent having a viscosity of 200 cps or more, or an water-insoluble organic polymer has a greater effect, in particular.

EXAMPLE 5

Color print papers 501 to 506 was prepared in the same manner as Sample 301 in Example 3, except that the cyan coupler was changed as shown in Table 6. The same evaluation as in Example 3 was carried out to obtain good results such as the degree of insufficiency of color formation being 0.08 or below and the degree of light-fading being 0.08 or below, regardless the kind of cyan coupler included in formula (X), according to the present invention.

TABLE 6

| Sample No. | Species of cyan coupler |
|---|---|
| 501 | V-2/V-5 (3:2 in molar ratio) |
| 502 | V-4/V-5 (8:2 in molar ratio) |
| 503 | V-2/V-10 (1:2 in molar ratio) |
| 504 | V-5 |
| 505 | V-2/V-11 (1:1 in molar ratio) |
| 506 | V-18 |

Note;
The cyan couplers were used in a molar amount equivalent to the cyan coupler of Sample 301.

EXAMPLE 6

Color print papers prepared in Example 4 were subjected to an exposure to light in the smae manner as in Example 3, and subjected to another imagewise exposure to light. These exposed samples were subjected to a continuous processing (running test) according to the processing process shown below by using a paper processor, until the replenishing amount reached twice the volume of color developer in the tank.

| Processing step | Temperature | Time | Replenisher* | Tank Volume |
|---|---|---|---|---|
| Color developing | 35° C. | 45 sec | 161 ml | 17 liter |
| Bleach-fixing | 30–36° C. | 45 sec | 215 ml | 17 liter |
| Stabilizing (1) | 30–37° C. | 20 sec | — | 10 liter |
| Stabilizing (2) | 30–37° C. | 20 sec | — | 10 liter |
| Stabilizing (3) | 30–37° C. | 20 sec | — | 10 liter |
| Stabilizing (4) | 30–37° C. | 20 sec | 248 ml | 10 liter |
| Drying | 70–85° C. | 60 sec | | |

Note:
*Replenisher amount per $m^2$ of photographic material.
Stabilizing steps were carried out in 4-tanks countercurrent mode from the tank of stabilizing (4) toward the tank of rinsing (1).

The compounds of each processing solution is as followed, respectively:

| | Tank Solution | Replenisher |
|---|---|---|
| Color-developer | | |
| Water | 800 ml | 800 ml |
| Ethylenediaminetetraacetic acid | 2.0 g | 2.0 g |
| 5,6-Dihydroxybenzene-1,2,4-trisulfonic acid | 0.3 g | 0.3 g |
| Triethanolamine | 8.0 g | 8.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| Diethylhydroxylamine | 4.2 g | 6.0 g |
| Fluorescent whitening agent (4,4'-diaminostilbene) | 2.0 g | 2.5 g |
| Water to make | 1000 ml | 1000 ml |
| pH (25° C.) | 10.05 | 10.45 |

Bleach-fixing solution
(Both tank solution and replenisher)

| | |
|---|---|
| Water | 400 ml |
| Ammonium thiosulfate (700 g/1) | 100 ml |
| Sodium sulfite | 17 g |
| Iron (III) ammonium ethylenediaminetraacetate | 55 g |
| Disodium ethylenediaminetetraacetate | 5 g |

-continued

| | |
|---|---|
| Glacial acetic acid | 9 g |
| Water to make | 1000 ml |
| pH (25° C.) | 5.40 |
| Stabilizing solution (Both tank solution and replenisher) | |
| Formalin (37%) | 0.1 g |
| Formalin-sulfurus acid adduct | 0.7 g |
| 5-Chloro-2-methyl-4-isothiazoline-3-one | 0.02 g |
| 2-Methyl-4-isothiazoline-3-one | 0.01 g |
| Copper sulfate | 0.005 g |
| Water to make | 1000 ml |
| pH (25° C.) | 4.0 |

Using processed samples the same evaluation as Example 3 was conducted to obtain the similar good results.

Having described our invention as related to the present embodiments, is it our intention that the invention not be limited by any of the details of the description, unless otherwise specified, but rather be construed broadly within its spirit and scope as set out in the accompanying claims.

What we claim is:

1. A multilayer silver halide color photographic material comprising a support having thereon a yellow color-forming silver halide emulsion layer, a magenta color-forming silver halide emulsion layer, and a cyan color-forming silver halide emulsion layer, which comprises, in said color-forming silver halide emulsion layers, silver halide grains that are composed of silver chloride or silver chlorobromide having a silver chloride content of 80 mol% or more substantially free from silver iodide, said silver halide grains in said cyan color-forming layer being spectrally sensitized with at least one red-sensitive sensitizing dye having a reduction potential of −1.25 V (vs SCE) or more negative, and at least one compound represented by the following formula (I) or (II) and at least one compound represented by the following formula (III) or (IV) in said cyan color-forming silver halide emulsion layer:

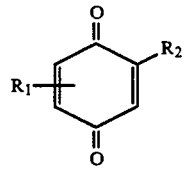

Formula (I)

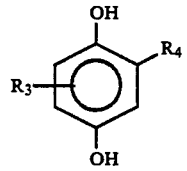

Formula (II)

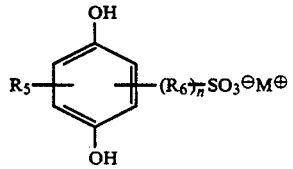

Formula (III)

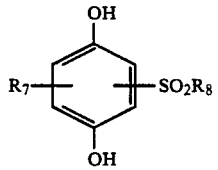

Formula (IV)

wherein $R_1$ and $R_3$ each represent a hydrogen atom, an alkyl group, or a halogen atom, $R_2$, $R_4R_5$, $R_7$, and $R_8$ each represent independently an alkyl group, an aryl group, an alkoxy group, an aryloxy group, alkythio group, an arylthio group, an amido group, an acyl group, an alkoxycarbonyl group, and aryloxycarbonyl group, a carbamoyl group, a sulfamoyl group, or a sulfoxide group, the number of carbon atoms of each of $R_2$ and $R_4$ is 6 or more, $R_6$ represents an alkylene group, n is 0 or 1, and $M\oplus$ represents a cation.

2. The silver halide color photographic material as claimed in claim 1, wherein said red-sensitive sensitizing dye is selected from the group consisting of red-sensitive sensitizing dyes represented by formulae (V), (VI), (VII), and (VIII):

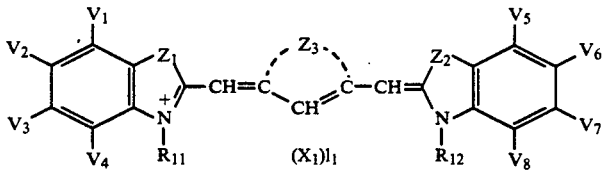

Formula (V)

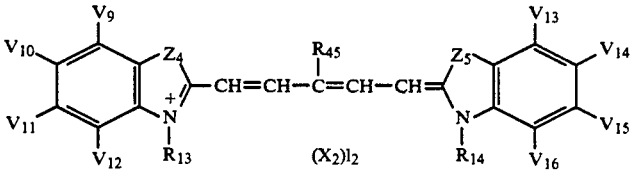

Formula (VI)

-continued

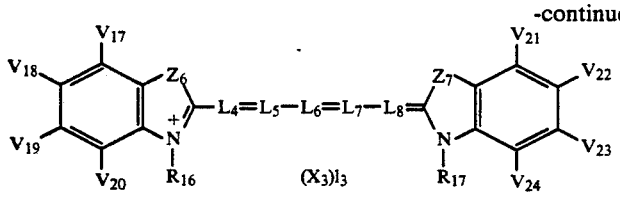

Formula (VII)

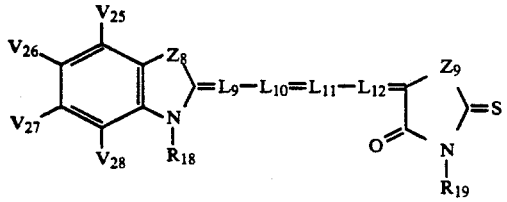

Formula (VIII)

wherein $Z_1$, $Z_2$, $Z_4$, and $Z_5$ each represent a sulfur atom or a selenium atom; $Z_6$ and $Z_7$ each represents an oxygen atom, a sulfur atom, a selenium atom, or a nitrogen atom, with at least one of $Z_6$ and $Z_7$ being an oxygen atom or a nitrogen atom; $Z_8$ represent an oxygen atom, a sulfur atom, a selenium atom, or a nitrogen atom, $Z_9$ represents an oxygen atom, a sulfur atom, or a nitrogen atom, $Z_3$ represents a group of atoms required for forming a 5- or 6-membered ring; $R_{11}$, $R_{12}$, $R_{13}$, $R_{14}$, $R_{16}$, $R_{17}$, and $R_{18}$, which may be the same or different, each represent an alkyl group; $R_{16}$ and $L_4$ and/or $R_{17}$ and $L_8$ and/or $R_{18}$ and $L_9$ may bond together to form a 5- or 6-membered ring; $R_{19}$ represents an alkyl group, an aryl group, or a heteroxyclic group; $R_{15}$ represents an alkyl group or an alkoxy group; $V_1$, $V_2$, $V_3$, $V_4$, $V_5$, $V_6$, $V_7$, $V_8$, $V_9$, $V_9$, $V_{10}$, $V_{11}$, $V_{12}$, $V_{13}$, $V_{14}$, $V_{15}$, $V_{16}$, $V_{17}$, $V_{18}$, $V_{19}$, $V_{20}$, $V_{21}$, $V_{22}$, $V_{23}$, $V_{24}$, $V_{25}$, $V_{26}$, $V_{27}$, and $V_{28}$ each represent a hydrogen atom, a halogen atom, an alkyl group, an acyl group, an acyloxy group, an alkoxycarbonyl group, a carbamoyl group, a sulfamoyl group, a carboxyl group, a cyano group, a hydroxyl group, an amino group, an acylamino group, an alkoxy group, an alkylthio group, an alkylsulfonyl group, a sulfonic acid group, an aryloxy group, or an aryl group, among $V_{17}$ to $V_{28}$, these two which are bonded to adjacent carbon atoms may form a condensed ring, the Hammet $\sigma p$ values of $V_1$ to $V_8$, when their Hammet $\sigma p$ values are designated $\sigma pi$ (i=1 to 8), and when $Y_1=\sigma p_1+\sigma p_2+\sigma p_3+\sigma p_4+\sigma p_5+\sigma p_6+\sigma p_7+\sigma p_8$, being represented by $Y_1 \leqq --0.15$; the Hammett $\sigma p$ values of $V_9$ to $V_{16}$, when their Hammet $\sigma p$ value is designated $\sigma pi$ (i=9 to 16), and when $Y_2=\sigma p_9+\sigma p_{10}+\sigma p_{11}+\sigma_{12}+\sigma p_{13}+\sigma p_{14}+\sigma p_{15}+\sigma p_{16}$, being which may be unsubstituted or substituted; and $(X_1)l_1$, $(X_2l_2$, and $(X_3)l_3$each represent an electric charge balancing counter ion and $l_1$, $l_2$, and $l_3$ each represent a value required to neutralize the electric charge higher than 0.

3. The silver halide color photographic material as claimed in claim 1, wherein the amount of compound represented by formula (I) or (II) to be used is 0.1 to 100 mol% per mol of cyan coupler.

4. The silver halide color photographic material as claimed in claim 1, wherein the amount of compound represented by formula (I) or (II) to be used is 0.5 to 30 mol% per mol of cyan coupler.

5. The silver halide color photographic material as claimed in claim 1, wherein the amount of compound represented by formula (III) or (IV) to be used is 0.1 to 100 mol% per mol of cyan coupler.

6. The silver halide color photographic material as claimed in claim 1, wherein the amount of compound represented by formula (III) or (IV) to be used is 0.5 to 30 mol% per mol of cyan coupler.

7. The silver halide color photographic material as claimed in claim 1, wherein the compound represented by formula (I), (II), (III), or (IV) is present in the oil droplets in which the cyan coupler is present.

8. The silver halide color photographic material as claimed in claim 2, wherein the amount of compound represented by formula (V), (VI), (VII), or (VIII) to be used is $1\times10^{-6}$ to $1\times10^{-3}$ mol per mol of silver halide.

9. The silver halide color photographic material as claimed in claim 1, wherein the compound represented by the following formula (IX) is used at the sensitization of the silver halide grains:

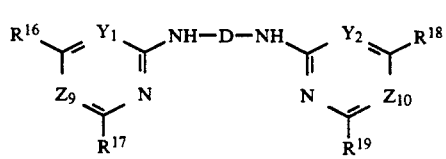

Formula (IX)

wherein D represents a divalent aromatic residue, and $R^{16}$, $R^{17}$, $R^{18}$, and $R^{19}$ each represent a hydrogen atom, a hydroxyl group, an alkoxy group, an aryoxy group, a halogen atom, a heterocyclic group, a mercapto group, an alkylthio group, an arylthio group, a heteroxyclythio group, an amino group, an alkylamino group, a cyclohexylamin group, an arylamino group, a heterocyclylamino group, an aralkylamino group, or an aryl group. $Z_9$ and $Y_1$ each represent —N= or —CH= provided that at least one of $Z_9$ and $Y_1$ is —N=, and $Z_{10}$ and $Y_2$ each represent —N= or —CH= provided that at least one of $Z_{10}$ and $Y_2$ is —N=.

10. The silver halide color photographic material as claimed in claim 1, wherein silver halide grains having a silver chloride contents of 90 mol% or more and at least one oil-soluble cyan coupler that cause coupling reaction with the oxidized product of an aromatic primary amine developing agent to form a substantially nondiffusible dye are contained in said cyan color-forming silver halide emulsion layer.

11. A multilayer silver halide color photographic material containing a support having thereon a yellow color-forming silver halide emulsion layer, a magenta color-forming silver halide emulsion layer, and a cyan color-forming silver halide emulsion layer, which comprises, in said cyan color-forming silver halide emulsion layer, silver halide grains having a silver chloride content of 90 mol% or more, at least one oil-soluble cyan coupler that cause coupling reaction with the oxidized product of an aromatic primary amine developing-agent to form a substantially nondiffusible dye, at least one compound selected from the group consisting of compounds represented by formula (I) and (II), and at least one compound selected from the group consisting of compounds represented by formulae (III) and (IV):

Formula (I)

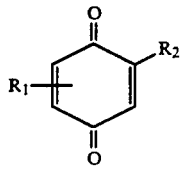

Formula (II)

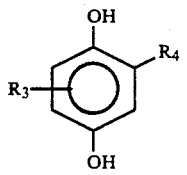

Formula (III)

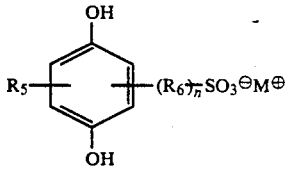

Formula (IV)

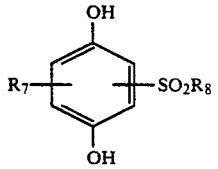

wherein $R_1$ and $R_3$ each represent a hydrogen atom, an alkyl group, or a halogen atom, $R_2$, $R_4$, $R_5$, $R_7$, and $R_8$ each represent independently an alkyl group, an aryl group, an alkoxy group, an aryloxy group, alkylthio group, an arylthio group, an amido group, an acyl group, an alkoxycarbonyl group, an aryloxycarbonyl group, a carbamoyl group, a sulfamoyl group, or a sulfoxido group, the number of carbon atoms of each of $R_2$ and $R_4$ is 6 or more, $R_6$ represents an alkylene group, n is 0 or 1, and $M^+$ represents a cation.

12. The silver halide color photographic material as claimed in claim 11, wherein said cyan coupler is represented by formula (X):

Formula (X)

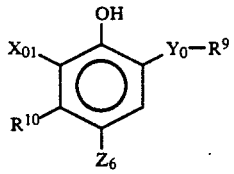

wherein $Y_0$ represents —NHCO— or —CONH—, $R^9$ represents an alkyl group, an aryl group, a heterocyclic group, or an amino group, $X_0$ represents a hydrogen atom, a halogen atom, an alkoxy group, or an acylamino group, $R^{10}$ represents an alkyl group or an acylamino group, $X_0$ and $R^{10}$ together may represent a group of nonmetallic atoms to form a 5- to 7-membered ring, and $Z_0$ represents an atom or a group capable of being released upon coupling reaction with the oxidized product of a developing agent.

13. The silver halide color photographic material as claimed in claim 11, wherein said cyan color-forming layer contains at least one high-boiling organic solvent having a viscosity of 200 cps or more at 25° C.

14. The silver halide color photographic material as claimed in claim 11, wherein the weight ratio of the high-boiling organic solvent to the cyan coupler is 0.05 to 2.0.

15. The silver halide color photographic material as claimed in claim 11, wherein said cyan color-forming layer contains a water-insoluble organic polymer compound.

16. The silver halide color photographic material as claimed in claim 15, wherein the weight ratio of the water-insoluble polymer to the cyan coupler is 20 to 20 : 1.

17. The silver halide color photographic material as claimed in claim 12, wherein the coating amount of cyan coupler represented by formula (X) is $1.0\times10^{-5}$ to $2.0\times10^{-3}$ mol per square meter of photographic material.

18. The silver halide color photographic material as claimed in claim 11, wherein the amount of compound represented by formula (I) or (II) to be used is 0.1, to 100 mol% per mol of cyan coupler.

19. The silver halide color photographic material as claimed in claim 11, wherein the amount of compound represented by formula (I) or (II) to be used is 0.5 to 30 mol% per mol of cyan coupler.

20. The silver halide color photographic material as claimed in claim 11, wherein the amount of compound represented by formula (III) or (IV) to be used is 0.1 to 100 mol% per mol of cyan coupler.

21. The silver halide color photographic material as claimed in claim 11, wherein the amount of compound represented by formula (III) or (IV) to be used is 0.5 to 30 mol% per mol of cyan coupler.

22. The silver halide color photographic material as claimed in claim 11, wherein the compound represented by formula (I), (II), (III), or (IV) is present in the oil droplets in which the cyan coupler is present.

23. The silver halide color photographic material as claimed in claim 2, wherein $L_4$–$L_{12}$ each represent a methane group which may be substituted by an alkyl group, an aryl group or a halogen atom or may form a ring together with other methane groups.

* * * * *